US007842444B2

(12) United States Patent
Nukada et al.

(10) Patent No.: US 7,842,444 B2
(45) **Date of Patent: *Nov. 30, 2010**

(54) ELECTROPHOTOGRAPHIC PHOTORECEPTOR, PROCESS CARTRIDGE, IMAGE FORMING APPARATUS AND COATING COMPOSITION

(75) Inventors: Katsumi Nukada, Kanagawa (JP); Masahiro Iwasaki, Kanagawa (JP); Wataru Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 820 days.

This patent is subject to a terminal disclaimer.

(21) Appl. No.: 11/727,473

(22) Filed: Mar. 27, 2007

(65) Prior Publication Data

US 2007/0231721 A1 Oct. 4, 2007

(30) Foreign Application Priority Data

Mar. 28, 2006 (JP) ..... 2006-087913

(51) Int. Cl.
*G03G 5/00* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS 6,416,915 B1 7/2002 Kikuchi et al.
7,585,603 B2 * 9/2009 Yamada et al. ..... 430/58.7
2003/0129512 A1 7/2003 Sugino et al.
2003/0186145 A1 10/2003 Morikawa et al.
2004/0265716 A1 12/2004 Itami et al.
2006/0029870 A1 2/2006 Nukada et al.

FOREIGN PATENT DOCUMENTS

EP 1 246 016 A2 10/2002
EP 1 321 456 A2 6/2003
JP A 2000-19749 1/2000
JP A 2000-66424 3/2000
JP A-2002-006527 1/2002
JP A-2002-075644 3/2002
JP A-2002-082466 3/2002
JP A 2002-82469 3/2002
JP B2 3287678 3/2002
JP A-2003-186215 7/2003
JP A-2003-186234 7/2003
JP A-2005-053845 3/2005

(Continued)

OTHER PUBLICATIONS

U.S. Office Action issued Nov. 1, 2007 in U.S. Appl. No. 11/444,483.

(Continued)

*Primary Examiner*—Mark A Chapman
(74) *Attorney, Agent, or Firm*—Oliff & Berridge, PLC

(57) ABSTRACT

The invention provides an electrophotographic photoreceptor comprising a conductive substrate having a photosensitive layer and a protective layer thereon, the protective layer comprising a crosslinked film having a phenolic structure, in which the relationship between a pH of the exfoliated protective layer extracted with distilled water ($pH_{OCL}$) and a pH of said distilled water ($pH_w$) satisfies the following formula (A): $pH_{OCL}-pHW \leqq 0.5$.

16 Claims, 4 Drawing Sheets

FOREIGN PATENT DOCUMENTS

| | | |
|---|---|---|
| JP | A 2005-234546 | 9/2005 |
| JP | A-2006-078774 | 3/2006 |
| JP | A-2006-084711 | 3/2006 |
| KR | 2003-0053450 A | 6/2003 |

OTHER PUBLICATIONS

U.S. Office Action issued Apr. 30, 2008 in U.S. Appl. No. 11/444,483.

Advisory Action issued Aug. 11, 2008 in U.S. Appl. No. 11/444,483.

U.S. Office Action issued Dec. 8, 2008 in U.S. Appl. No. 11/444,483.

Notice of Allowance issued Jun. 15, 2009 in U.S. Appl. No. 11/444,483.

"Handbook of Plastic Foams Types, Properties, Manufacture, and Applications," Handrock, Arthur, Noyes Publications, Park Ridge, NJ. 1995. pp. 183-184.

* cited by examiner

ELECTROPHOTOGRAPHIC PHOTORECEPTOR, PROCESS CARTRIDGE, IMAGE FORMING APPARATUS AND COATING COMPOSITION

CROSS-REFERENCE TO RELATED APPLICATIONS

This application is based on and claims priority under 35 USC 119 from Japanese Patent Application No. 2006-87913 filed on Mar. 28, 2006.

BACKGROUND

1. Technical Field

The invention relates to an electrophotographic photoreceptor, a process cartridge, an image forming apparatus, and a coating composition used for the electrophotographic photoreceptor.

2. Related Art

Generally, an electrophotographic image forming apparatus has the following structure and processes. Specifically, the surface of an electrophotographic photoreceptor is uniformly charged by a charging means to desired polarity and potential, and the charged surface of the electrophotographic photoreceptor is selectively removed of charge by subjecting to image-wise exposure to form an electrostatic latent image. The latent image is then developed into a toner image by attaching a toner to the electrostatic latent image by a developing means, and the toner image is transferred to an image-receiving medium by a transfer means, then the image-receiving medium is discharged as an image formed material.

Electrophotographic photoreceptors are currently been widely used in the field of copying machines, laser beam printers and other apparatus due to advantages of high speed and high printing quality. As electrophotographic photoreceptors used in image forming apparatus, organic photoreceptors using organic photoconductive materials are mainly used which are superior in cost efficiency, manufacturability and disposability, compared to conventionally used electrophotographic photoreceptors using inorganic photoconductive materials such as selenium, selenium-tellurium alloy, selenium-arsenic alloy and cadmium sulfide.

As a charging method, a corona charging method utilizing a corona charging device has been conventionally used. However, a contact charging method having advantages such as low ozone production and low electricity consumption has recently been put into practical used and is widely used. In the contact charging method, the surface of a photoreceptor is charged by bringing a conductive member as a charging member into contact with, or in close proximity to, the surface of the photoreceptor, and applying a voltage to the charging member. There are two methods of applying a voltage to the charging member: a direct current method in which only a direct current voltage is applied, and an alternating current superimposition method in which a direct current voltage superimposed by an alternating current voltage is applied. The contact charging method has advantages of downsizing the apparatus and suppressing generation of harmful gases such as ozone, but at the same time has disadvantages of being easily degraded and worn due to a direct charging on the surface of a photoreceptor.

As a transfer method, a method of transferring directly to a paper has conventionally been the mainstream. However, a method of transferring to a paper via an intermediate transfer body, in which a wider variety of paper can be used, is currently frequently used.

In conducting direct charging or using an intermediate transfer body, there can be a problem of damaging or stabbing of a photoreceptor due to foreign matter involved in an image forming apparatus and pinched between an intermediate transfer body and a photoreceptor, thereby easily causing a photoreceptor leak (a local flow of an excessive current through a photoreceptor). Problems such as a photoreceptor leak also tend to be aggravated by the intensified abrasion which occurs in the direct charging.

To overcome such problems, there has been proposed a way to enhance the strength of the photoreceptor by providing a protective layer on the surface of an electrophotographic photoreceptor.

A protective layer using a phenolic resin is superior in producing a stable image over the long-term because of its high gas barrier property and high resistance against strong oxidizing gases such as discharge products.

However, the phenolic resin has had serious problems such as significantly low adhesiveness to the underlying charge transporting layer due to a great degree of volumetric shrinkage during curing, intense occurrence of ghosts during repeated image forming which may be caused by microvoids being generated between the protective layer and the charge transporting layer due to poor adhesiveness of the phenolic resins, and unstable potential characteristics.

SUMMARY

According to an aspect of the invention, there is provided an electrophotographic photoreceptor comprising a conductive substrate having a photosensitive layer and a protective layer thereon, the protective layer comprising a crosslinked film having a phenolic structure, in which the relationship between the pH of the exfoliated protective layer extracted with distilled water ($pH_{OCL}$) and the pH of said distilled water ($pH_w$) satisfies the following formula (A):

$$pH_{OCL}-pH_w \leqq 0.5 \quad (A)$$

BRIEF DESCRIPTION OF THE DRAWINGS

Embodiments of the present invention will be described in detail based on the following figures, wherein.

DETAILED DESCRIPTION

Figure 1:
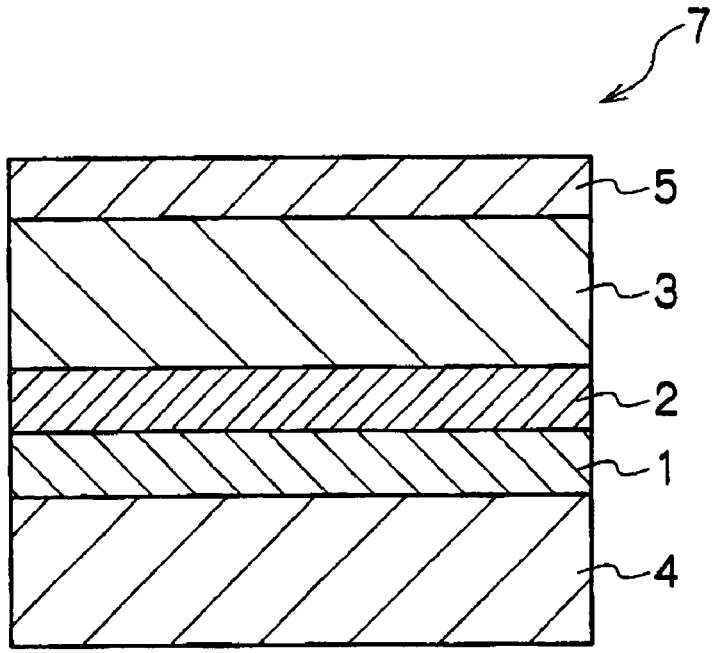
FIG. 1 is a schematic partial sectional view showing a preferred embodiment of an electrophotographic photoreceptor of the invention.

The invention relates to an electrophotographic photoreceptor comprising a conductive substrate having a photosensitive layer and a protective layer thereon, the protective layer comprising a crosslinked film having a phenolic structure, in which the relationship between a pH of the exfoliated protective layer extracted with distilled water ($pH_{OCL}$) and a pH of said distilled water ($pH_w$) satisfies the following formula (A):

$$pH_{OCL}-pH_w \leqq 0.5 \quad (A)$$

The electrophotographic photoreceptor of the invention, in which the relationship between the pH of the exfoliated protective layer extracted with distilled water pH ($pH_{OCL}$) and the pH of the distilled water ($pH_w$) satisfies the above-described formula (A), exhibits stable electrical and image characteristics and produces stable images even with repeated use over the long-term.

The reason why the above-described effects can be achieved in the electrophotographic photoreceptor of the invention is not necessarily evident, but the inventors presume the following. Specifically, by neutralizing a basic catalyst, which is used in synthesizing a phenolic resin and the residual thereof forms an charge trapping, so as to satisfy the above-described formula (A) as a layer, the charge trapping is reduced and generation of a potential cycle-up can be suppressed.

By using the electrophotographic photoreceptor of the invention, stabbing in the photoreceptor caused by conductive foreign matter coming from inside and outside the image forming apparatus is reduced, and occurrence of leaks can be prevented. Moreover, film abrasion of the photosensitive layer of the electrophotographic photoreceptor can be suppressed, which also prevents the occurrence of leaks in the case of repeated use over the long-term.

In the electrophotographic photoreceptor of the invention, the crosslinked film having a phenolic structure preferably has an charge transporting property.

In the electrophotographic photoreceptor, it is preferable that the crosslinked film with a phenolic structure has the charge transporting property, in that stable electrical characteristics of the photoreceptor can be obtained by having a function of transporting the charge, as well as a highly strong surface layer of the obtained electrophotographic photoreceptor.

In the electrophotographic photoreceptor of the invention, the protective layer is preferably a film formed by applying a coating solution containing a phenolic resin and at least one of the compounds represented by the following Formulae (I) to (V), and curing.

$$F—[(X_1)_n R_1—CO_2H]_m \quad \text{Formula (I)}$$

(In Formula (I), F represents an organic group derived from a compound having a hole transporting ability, $R_1$ represents an alkylene group, m denotes an integral number of 1 to 4, $X_1$ represents an oxygen atom or a sulfur atom, and n denotes 0 or 1.)

$$F—[(X_2)_{n1}—(R_2)_{n2}—(Z_2)_{n3}G]_{n4} \quad \text{Formula (II)}$$

(In Formula (II), F represents an organic group derived from a compound having a hole transporting ability, $X_2$ represents an oxygen atom or a sulfur atom, $R_2$ represents an alkylene group, $Z_2$ represents an alkylene group, an oxygen atom, a sulfur atom, NH or COO, G represents an epoxy group, n1, n2 and n3 each independently denotes an integral number of 0 or 1, and n4 denotes an integral number of 1 to 4.)

Formula (III)

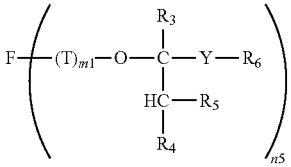

(In Formula (III), F represents an organic group having a valence of n5 and a hole transporting ability, T represents a group having a valence of 2, Y represents an oxygen atom or a sulfur atom, $R_3$, $R_4$ and $R_5$ each independently represent a hydrogen atom or a monovalent organic group, $R_6$ represents a monovalent organic group, m1 denotes an integral number of 0 or 1, and n5 denotes an integral number of 1 to 4. $R_5$ and $R_6$ may be bonded to each other to form a heterocyclic ring with Y as the heteroatom.)

Formula (IV)

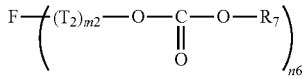

(In Formula (IV), F represents an organic group having a valence of n6 and a hole transporting ability, $T_2$ represents a group having a valence of 2, $R_7$ represents a monovalent organic group, m2 denotes an integral number of 0 or 1, and n6 denotes an integral number of 1 to 4.)

Formula (V)

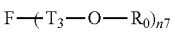

(In Formula (V), F represents an organic group having a valence of n7 and a hole transporting ability, $T_3$ represents a divalent alkylene group, $R_0$ represents a monovalent organic group, and n7 denotes an integral number of 1 to 4.)

By including a phenolic resin and at least one of the compounds represented by the above-described Formulae (I) to (V) in the protective layer of the electrophotographic photoreceptor, the protective layer of the electrophotographic photoreceptor can achieve both mechanical hardness and electrical characteristics in a high level.

The compounds represented by the above-described Formulae (I) to (V) are preferably compounds represented by the following Formula (VI).

Formula (VI)

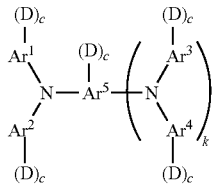

[In Formula (VI), $Ar^1$ to $Ar^4$ may be the same or different, each independently represent a substituted or unsubstituted aryl group, $Ar^5$ represents a substituted or unsubstituted aryl group or arylene group, each of c independently denotes 0 or 1, k denotes 0 or 1, D represents a group selected from the following Formulae (VII) to (XI), and the total number of D is 1 to 4.]

$$—(X_1)_n R_1—CO_2H \quad \text{Formula (VII)}$$

$$—(X_2)_{n1}(R_2)_{n2}—(Z_2)_{n3}G \quad \text{Formula (VIII)}$$

Formula (IX)

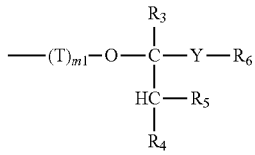

-continued

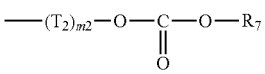

Formula (X)

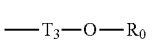

Formula (XI)

The symbols in Formulae (VII) to (XI) are the same as those in Formulae (I) to (V).

By containing the above-described compounds, the protective layer in the electrophotographic photoreceptor of the invention can obtain stable electrical characteristics over the longer period of time.

The protective layer of the electrophotographic photoreceptor of the invention is preferably produced by using a sulfur-containing material as a curing catalyst.

By using the sulfur-containing material as a curing catalyst in producing the protective layer, excellent property of the sulfur-containing material as a curing catalyst sufficiently accelerates the curing reaction of the phenolic resin and improves the mechanical strength of the obtained protective layer. Moreover, when a curable resin composition further contains compounds represented by the above-described Formulae (I) to (V), the sulfur-containing material also exhibits an excellent property as a dopant for these charge transporting substances to improve the electrical characteristics of the obtained functional layer. Consequently, the electrophotographic photoreceptor of the invention can achieve all of the mechanical strength, film-forming ability and electrical characteristics in a high level.

In the electrophotographic photoreceptor of the invention, the crosslinked film having a phenolic structure is preferably formed by using a coating agent composition containing a phenol-based resin obtained by dissolving a crosslinked film precursor material having a phenolic structure in a solvent and bringing the material into contact with an acidic substance.

The process cartridge of the invention integrally comprises the above-described electrophotographic photoreceptor of the invention and a device selected from the group consisting of a charging device and an exposure device. The process cartridge is detachable from the main body of the image forming apparatus.

The image forming apparatus of the invention comprises the above-described electrophotographic photoreceptor of the invention, a charging device for charging the surface of the electrophotographic photoreceptor, an exposure device for forming an electrostatic latent image by exposing the surface of the electrophotographic photoreceptor, a developing device for developing the latent image, and a transfer device for transferring a developed image to an image-receiving medium.

The coating agent composition of the invention is a composition which forms a crosslinked film having a phenolic structure by heating. The coating agent composition contains a phenolic resin obtained by dissolving a crosslinking film precursor material having a phenolic structure in a solvent, then bringing into contact with an acidic substance.

By forming the protective layer of an electrophotographic photoreceptor using the coating agent composition of the invention, the composition containing a phenolic resin obtained by dissolving a crosslinking film precursor material having a phenolic structure in a solvent and bringing into contact with an acidic substance, the electrophotographic photoreceptor can exhibit stable electrical and image characteristics and produce stable images in repeated use over the long time when the relationship between the pH of the exfoliated protective layer extracted with distilled water ($pH_{OCL}$) and the pH of the distilled water ($pH_w$) satisfies the above-described Formula (A).

The crosslinking film precursor material having a phenolic structure is preferably a resol type phenolic resin produced by using a basic catalyst.

By containing a resol type phenolic resin in the coating agent composition, a film having a high mechanical strength can be formed.

The acidic substance is preferably a solid acid. By using a solid acid as an acidic substance in the coating agent composition, the adhesiveness of the formed film can be enhanced.

Preferred embodiments of the invention are illustrated in detail with reference to FIG. 1 to FIG. 5. In the figures, same or corresponding elements are indicated by the same reference numerals, and overlapping explanation is omitted.

(Electrophotographic Photoreceptor)

FIG. 1 is a schematic sectional view showing a preferred embodiment of the electrophotographic photoreceptor of the invention.

The electrophotographic photoreceptor 7 shown in FIG. 1 comprises a conductive substrate 4 having a subbing layer 1 thereon, a photosensitive layer comprising a charge generating layer 2 and an charge transporting layer 3, which are formed on the subbing layer 1, and a protective layer 5 as the surface. The protective layer 5 is a protective layer of the invention. The relationship between the pH of the exfoliated protective layer extracted with distilled water pH ($pH_{OCL}$) and the pH of the distilled water ($pH_w$) satisfies the following Formula (A).

$$pH_{OCL}-pH_w \leqq 0.5 \quad \text{Formula (A)}$$

Figure 2:
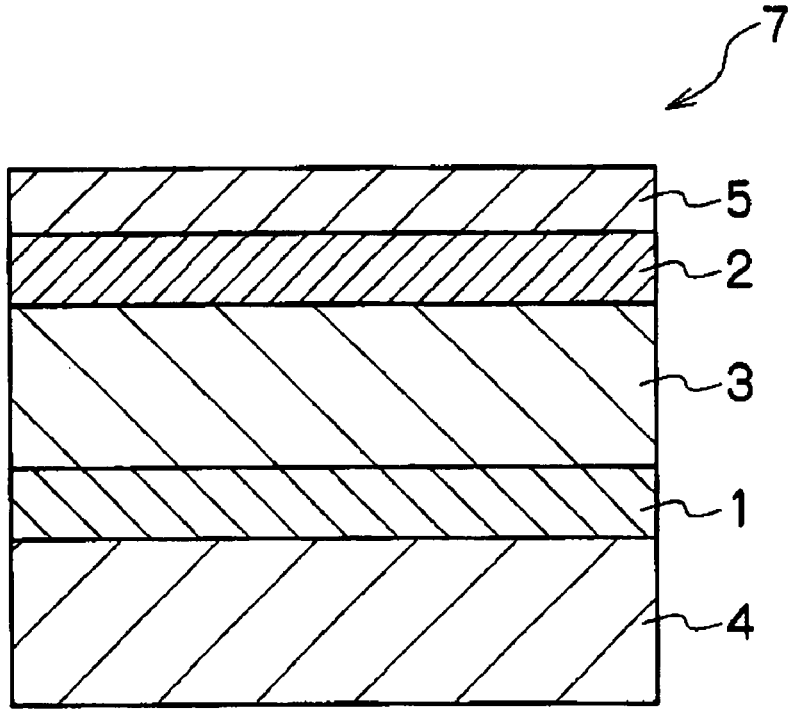
FIG. 2 is a schematic partial sectional view showing another preferred embodiment of the electrophotographic photoreceptor of the invention.
Figure 3:
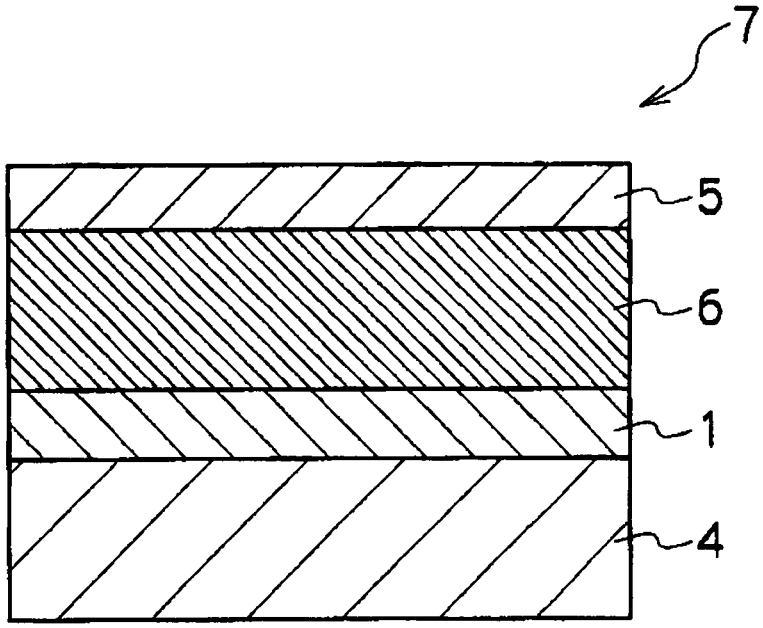
FIG. 3 is a schematic partial sectional view showing another preferred embodiment of the electrophotographic photoreceptor of the invention.

FIG. 2 and FIG. 3 are schematic sectional views showing another preferred embodiment of the electrophotographic photoreceptor of the invention.

The electrophotographic photoreceptor 7 shown in FIG. 2 has a photosensitive layer in which a charge generating layer 2 and a charge transporting layer 3 are separated from each other, as is the case of the electrophotographic photoreceptor 7 shown in FIG. 1. The electrophotographic photoreceptor 7 shown in FIG. 3 contains an charge generating material and a charge transporting material in the single layer (charge generating/charge transporting layer 6).

The electrophotographic photoreceptor 7 shown in FIG. 2 comprises a conductive substrate 4 having a subbing layer 1, a photosensitive layer comprising a charge transporting layer 3 and a charge generating layer 2, and a protective layer 5 thereon. The electrophotographic photoreceptor 7 shown in FIG. 3 comprises a conductive substrate 4 having a subbing layer 1, a charge generating/charge transporting layer 6, and a protective layer 5 thereon. The protective layers 5 in the electrophotographic photoreceptors 7 shown in FIG. 2 and FIG. 3 are the above-described protective layer of the invention.

In FIG. 1 to FIG. 3, the subbing layer may be provided or not provided.

The elements constituting the electrophotographic photoreceptor 7 in FIG. 1 are further described below as examples.

<Conductive Substrate>

Examples of the conductive substrate 4 include metal plates, metal drums, and metal belts using metals such as aluminum, copper, zinc, stainless steel, chromium, nickel, molybdenum, vanadium, indium, gold, platinum or alloys thereof, and papers, plastic films and belts which are coated, deposited, or laminated with a conductive compound such as a conductive polymer and indium oxide, a metal such as aluminum, palladium and gold, or alloys thereof.

When the electrophotographic photoreceptor 7 is used in a laser printer, the surface of the conductive substrate 4 is preferred to be roughened so as to have a centerline average roughness (Ra) of 0.04 μm to 0.5 μm in order to prevent interference fringes which are formed when irradiated by laser light. If Ra is less than 0.04 μm, the surface is almost a mirror surface and may not exhibit satisfactory effect of interference prevention. If Ra exceeds 0.5 μm, the image quality tends to become rough even if a film is formed. When an incoherent light source is used, surface roughening for preventing interference fringes is not necessary, and occurrence of defects due to the irregular surface of the conductive substrate 4 can be prevented to achieve a longer service life.

Preferred examples of the method for surface roughening include wet honing in which an abrasive suspended in water is blown onto a support, centerless grinding in which a support is continuously ground by pressing the support onto a rotating grind stone, and anodic oxidation.

A method of surface roughening by forming a layer of resin in which conductive or semiconductive particles are dispersed on the surface of the conductive substrate 4 so that the surface is roughened by the particles dispersed in the layer, without roughing the surface of the conductive substrate 4, is also preferably used.

In the surface-roughening treatment by anodic oxidation, an oxide film is formed on an aluminum surface by anodic oxidation in which the aluminum as anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The thickness of the anodic oxide film is preferably 0.3 to 15 μm. When the thickness of the anodic oxide film is less than 0.3 μm, the barrier property against injection may be low and fail to achieve sufficient effects. If the thickness of the anodic oxide film exceeds 15 μm, the residual potential tends to be increased due to the repeated use.

The conductive substrate 4 may be subjected to a treatment with an acidic aqueous solution or a boehmite treatment. The treatment with an acidic treatment solution comprising phosphoric acid, chromic acid and hydrofluoric acid is carried out as follows: phosphoric acid, chromic acid, and hydrofluoric acid are mixed to prepare an acidic treatment solution preferably in a mixing ratio of 10 to 11 weight % of phosphoric acid, 3 to 5 weight % of chromic acid, and 0.5 to 2 weight % of hydrofluoric acid. The concentration of the total acid components is preferably in the range of 13.5 to 18 weight %.

The treatment temperature is preferably 42 to 48° C., but by keeping the treatment temperature higher, a film having a substantial thickness can be obtained more speedily. The thickness of the film is preferably 0.3 to 15 μm. If the thickness of the film is less than 0.3 μm, the barrier property against injection may be low and sufficient effects may not be achieved. If the thickness exceeds 15 μm, the residual potential due to the repeated use may be increased.

The boehmite treatment is carried out by immersing the substrate in pure water at a temperature of 90 to 100° C. for 5 to 60 minutes, or by bringing it into contact with heated water vapor at a temperature of 90 to 120° C. for 5 to 60 minutes. The film thickness is preferably 0.1 to 5 μm. The film may further be subjected to anodic oxidation using an electrolyte solution which sparingly dissolves the film, such as adipic acid, boric acid, borate salt, phosphate, phthalate, maleate, benzoate, tartrate, and citrate solutions.

<Subbing Layer>

The subbing layer 1 comprises, for example, a binding resin containing inorganic particles.

The inorganic particles preferably have powder resistance (volume resistivity) of about $10^2$ to $10^{11}$ Ω·cm so that the subbing layer 1 can obtain adequate resistance in order to achieve leak resistance and carrier blocking properties. If the resistance value of the inorganic particles is lower than the lower limit of the range, adequate leak resistance may not be achieved, and if higher than the upper limit of the range, increase in residual potential may be caused.

Preferred examples of the inorganic particles having the above resistance value include inorganic particles of tin oxide, titanium oxide, zinc oxide, and zirconium oxide, and most preferred is zinc oxide.

The inorganic particles may be the ones which are subjected to a surface treatment. Particles which are subjected to different surface treatments, or those having different particle diameters, may be used in combination of two or more kinds.

Inorganic particles having a specific surface area (measured by a BET analysis) of 10 $m^2/g$ or more are preferably used. When the specific surface area thereof is less than 10 $m^2/g$, lowering of the electrostatic properties may easily be caused and the favorable electrophotographic characteristics may not be obtained.

By including inorganic particles and acceptive compounds, the subbing layer which is superior in long-term stability of electrical characteristics and carrier blocking property can be achieved. Any acceptive compound by which desired characteristics can be obtained may be used, but preferred examples thereof include electron transporting substances such as quinone-based compounds such as chloranil and bromanil, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compounds and diphenoquinone compounds such as 3,3',5,5'-tetra-t-butyldiphenoquinone, and particularly preferable are compounds having an anthraquinone structure. Still more preferred examples are acceptive compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin, and purpurin.

The content of the acceptive compound may be determined as appropriate within the range where desired characteristics can be achieved, but preferably in the range of 0.01 to 20 weight % relative to inorganic particles, more preferably in the range of 0.05 to 10 weight % in terms of preventing accumulation of charge and aggregation of inorganic particles. The aggregation of the inorganic particles may cause irregular formation of conductive channels, deterioration of maintainability such as increase in residual potential, or image defects such as black points, when repeatedly used.

The acceptor compound may simply be added at the time of application of the subbing layer, or may be previously attached to the surface of the inorganic particles. There are a dry method and a wet method as the method of attaching the acceptor compound to the surface of the inorganic particles.

When a surface treatment is conducted according to a dry method, the acceptor compound is added to the inorganic particles by dripping directly or in the form of a solution in which the acceptor compound is dissolved in an organic solvent, or spraying with dry air or a nitrogen gas, while stirring with a mixer or other devices having a high shearing force so that the particles are uniformly treated. The addition or spraying is preferably carried out at a temperature lower than the boiling point of the solvent. If the spraying is carried out at a temperature of not less than the boiling point of the solvent, the solvent may evaporate before the inorganic particles are uniformly stirred and the acceptor compound may locally coagulate. After the addition or spraying of the acceptor compound, the inorganic particles may further be subjected to baking at a temperature of 100° C. or higher. The baking may be carried out as appropriate at the temperature and timing in which desired electrophotographic characteristics can be obtained.

When a surface treatment is conducted according to a wet method, the inorganic particles are stirred or dispersed in a solvent by means of ultrasonic wave, a sand mill, an attritor, a ball mill or the like, then the acceptor compound is added and the mixture is further stirred or dispersed, thereafter the solvent is removed, and thereby the particles are uniformly surface-treated. The solvent is removed by filtration or distillation. After removing the solvent, the particles may be subjected to baking at a temperature of 100° C. or higher. The baking can be carried out at any temperature and timing in which desired electrophotographic characteristics can be obtained. In the wet method, the moisture contained in the inorganic particles can be removed prior to adding the surface treatment agent. The moisture can be removed by, for example, stirring and heating the particles in the solvent used for the surface treatment, or by azeotropic distillation with the solvent.

The inorganic particles may be subjected to a surface treatment prior to the addition of the acceptor compound. The surface treatment agent may be any agent by which desired characteristics can be obtained, and can be selected from known materials. Examples thereof include silane coupling agents, titanate-based coupling agents, aluminum-based coupling agents and surfactants. Among these, silane coupling agents are preferably used by which favorable electrophotographic characteristics can be provided, and particularly preferred examples are the silane coupling agents having an amino group that can impart favorable blocking properties to the subbing layer 1.

The silane coupling agents having amino groups may be any compounds by which desired electrophotographic photoreceptor characteristics can be obtained. Specific examples thereof include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane, but are not limited thereto.

The silane coupling agent may be used singly or in combination of two or more kinds thereof. Examples of the silane coupling agents which can be used in combination with the above-described silane coupling agents having an amino group include vinyltrimethoxysilane, γ-methacryloxypropyl-tris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane, but are not limited thereto.

The surface treatment method may be any known dry or wet method. Addition of an acceptor and a surface treatment using a coupling agent or the like can be carried out simultaneously.

The content of the silane coupling agent relative to the inorganic particles contained in the subbing layer 1 can be determined as appropriate within a range in which the desired electrophotographic characteristics can be obtained, but preferably 0.5 weight % to 10 weight % from the viewpoint of improving dispersibility.

As the binding resin contained in the subbing layer 1, any known resin that can form a favorable film and achieve desired characteristics may be used. Examples thereof include known polymer resin compounds, e.g. acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having charge transporting groups; and conductive resins such as polyaniline. Particularly preferred examples are resins which are insoluble in the coating solvent for the upper layer, specifically phenolic resins, phenol-formaldehyde resins, melamine resins, urethane resins, epoxy resins and the like. When these resins are used in combination of two or more kinds, the mixing ratio can be appropriately determined according to the circumstances.

The ratio of the metal oxide imparted with the properties as an acceptor to the binder resin, or the ratio of the inorganic particles to the binder resin, in the coating solution for forming the subbing layer, can be appropriately determined within a range in which the desired electrophotographic photoreceptor characteristics can be obtained.

Various additives may be used for the subbing layer 1 to improve electrical characteristics, environmental stability, or image quality. Examples of the additives include known materials such as the polycyclic condensed type or azo-based type of the electron transporting pigments, zirconium chelate compounds, titanium chelate compounds, aluminum chelate compounds, titanium alkoxide compounds, organic titanium compounds, and silane coupling agents. Silane coupling agents, which are used for surface treatment of metal oxides, may also be added to the coating solution as additives. Specific examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphnate, zirconium octanoate, zirconium naphthenate, zirconium laurate, zirconium stearate, isostearic acid zirconium, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl)titanate, titanium acetyl acetonate, polytitaniumacetyl acetonate, titanium octylene glycolate, titanium lactate ammonium salt, titanium lactate, titanium lactate ethyl ester, titanium triethanol aminato, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These compounds may be used alone, or as a mixture or a polycondensate of two or more kinds thereof.

The solvent for preparing the coating solution for forming the subbing layer 1 may appropriately be selected from known organic solvents such as alcohol-based, aromatic, hydrocarbon halide-based, ketone-based, ketone alcohol-based, ether-based, and ester-based solvents. Examples thereof include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for dispersion may be used alone or as a mixture of two or more kinds thereof. When they are mixed, any mixed solvents which can solve a binder resin can be used.

To perform the dispersion, known devices such as a roll mill, a ball mill, a vibration ball mill, an attritor, a sand mill, a colloid mill, or a paint shaker can be used. For applying the subbing layer 1, known methods such as blade coating, wire bar coating, spray coating, dip coating, bead coating, air knife coating, curtain coating or the like can be used.

The subbing layer 1 is formed on the conductive substrate using the coating solution obtained by the above-described method.

The Vickers hardness of the subbing layer 1 is preferably 35 or more. The thickness of the subbing layer 1 can be optionally determined within the range in which the desired characteristics can be obtained, but preferably 15 μm or more, more preferably 15 μm or more and 50 μm or less.

When the thickness of the subbing layer 1 is less than 15 μm, sufficient antileak properties may not be obtained, while when the thickness of the subbing layer 1 exceeds 50 μm, residual potential tends to remain during the long-term operation and cause the defects in image concentration.

The surface roughness of the subbing layer 1 (ten point height of irregularities) is adjusted in the range of from 1/4 n to 1/2 λ, where λ represents the wavelength of the laser for exposure and n represents a refractive index of the upper layer, in order to prevent a moire image. Particles of a resin or the like may also be added to the subbing layer 1 for adjusting the surface roughness thereof. Examples of the resin particles include silicone resin particles and crosslinking PMMA resin particles.

The subbing layer 1 may be subjected to grinding for adjusting the surface roughness thereof. The method such as buffing, a sandblast treatment, a wet honing, a grinding treatment and the like can be used for grinding.

The subbing layer 1 can be obtained by drying the applied coating, which is usually carried out by evaporating the solvent at a temperature at which a film can be formed.

<Charge Generating Layer>

The charge generating layer 2 contains an charge generating material and a binding resin. Examples of the charge generating material include azo pigments such as bisazo and trisazo pigments, condensed aromatic pigments such as dibromoantanthrone, perylene pigments, pyrrolopyrrole pigment, phthalocyanine pigment, zinc oxides, and trigonal selenium. For laser exposure in the near-infrared region, preferred examples are metal or nonmetal phthalocyanine pigments, and more preferred are hydroxy gallium phthalocyanine disclosed in Japanese Patent Application Laid-Open (JP-A) Nos. 5-263007 and 5-279591, chlorogallium phthalocyanine disclosed in JP-A No. 5-98181, dichlorotin phthalocyanine disclosed in JP-A Nos. 5-140472 and 5-140473, and titanyl phthalocyanine disclosed in JP-A Nos. 4-189873, and 5-43823. For laser exposure in the near-ultraviolet region, preferred examples are condensed aromatic pigments such as dibromoantanthrone, thioindigo-based pigments, porphyrazine compounds, zinc oxides, and trigonal selenium.

The binding resin used in the charge generating layer 2 can be selected from a wide range of insulating resins, and from organic light conductive polymers such as poly-N-vinyl carbazole, polyvinyl anthracene, polyvinyl pyrene, and polysilane. Preferable examples of the binding resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binding resins may be used alone or in combination of two or more kinds thereof. The mixing ratio between the charge generating material and the binding resin is preferably in the range of 10:1 to 1:10 by weight ratio.

The charge generating layer 2 may be formed using a coating solution in which the above-described charge generating materials and binding resins are dispersed in a given solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, which may be used alone or in combination of two or more kinds.

For dispersing the charge generating materials and the binding resins in a solvent, ordinary methods such as ball mill dispersion, attritor dispersion and sand mill dispersion can be used. By these dispersion methods, deformation of crystals of the charge generating material caused by dispersion can be prevented. The average particle diameter of the charge generating material to be dispersed is preferably 0.5 μm or less, more preferably 0.3 μm or less and further preferably 0.15 μm or less.

For forming the charge generating layer 2, conventional methods such as blade coating, Meyer bar coating, spray coating, dip coating, bead coating, air knife coating or curtain coating can be used.

The film thickness of the charge generating layer 2 obtained by the above-described methods is preferably 0.1 to 5.0 μm and more preferably 0.2 to 2.0 μm.

<Charge Transporting Layer>

The charge transporting layer 3 is formed by including a charge transporting material and a binding resin, or a polymer charge transporting material.

Examples of the charge transporting material include electron transporting compounds such as quinone-based compounds such as p-benzoquinone, chloranil, bromanil, and anthraquinone, tetracyanoquinodimethane-based compounds, fluorenone compounds such as 2,4,7-trinitro fluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds. These charge transporting materials may be used alone or in combination of two or more kinds thereof, but are not limited thereto.

The charge transporting material is preferably a triaryl amine derivative represented by the following Formula (XII) or a benzidine derivative represented by the following Formula (XIII) from the viewpoint of charge mobility.

Formula (XII)

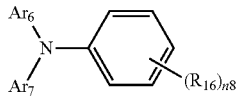

In Formula (XII), $R_{16}$ represents a hydrogen atom or a methyl group. n8 denotes 1 or 2. $Ar_6$ and $Ar_7$ each independently represent a substituted or unsubstituted aryl group or —$C_6H_4$—$C(R_{17})$=$C(R_{18})(R_{19})$, —$C_6H_4$—CH=CH—CH=$C(R_{20})(R_{21})$, $R_{17}$ to $R_{21}$ each independently represent a hydrogen atom, a substituted or unsubstituted alkyl group, or a substituted or unsubstituted aryl group. The substituent represents an amino group substituted with a halogen atom, an alkyl group having carbon atoms of 1 to 5, an alkoxy group having carbon atoms of 1 to 5, or an alkyl group having carbon atoms of 1 to 3.)

Formula (XIII)

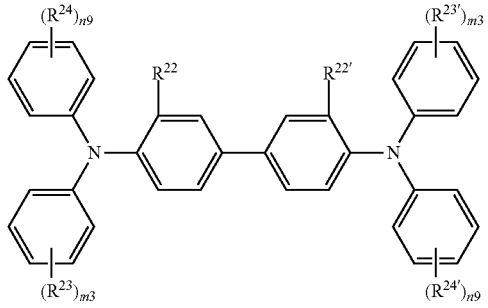

In Formula (XIII), $R^{22}$ and $R^{22'}$ may be the same or different and each independently represent a hydrogen atom, a halogen atom, an alkyl group having carbon atoms of 1 to 5, or an alkoxy group having carbon atoms of 1 to 5. $R^{23}$, $R^{23'}$, $R^{24}$ and $R^{24'}$ may be the same or different and each independently represent hydrogen atom, a halogen atom, an alkyl group having carbon atoms of 1 to 5, an alkoxy group having carbon atoms of 1 to 5, or an amino group substituted with an alkyl group having carbon atoms of 1 to 2, a substituted or unsubstituted aryl group, or —$C(R^{25})$=$C(R^{26})(R^{27})$, —CH=CH—CH=$C(R^{28})(R^{29})$, where $R^{25}$ to $R^{29}$ each independently represent a hydrogen atom, a substituted or unsubstituted alkyl group, or a substituted or unsubstituted aryl group. m3 and n9 each independently denote an integral number of 0 to 2.

Particularly preferable examples of the above are triarylamine derivatives having —$C_6H_4$—CH=CH—CH=$C(R_{20})(R_{21})$ and benzidine derivatives having —CH=CH—CH=$C(R^{28})(R^{29})$ from the viewpoint of excellent mobility, adhesiveness to the protective layer and suppression of ghost.

Examples of the binding resin used in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole and polysilane. Further, polymer charge transporting materials can also be used as the binding resin, such as the polyester-based polymer charge transporting materials disclosed in JP-A Nos. 8-176293 and 8-208820. These binding resins may be used alone or in combination of two or more kinds thereof. The mixing ratio between the charge transporting material and the binding resin is preferably 10:1 to 1:5 by weight ratio.

As the charge transporting material, polymer charge transport materials that can form a film independently can also be used. As the polymer charge transporting material, known materials having charge transporting properties such as poly-N-vinyl carbazole and polysilane can be used. Polyester-based polymer charge transporting materials disclosed in JP-A Nos. 8-176293 and 8-208820, having high charge transporting properties, are particularly preferred. Charge transporting polymer materials can form a film independently, but may also be mixed with the above-described binding resin to form a film.

The charge transporting layer 3 can be formed using the coating solution containing the above-described constituents. Examples of the solvent used for the coating solution for forming the charge transporting layer include ordinary organic solvents such as aromatic hydrocarbons such as benzene, toluene, xylene and chlorobenzene, ketones such as acetone and 2-butanone, aliphatic hydrocarbon halides such as methylene chloride, chloroform and ethylene chloride, cyclic or straight-chained ethers such as tetrahydrofuran and ethyl ether. These solvents may be used alone or in combination of two or more kinds thereof. Known methods can be used for dispersing the above-described constituents.

For applying the coating solution for forming the charge transporting layer onto the charge generating layer 2, ordinary methods such as blade coating, Meyer bar coating, spray coating, dip coating, bead coating, air knife coating and curtain coating can be used.

The film thickness of the charge transporting layer 3 is preferably 5 to 50 μm and more preferably 10 to 30 μm.

<Protective Layer>

The protective layer 5 is the outermost layer of the electrophotographic photoreceptor 7, which is provided for the purpose of imparting surface resistance against abrasion or scratches, and enhancing the toner transferring efficiency.

The protective layer 5 comprises a crosslinked film having a phenolic structure, and in which the relationship between the pH of the exfoliated protective layer extracted with distilled water ($pH_{OCL}$) and the pH of the distilled water ($pH_w$) satisfies the following Formula (A).

$$pH_{OCL}-pH_w \leqq 0.5 \quad \text{Formula (A)}$$

When the value of $pH_{OCL}$-$pH_w$ satisfies Formula (A), a high mechanical strength and stable electrical and image quality characteristics can be achieved and last for a long-term repeated use.

The value of $pH_{OCL}$-$pH_w$ most preferably satisfies the following formula (B). If the value of $pH_{OCL}$-$pH_w$ is too low, the protective layer may easily be photo-deteriorated when exposed to light such as an interior lamp while replacing cartridges, or the like.

$$-4 \leqq pH_{OCL}-pH_w \leqq 0.5 \quad \text{Formula (B)}$$

In the protective layer 5 of the invention, the above Formulae (A) and (B) can be controlled by performing a treatment as described below to the phenolic resin which is used for the protective layer 5.

For example, such control can be achieved by using a sufficient amount of phenolic resin to be dissolved in a solvent so that the residual basic substance is sufficiently neutralized by using an acidic substance: specifically, so that the pH of the solution after performing a desired treatment is 7 or less, the stirred.

The solution after being subjected to a treatment may further be subjected to water washing or filtration to remove the acidic substance.

Alternatively, the acidic substance can be inactivated or removed by bringing it to contact with an adsorption agent such as silica gel or an ion exchange resin.

The protective layer 5 of the invention can be obtained by preparing a coating agent composition using a phenolic resin obtained through the above-described treatment, then applying, drying, and curing the coating agent composition.

Besides the method of conducting the above-described treatment using the acidic substance, the protective layer 5 that satisfies the above-described Formulae (A) and (B) may also be formed by adding an acidic curing catalyst to the coating agent composition in an amount enough to neutralize the residual basic catalyst.

The protective layer 5 of the invention can improve the adhesiveness to the lower layer by satisfying the above-described Formula (A). The reason is not definitely evident but presumed that the migration of the catalyst from inside the protective layer to the interface thereof with the lower layer is inhibited, and thereby preventing the deterioration of the adhesiveness to the lower layer.

The crosslinked film having a phenolic structure that forms a protective layer 5 is preferably a phenolic resin crosslinked film having charge transporting properties, more preferably a crosslinked film having one or more phenol derivatives having at least a methylol group, and at least one charge transporting component having a specific structure.

The phenol derivatives having a methylol group may be obtained by reacting a compound having a phenolic structure with formaldehyde, Polyoxymethylene or the like in the presence of an acidic or an alkali catalyst, and prepare a monomer of monomethylol phenols, dimethylol phenols or trimethylol phenols, a mixture or an oligomer thereof, or a mixture of the monomer and the oligomer. A relatively large molecule having approximately 2 to 20 repeating units is referred to as an oligomer and the one having less repeating units than the oligomer is referred to as a monomer. Examples of the phenol derivatives having a methylol group include substituted phenols having one hydroxyl group such as phenol, cresol, xylenol, p-alkylphenol and p-phenylphenol, substituted phenols having two hydroxyl groups such as catechol, resorcinol or hydroquinone, bisphenols such as bisphenol A and bisphenol Z, and biphenols.

Examples of the acidic catalyst used in the above process include sulfuric acid, p-toluene sulfonic acid and phosphoric acid, and examples of the alkali catalyst include alkali metal hydroxides such as NaOH, KOH, and $Ca(OH)_2$, alkali earth metal hydroxides and amine-based catalysts. Examples of the amine-based catalyst include ammonia, hexamethylenetetramine, trimethylamine, triethylamine and triethanolamine, but not limited thereto.

The resins that are synthesized using an acidic catalyst are generally referred to as novolac resins, while the ones that are synthesized using a basic catalyst are generally referred to as resol type resins. The resol type resins are preferably used for the protective layer 5, since the novolac resins have low heat curability and are difficult to form a strong protective layer.

When a basic catalyst is used, the adhesiveness between the protective layer and the lower layer, occurrence of ghost, and electrical characteristics tend to be exacerbated, which is presumably due to the rapid progression of the crosslinking reaction. Therefore, it is preferred to neutralize the basic catalyst with an acidic substance and wash with water, or inactivate or remove the catalyst by bringing into contact with an adsorption agent such as silica gel or an ion exchange resin. Examples of the acidic substances include hydrochloric acid, sulfuric acid, acetic acid, trifluoroacetic acid, nitric acid and phosphoric acid, which can be used by diluting with an appropriate solvent such as water, methanol, ethanol, or other alcohol to optimize the concentration thereof. The method using a solid type acidic substance is most preferable in terms of high productivity, since the remaining of the residual salt can be suppressed and be readily removed by stirring the solution containing the residual salt, performing a contacting treatment, then performing filtration. Examples of the solid acidic substances include ion exchange resins, inorganic solids having a group including a protonic acid group is bonded on the surface thereof, polyorganosiloxanes including a protonic acid group, heteropoly acids, isopoly acids, simple metal oxides, combined metal oxides, clay minerals, metal sulfates, metal phosphates and metal nitrates.

Examples of the ion exchange resins include Amberite 15, Amberite 200C, Amberlyst 15 (manufactured by Rohm and Haas Company); Dowex MWC-1-H, Dowex 88, Dowex HCR-W2 (manufactured by Dow Chemical Company); Lewatit SPC-108, Lewatit SPC-118 (manufactured by Bayer Ltd.); Diaion RCP-150H (manufactured by Mitsubishi Chemical Corporation); Sumika Ion KC-470, Duolite C26-C, Duolite C-433, Duolite-464 (manufactured by Sumitomo Chemical Co., Ltd.); Nafion-H (manufactured by Du Pont); and Purolite (manufactured by AMP IONEX Corporation).

Examples of the inorganic solids having surface groups comprising a protonic acid-containing group bonded on the surface thereof include $Zr(O_3PCH_2CH_2SO_3H)_2$ and $Th(O_3PCH_2CH_2COOH)_2$.

Examples of the polyorganosiloxanes having a protonic acid group include polyorganosiloxane having a sulfonic acid group.

Examples of the heteropoly acids include cobalt tungstate and phosphomolybdic acid.

Examples of the isopoly acids include niobic acid, tantalic acid and molybdic acid.

Examples of single metal oxides include silica gel, alumina, chromia, zirconia, CaO and MgO.

Examples of the combined metal oxides include silica-alumina, silica-magnesia, silica-zirconia and zeolites.

Examples of the clay minerals include acid clay, activated clay, montmorillonite and kaolinite.

Examples of the metal sulfates include $Li_2SO_4$ and $MgSO_4$.

Examples of the metal phosphates include zirconium phosphate and lanthanum phosphate.

Examples of the metal nitrates include $LiNO_3$ and $Mn(NO_3)_2$.

The treatment of a phenol-based resin using an acidic substance may be carried out by dissolving 1 part by weight of a phenol-based resin in a solvent of 1 to 100 parts by weight, preferably 1 to 10 parts by weight, and adding the acidic substance in an amount enough to neutralize the residual basic substance, specifically the amount with which the pH of the solution after desired treatment becomes 7 or lower, and stirring. The treated solution may further be subjected to water washing or filtration to remove the acidic substance. The treatment may be carried out for 1 to 300 minutes at a temperature of room temperature to about 50° C.

Conductive particles may be added to the protective layer 5 in order to lower the residual potential. Examples of the conductive particles include particles of metal, metal oxide and carbon black, and more preferably particles of metal or metal oxides. Examples of metal particles include particles of aluminum, zinc, copper, chromium, nickel, silver and stainless steel, and plastic particles having these metals deposited on the surface thereof. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These may be used alone or in combination of two or more kinds thereof. When they are used in combination of two or more kinds thereof, they may be simply mixed, fused or a solid solution. The average particle diameter of the conductive particles is preferably 0.3 μm or lower, more preferably 0.1 μm or lower from the viewpoint of transparency of the protective layer.

Examples of the charge transporting materials that can be used for the protective layer 5 include the compounds represented by the following Formulae (I) to (V), and the specific structures as described below can be used.

$$F—[(X_1)_nR_1—CO_2H]_m \qquad \text{Formula (I)}$$

In Formula (I), F represents an organic group derived from a compound having a hole transporting ability, $R_1$ represents an alkylene group, m denotes an integral number of 1 to 4, $X_1$ represents an oxygen atom or a sulfur atom, and n denotes 0 or 1.

$$F—[(X_2)_{n1}—(R_2)_{n2}—(Z_2)_{n3}G]_{n4} \qquad \text{Formula (II)}$$

In Formula (II), F represents an organic group derived from a compound having a hole transporting ability, $X_2$ represents an oxygen atom or a sulfur atom, $R_2$ represents an alkylene group, $Z_2$ represents an alkylene group, an oxygen atom, a sulfur atom, NH or COO, G represents an epoxy group, n1, n2 and n3 each independently denotes an integral number of 0 or 1, and n4 denotes an integral number of 1 to 4.

Formula (III)

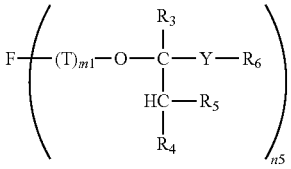

In Formula (III), F represents an organic group having a valence of n5 and a hole transporting ability, T represents a divalent group, Y represents an oxygen atom or a sulfur atom, $R_3$, $R_4$ and $R_5$ each independently represent a hydrogen atom or a monovalent organic group, $R_6$ represents a monovalent organic group, m1 denotes an integral number of 0 or 1, n5 denotes an integral number of 1 to 4, and $R_5$ and $R_6$ may be bonded to each other to form a heterocyclic ring with Y as the heteroatom.

Formula (IV)

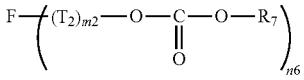

In Formula (IV), F represents an organic group having a valence of n6 and a hole transporting ability, $T_2$ represents a divalent group, $R_7$ represents a monovalent organic group, m2 denotes an integral number of 0 or 1, and n6 denotes an integral number of 1 to 4.

Formula (V)

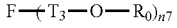

wherein in Formula (V), F represents an organic group having a valence of n7 and a hole transporting ability, $T_3$ represents a divalent alkylene group, $R_0$ represents a monovalent organic group, and n7 denotes an integral number of 1 to 4.

By including a resin obtained by using the above-described compounds in the surface layer of the electrophotographic photoreceptor, electrophotographic characteristics, mechanical hardness, charging characteristics and the like thereof can be improved.

The compounds represented by the above-described Formulae (I) to (V) are further preferably the compound represented by the following Formula (VI).

Formula (VI)

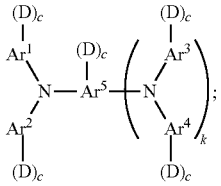

In Formula (VI), $Ar^1$ to $Ar^4$ may be the same or different and each independently represent a substituted or unsubstituted aryl group, $Ar^5$ represents a substituted or unsubstituted aryl group or arylene group, each of c independently denotes 0 or 1, k denotes 0 or 1, D represents a group selected from the following Formulae (VII) to (XI), and the total number of D is 1 to 4.

Formula (VII)

Formula (VIII)

-continued

Formula (IX)

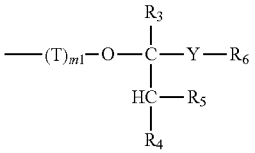

Formula (X)

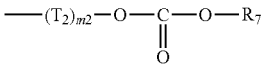

Formula (XI)

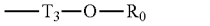

The symbols used in Formulae (VII) to (XI) are the same as those in Formulae (I) to (V).

In Formula (VI), $Ar^1$ to $Ar^4$ are preferred to be any one represented by the following Formulae (1) to (7).

(1)

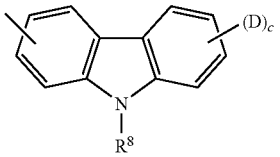

(2)

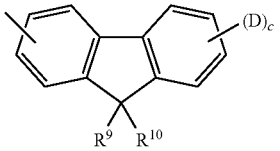

(3)

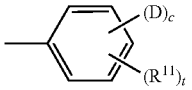

(4)

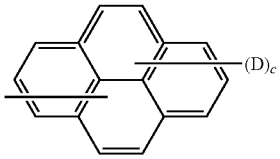

(5)

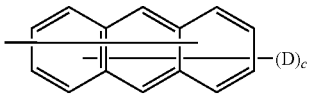

(6)

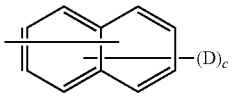

(7)

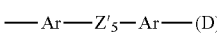

In Formulae (1) to (7), $R^8$ represents the one selected from the group consisting of a hydrogen atom, an alkyl group having carbon atoms of 1 to 4, a phenyl group substituted by an alkyl group having carbon atoms of 1 to 4 or an alkoxy group having carbon atoms of 1 to 4, an unsubstituted phenyl group, and an aralkyl group having carbon atoms of 7 to 10; $R^9$, $R^{10}$ and $R^{11}$ each represent the one selected from the group consisting of a hydrogen atom, an alkyl group having carbon atoms of 1 to 4, an alkoxy group having carbon atoms of 1 to 4, a phenyl group substituted by an alkoxy group having carbon atoms of 1 to 4, an unsubstituted phenyl group, an aralkyl group having carbon atoms of 7 to 10 and a halogen atom; Ar represents a substituted or unsubstituted arylene group; D is the one selected from the Formulae (VII) to (XI); c and s each denotes 0 or 1; and t denotes an integral number of 1 to 3.

In Formula (7), Ar is preferred to be the one represented by the following formulae (8) or (9).

(8)

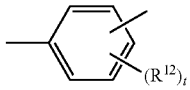

(9)

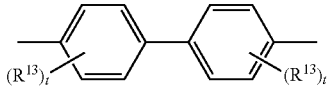

In Formula (8) and (9), $R^{12}$ and $R^{13}$ each represents the one selected from the group consisting of a hydrogen atom, an alkyl group having carbon atoms of 1 to 4, an alkoxy group having carbon atoms of 1 to 4, a phenyl group substituted by an alkoxy group having carbon atoms of 1 to 4, an unsubstituted phenyl group, an aralkyl group having carbon atoms of 7 to 10 and a halogen atom, and t denotes an integral number of 1 to 3.

In Formula (7), Z' is preferred to be any one represented by the following formulae (10) to (17).

(10)

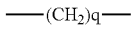

(11)

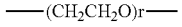

(12)

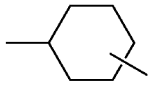

(13)

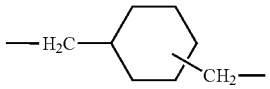

(14)

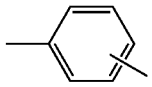

(15)

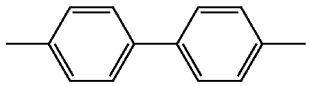

(16)

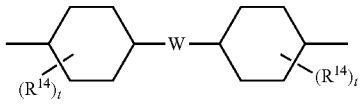

(17)

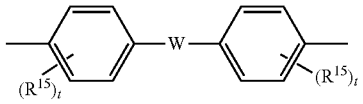

In Formula (10) to (17), $R^{14}$ and $R^{15}$ each represents the one selected from the group consisting of a hydrogen atom, an alkyl group having carbon atoms of 1 to 4, an alkoxy group having carbon atoms of 1 to 4, a phenyl group substituted by an alkoxy group having carbon atoms of 1 to 4, an unsubstituted phenyl group, an aralkyl group having carbon atoms of 7 to 10 and a halogen atom, W represents a divalent group, p and r each denotes an integral number of 1 to 10, and t denotes an integral number of 1 to 3.

In Formula (16) and (17), W is preferred to be any divalent group represented by the following formulae (18) to (26).

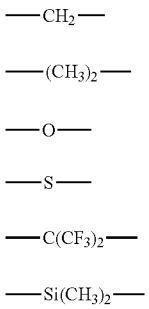

(18) $-CH_2-$

(19) $-(CH_3)_2-$

(20) $-O-$

(21) $-S-$

(22) $-C(CF_3)_2-$

(23) $-Si(CH_3)_2-$ (24)

(25)

(26)

In Formula (25), u denotes an integral number of 0 to 3.

In Formula (VI), $Ar^5$ is an aryl group exemplified in the description regarding $Ar^1$ to $Ar^4$ when k is 0, or an arylene group from which a prescribed hydrogen atom is subtracted when k is 1.

Specific examples of the compounds represented by Formula (I) include, but not limited to, the following compounds (I)-1 to (I)-8. In the following compounds, the bond which is described but not with a substituent at the end thereof represents a bond having a methyl group at the end thereof.

(I)-1

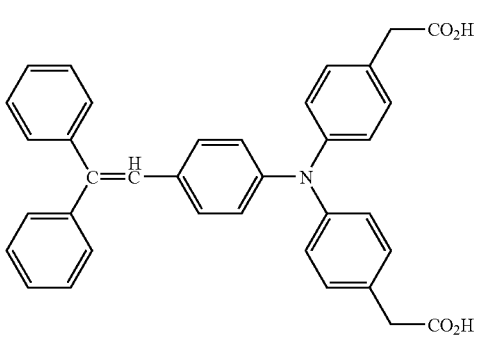

-continued (I)-2

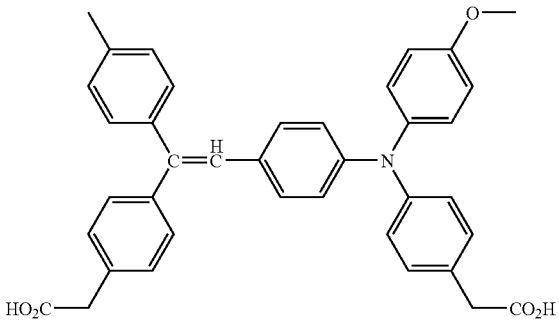

(I)-3

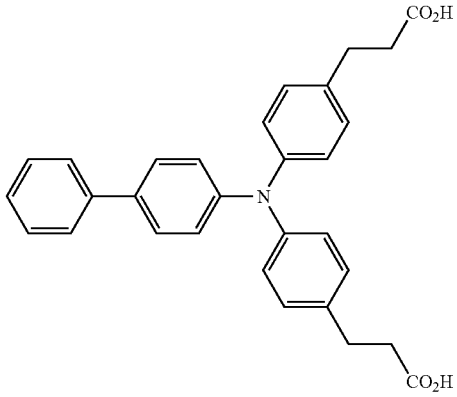

(I)-4

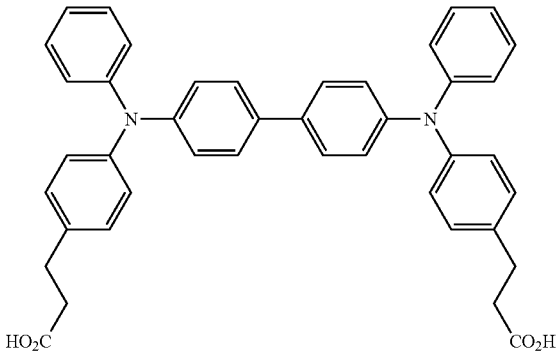

(I)-5

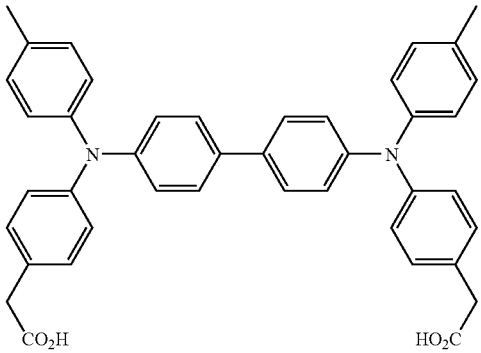

-continued
(I)-6
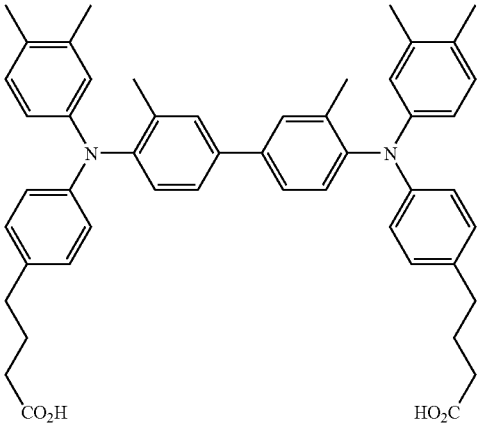
(I)-7
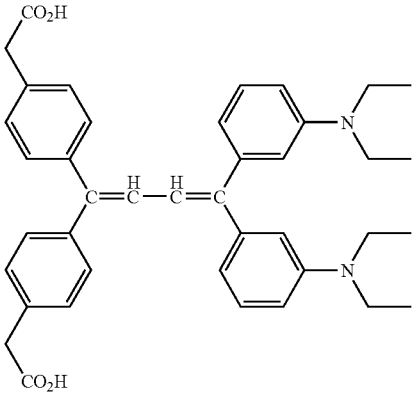
(I)-8
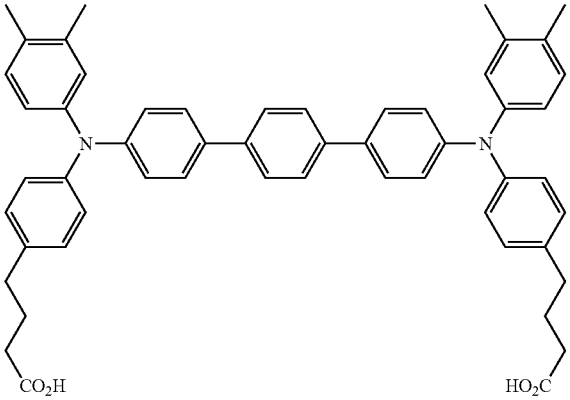
Specific examples of the compounds represented by Formula (II) include, but not limited to, the following compounds II-1 to II-47. In the compounds represented by the Formula (II), the bond which is described but not with a substituent at the end thereof, or Me, represents a bond having a methyl group at the end thereof, and Et represents an ethyl group.
II-1
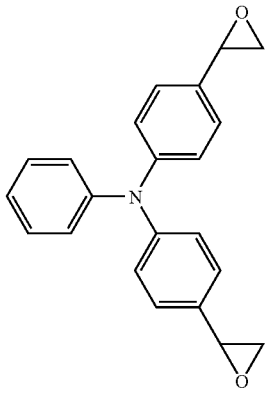
II-2
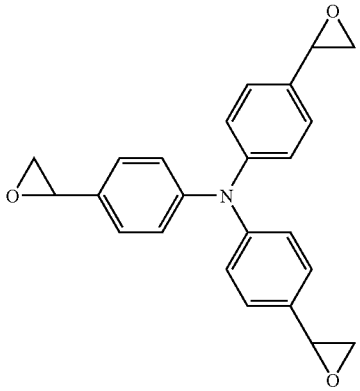
II-3
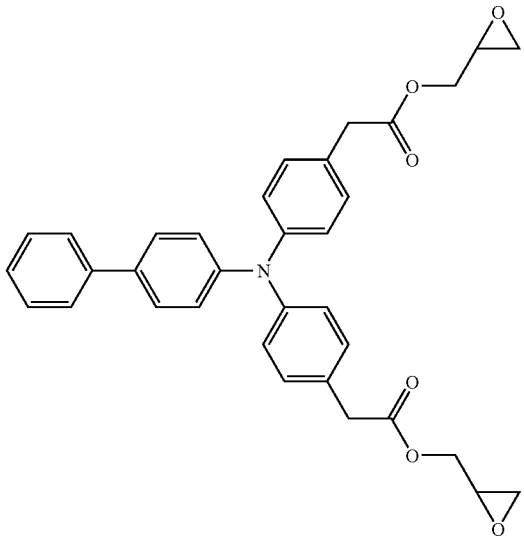

-continued
II-4
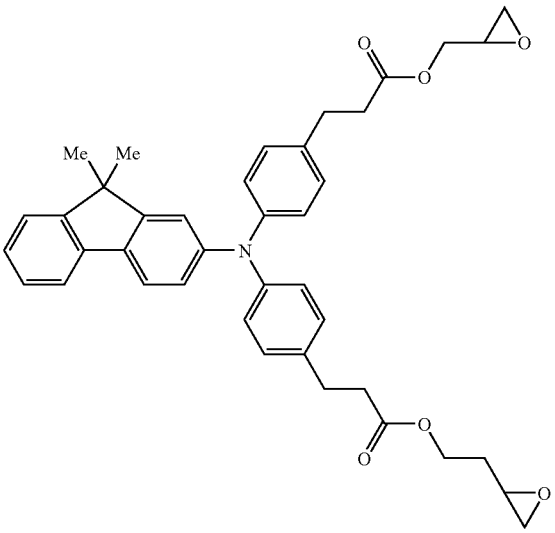
II-5
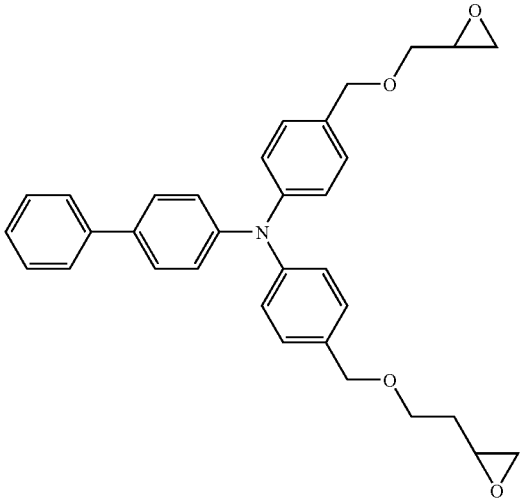
II-6
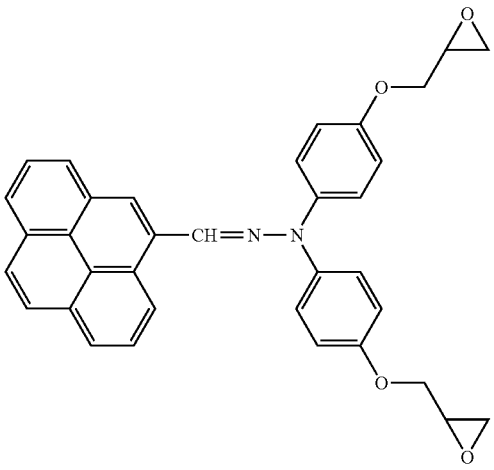
-continued
II-7
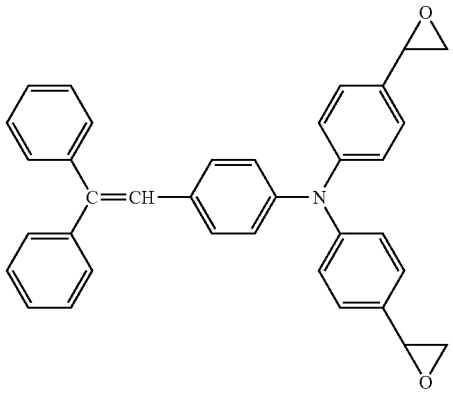
II-8
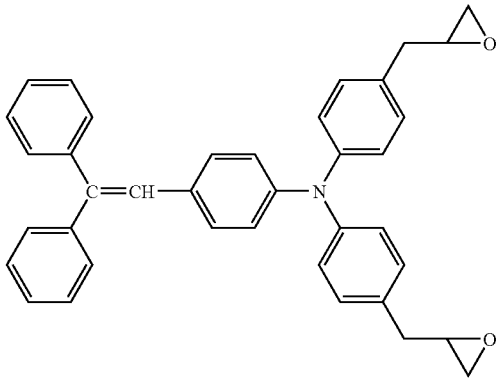
II-9
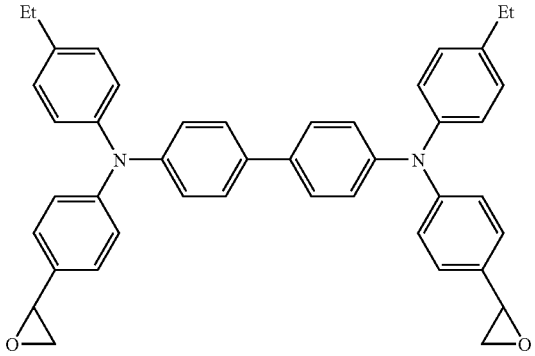
II-10
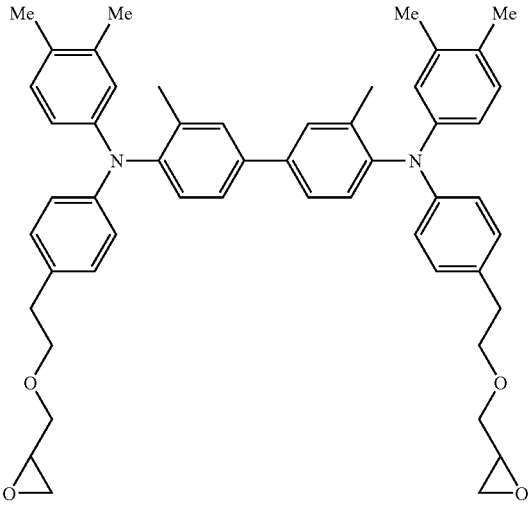

-continued
II-11
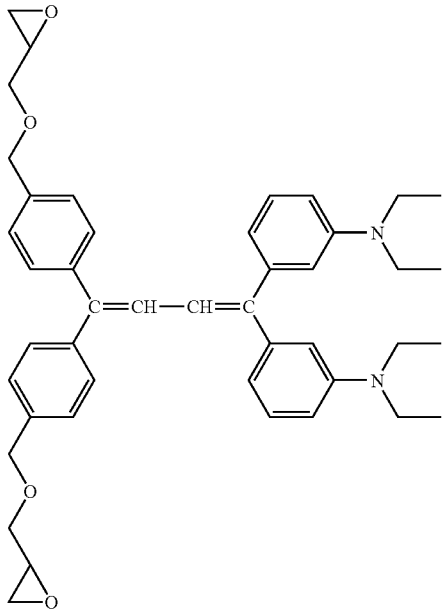
II-12
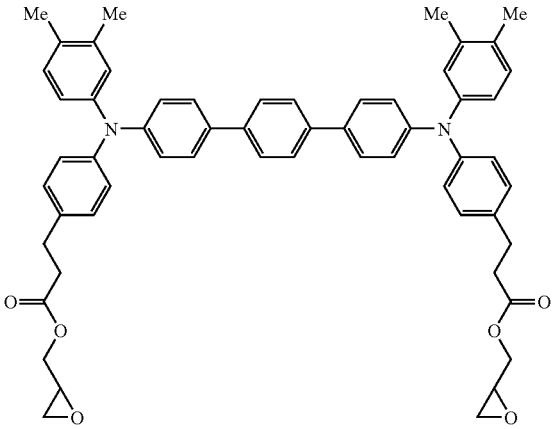
II-13
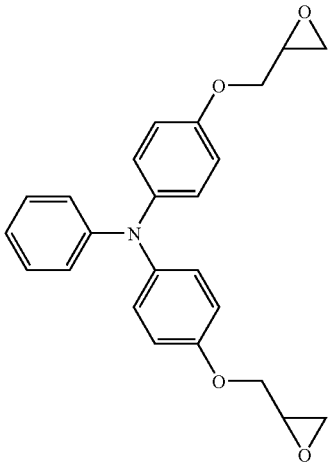
-continued
II-14
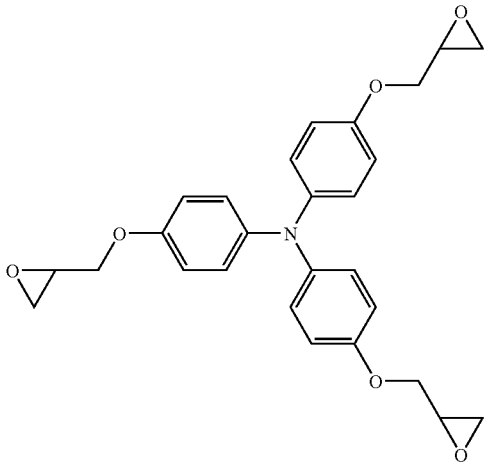
II-15
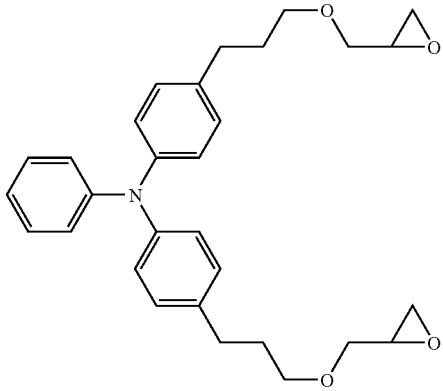
II-16
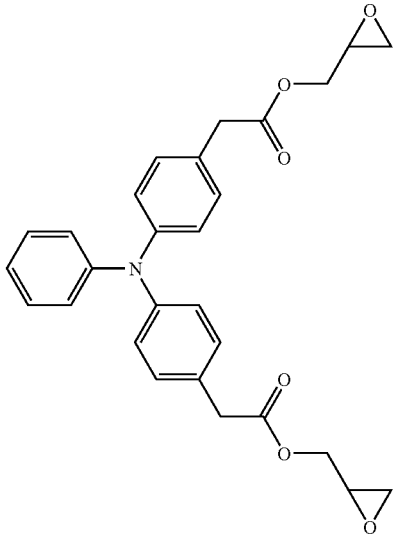

-continued
II-17
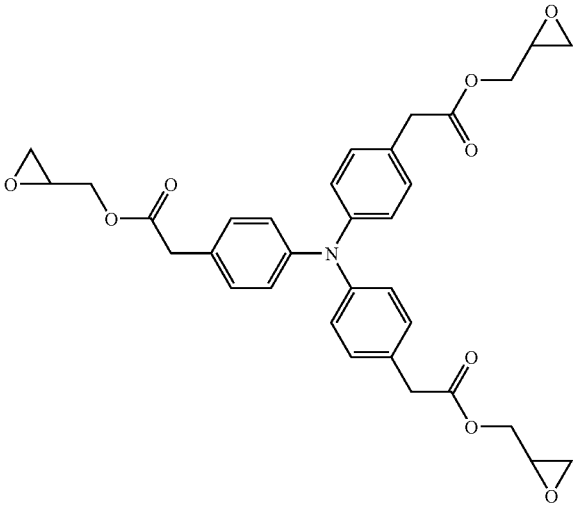
II-18
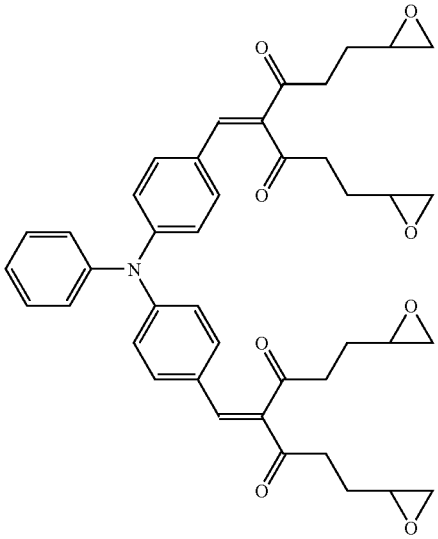
II-19
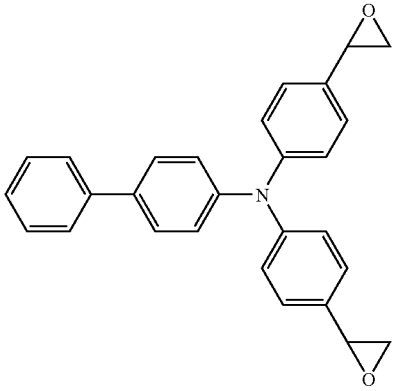
-continued
II-20
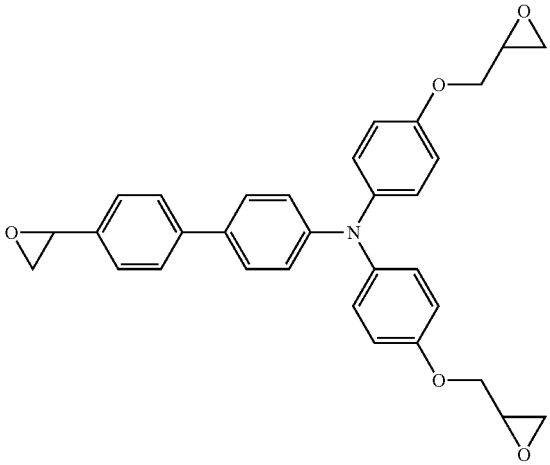
II-21
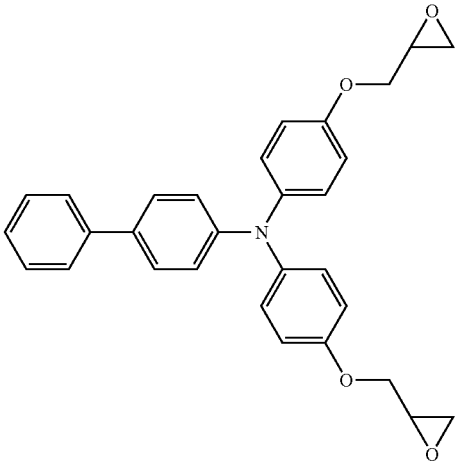
II-22
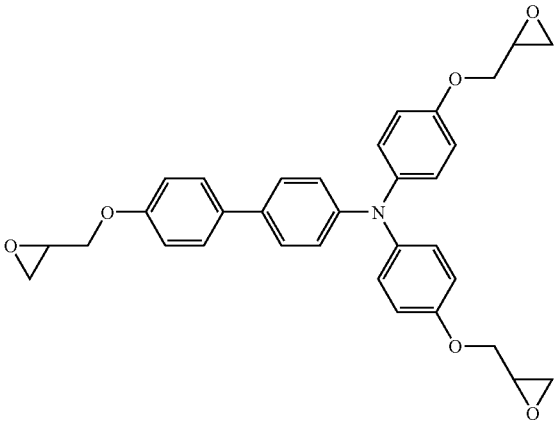

-continued
II-23
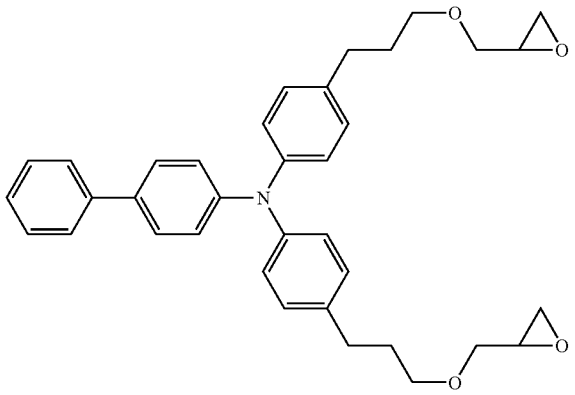
II-24
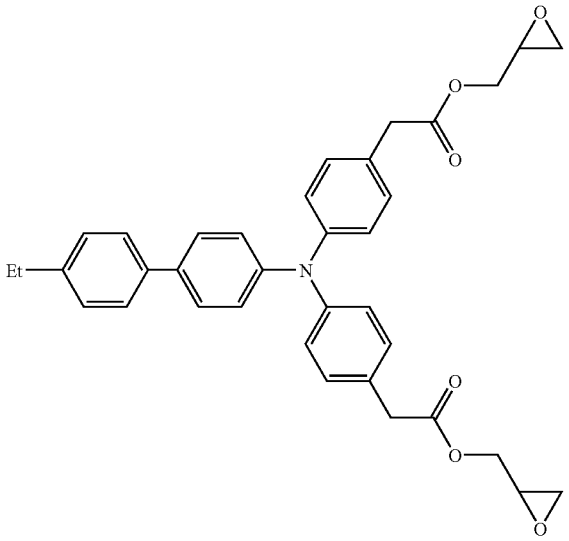
II-25
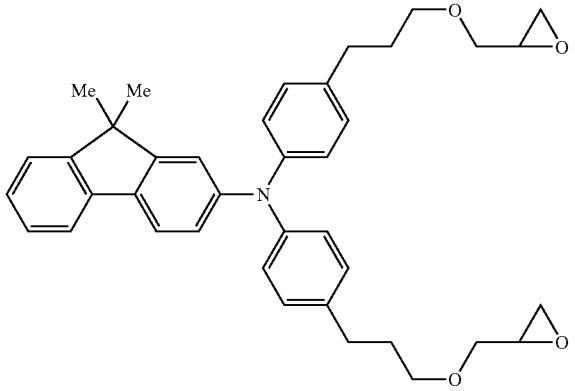
-continued
II-26
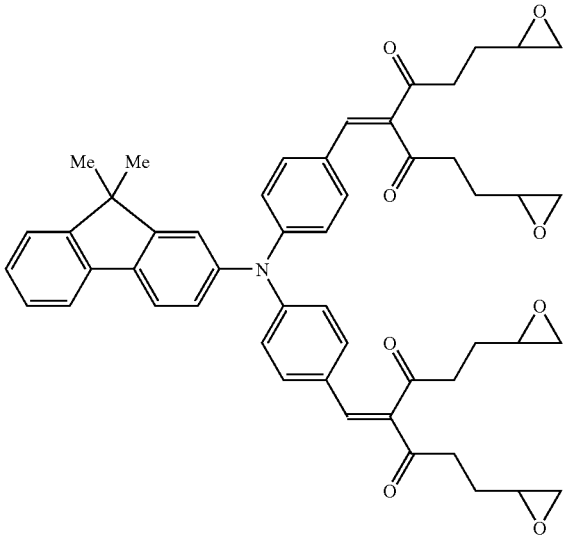
II-27
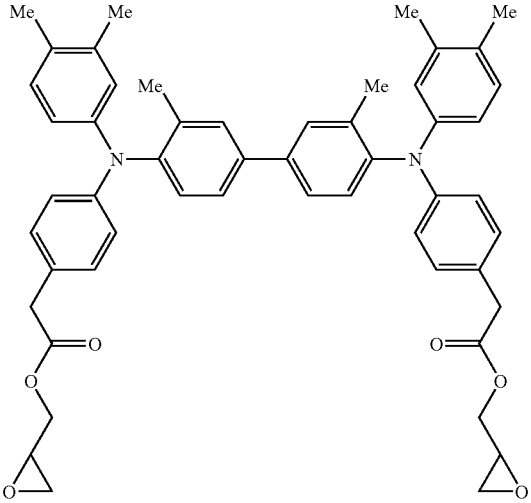
II-28
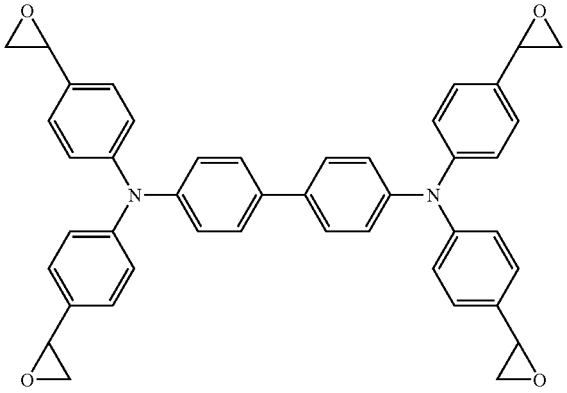

-continued
II-29
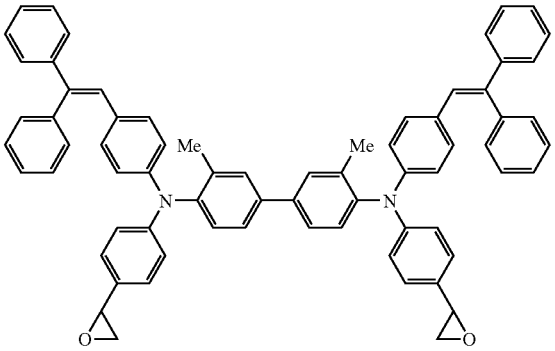
II-30
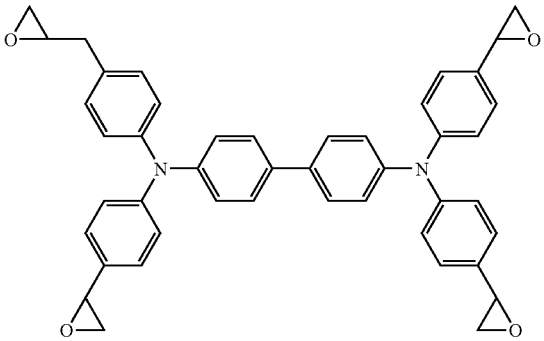
II-31
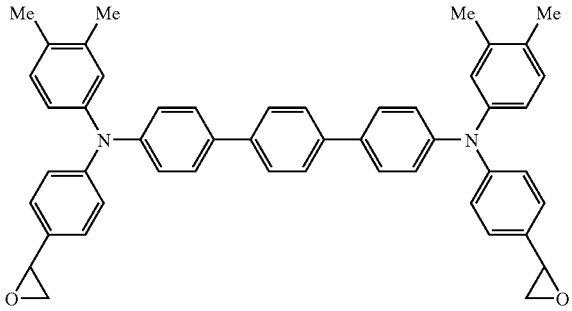
II-32
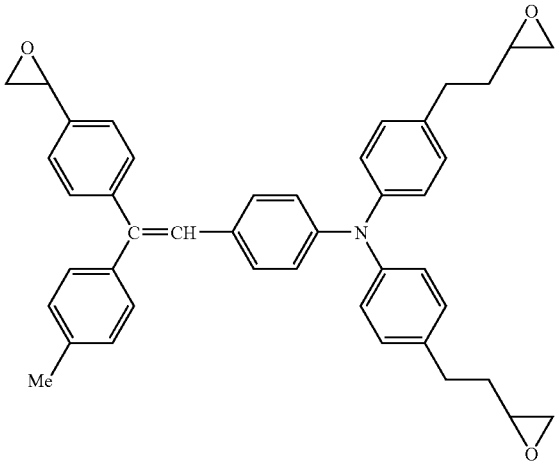
-continued
II-33
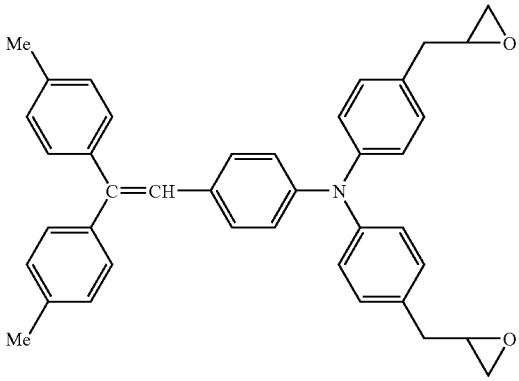
II-34
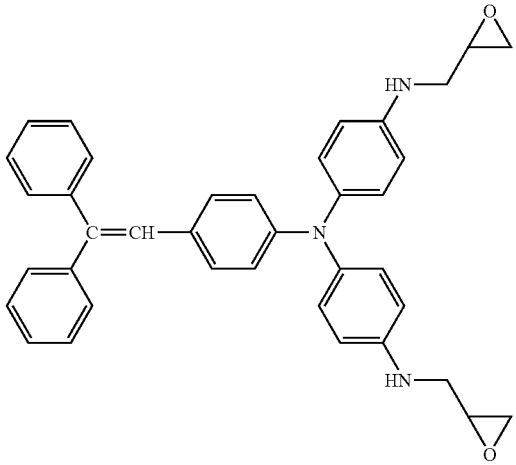
II-35
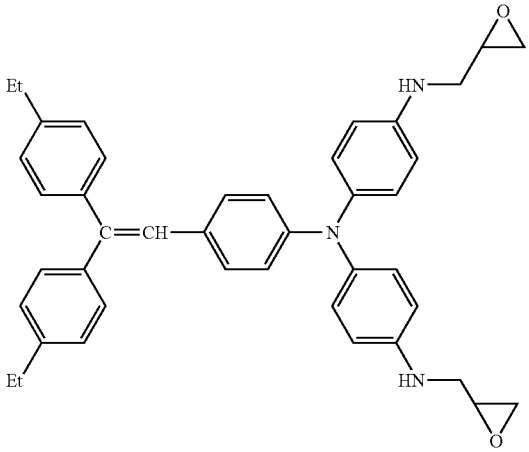

-continued
II-36
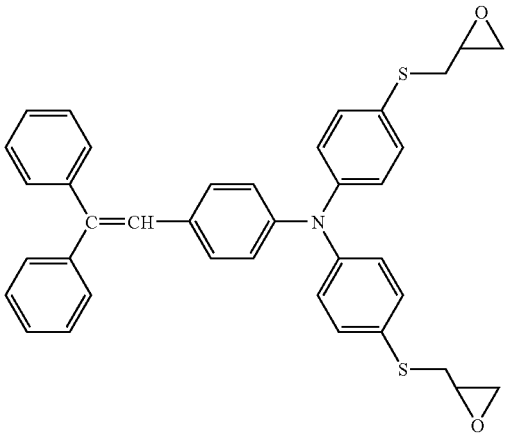
II-37
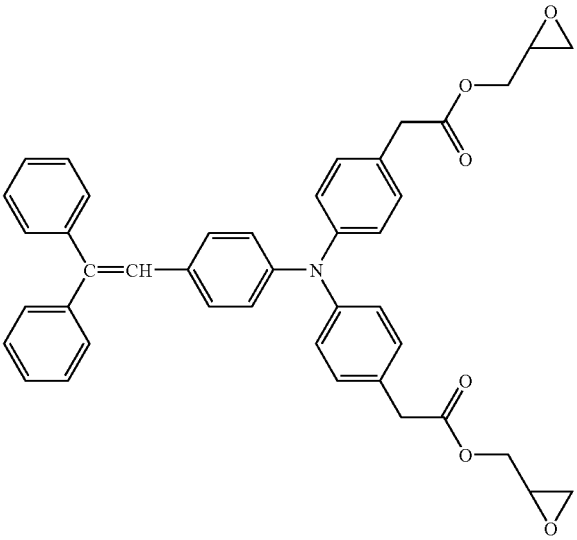
II-38
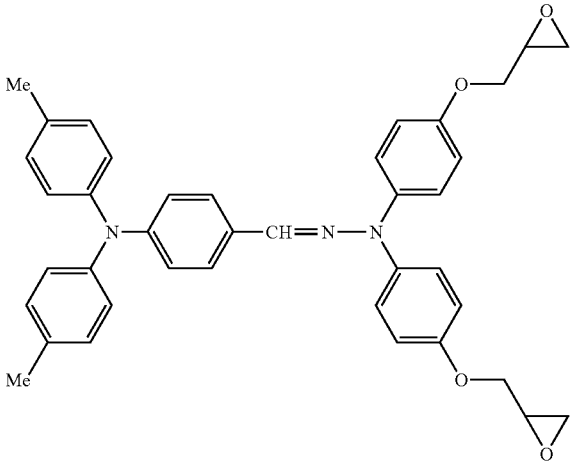
-continued
II-39
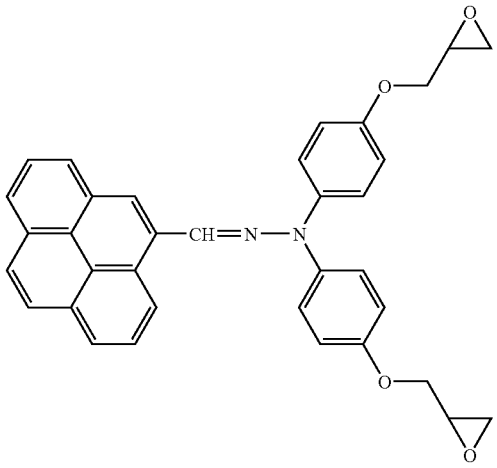
II-40
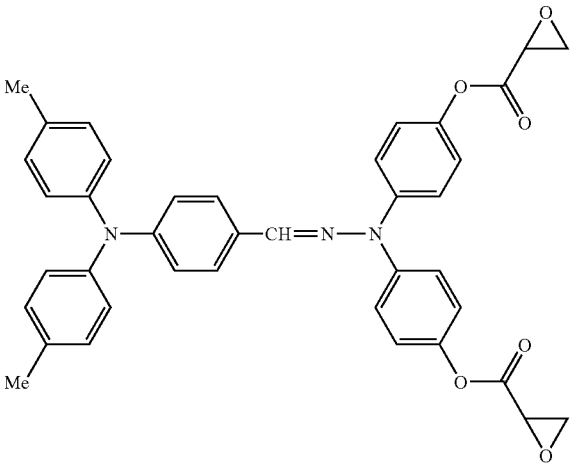
II-41
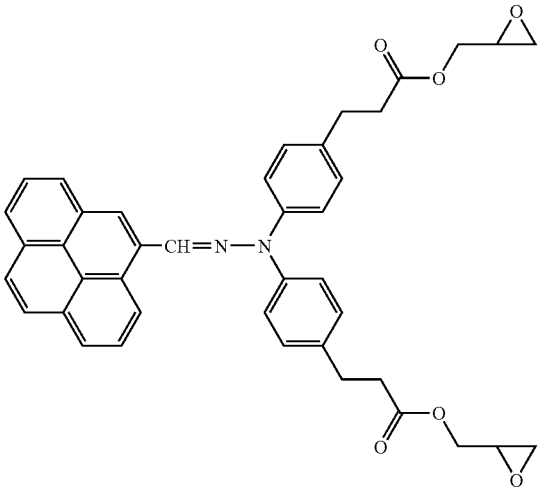

-continued
II-42
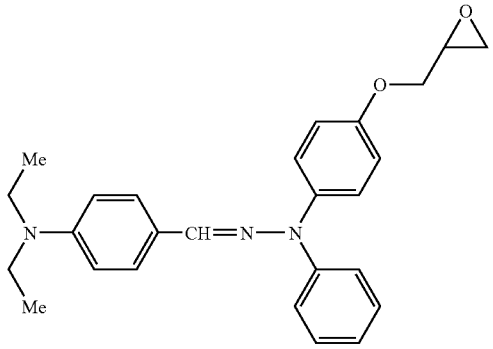
II-43
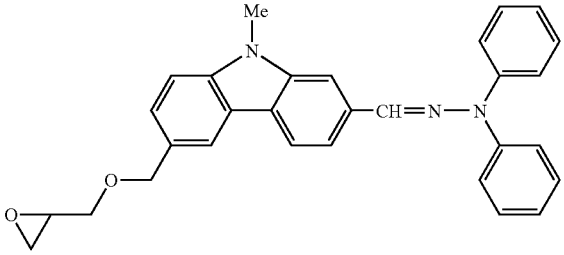
II-44
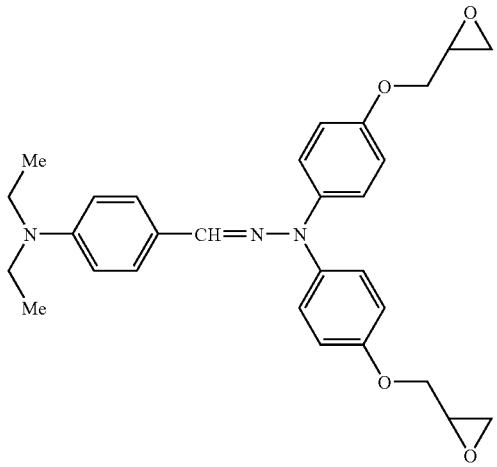
II-45
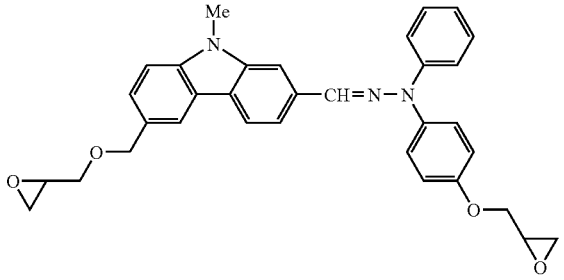
-continued
II-46
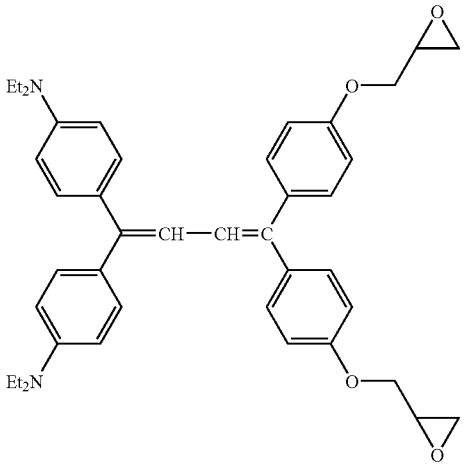
II-47
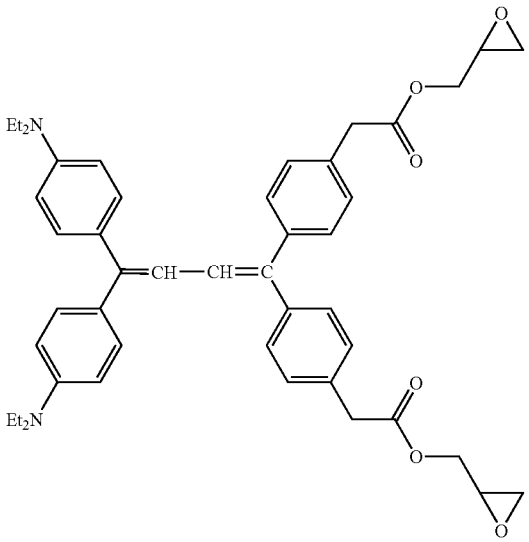
Specific examples of the compounds represented by Formula (III) include, but not limited thereto, the following compounds III-1 to III-40. In the compounds represented by the Formula (III), the bond which is described with no substituent at the end, or Me, represents a bond having a methyl group at the end. Et represents an ethyl group.

III-1
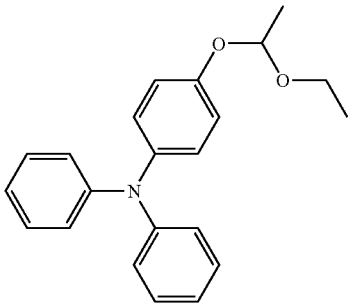
III-2
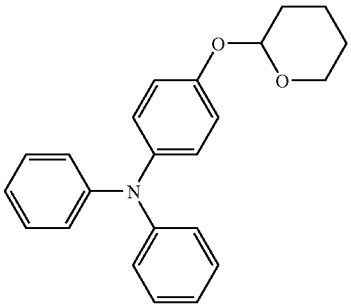
III-3
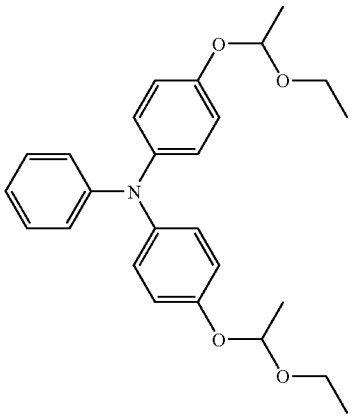
III-4
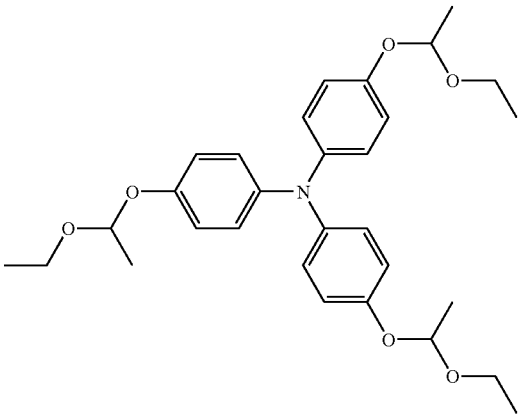
III-5
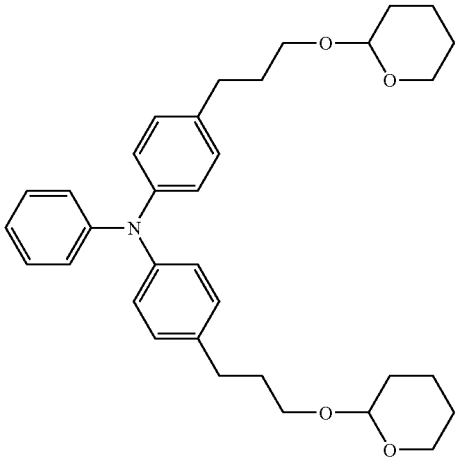
III-6
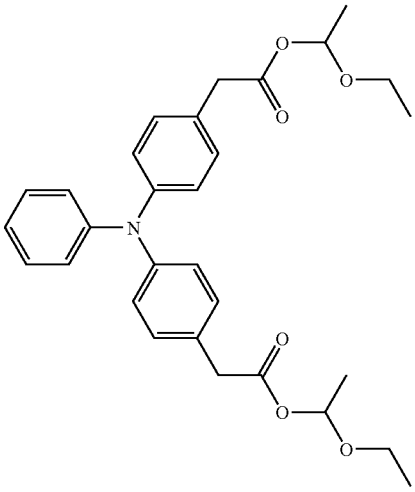

-continued
III-7
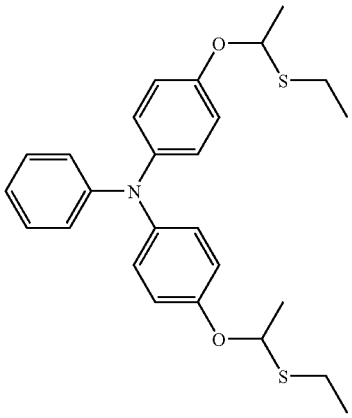
III-8
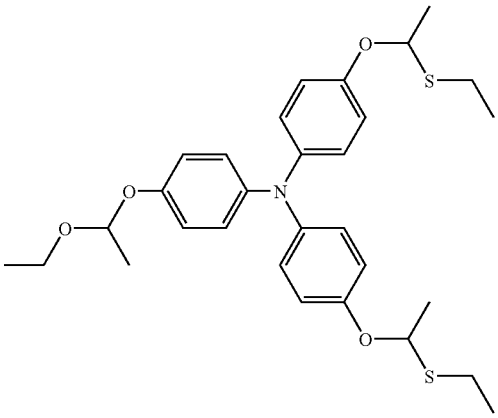
III-9
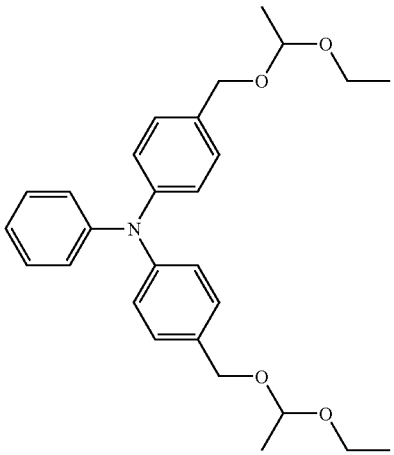
III-10
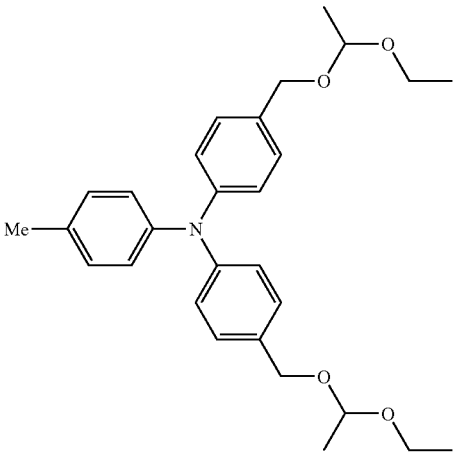
III-11
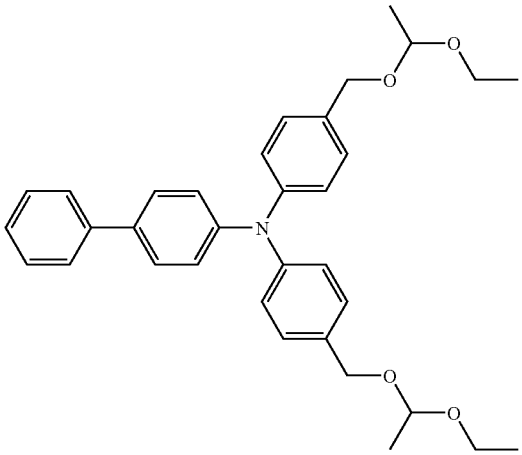
III-12
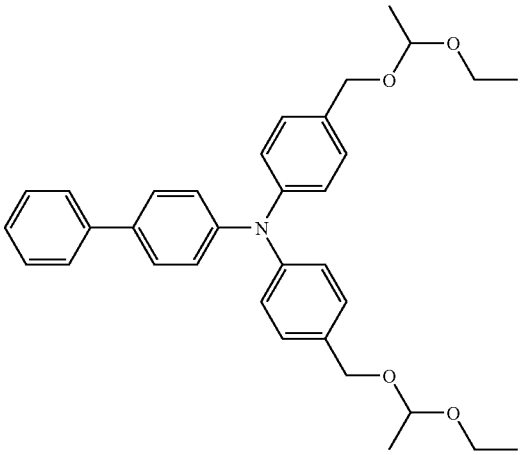

-continued
III-13
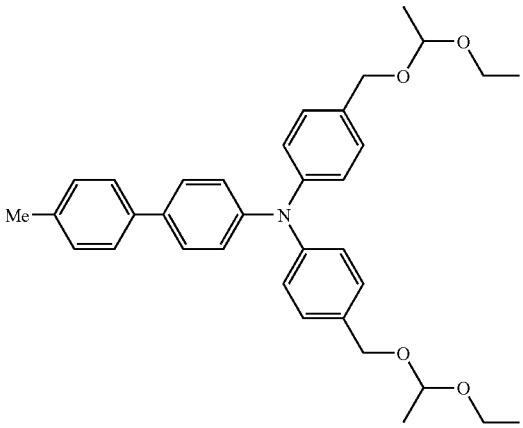
III-14
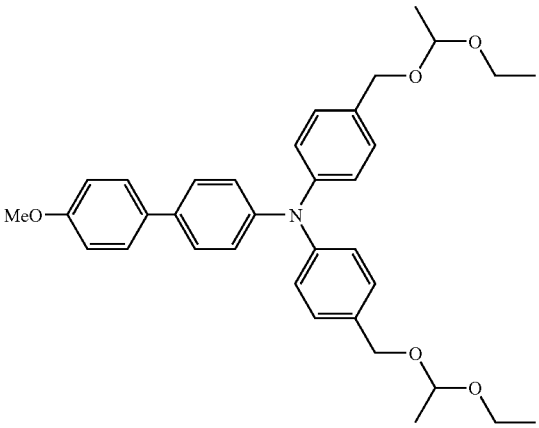
III-15
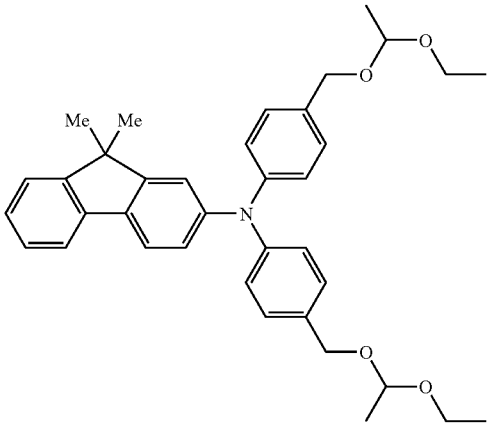
III-16
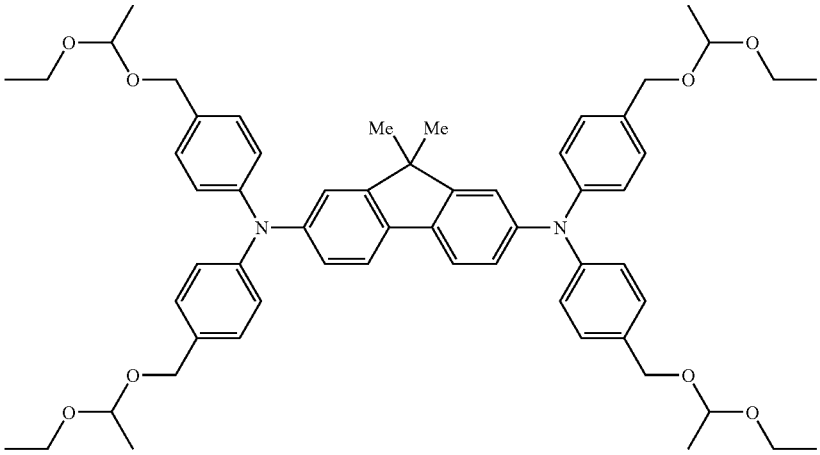

-continued
III-17
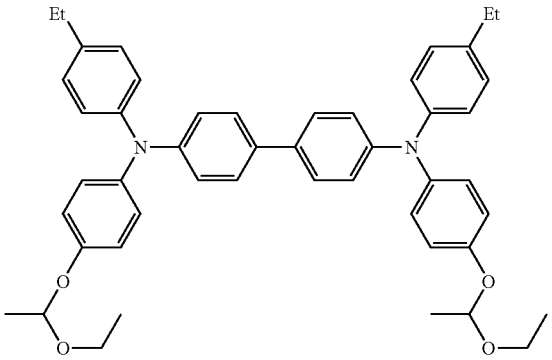
III-18
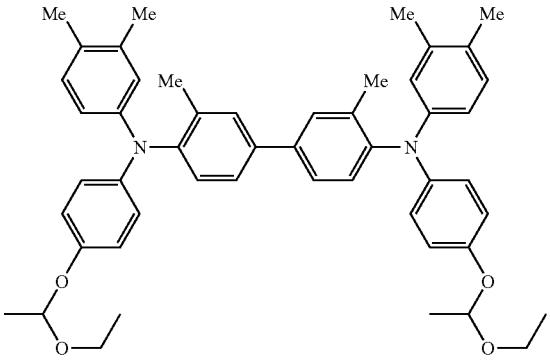
III-19
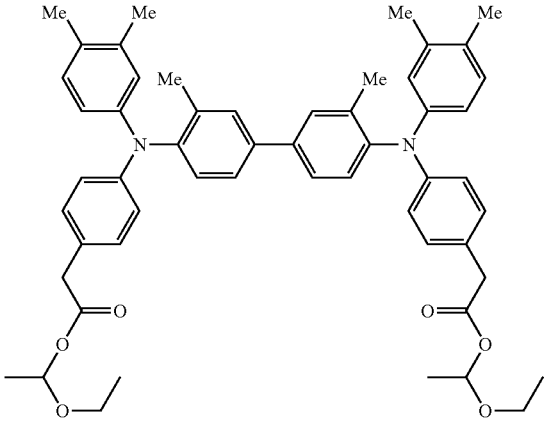
III-20
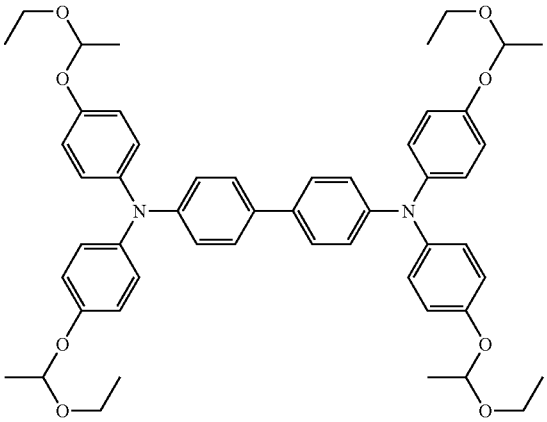
III-21
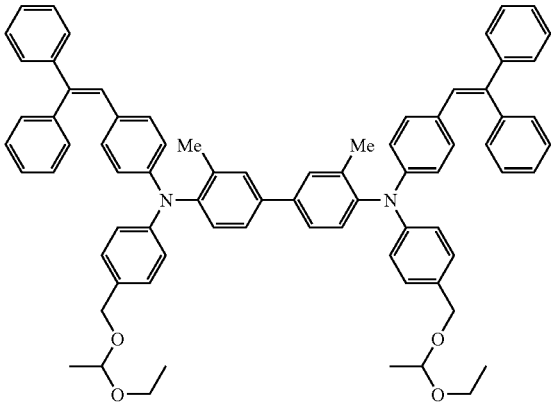
III-22
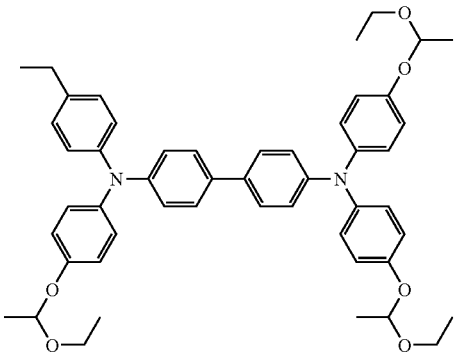

-continued
III-23
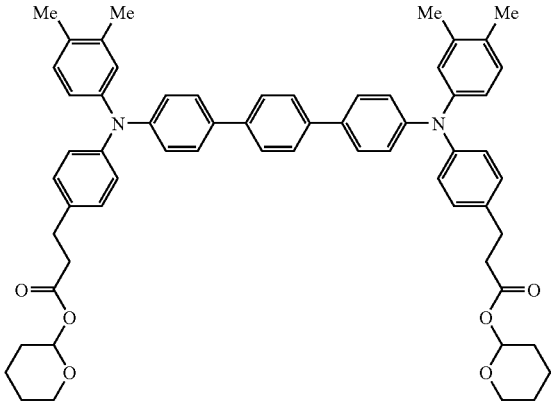
III-24
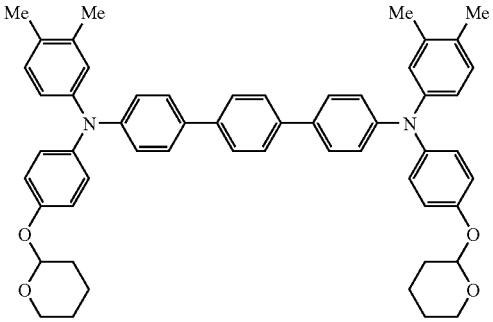
III-25
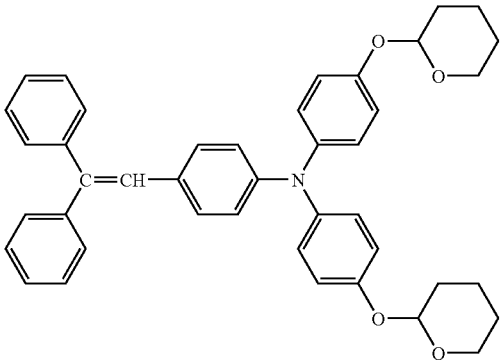
III-26
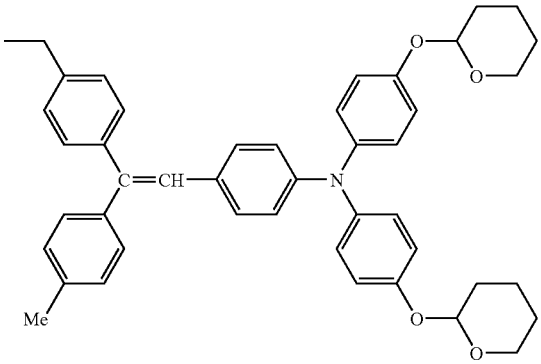
III-27
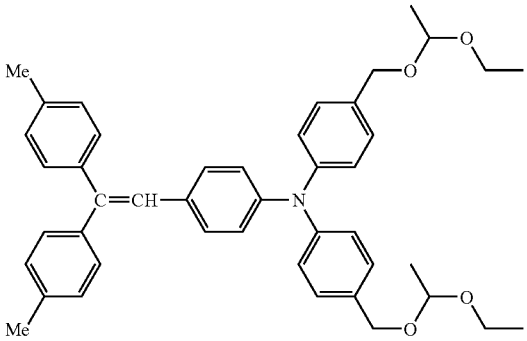
III-28
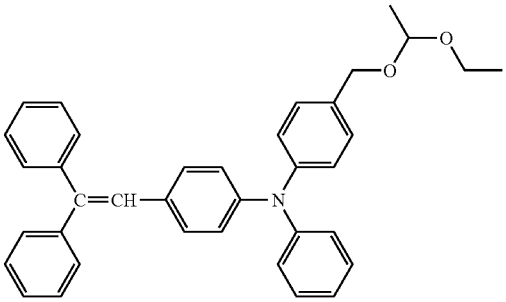
III-29
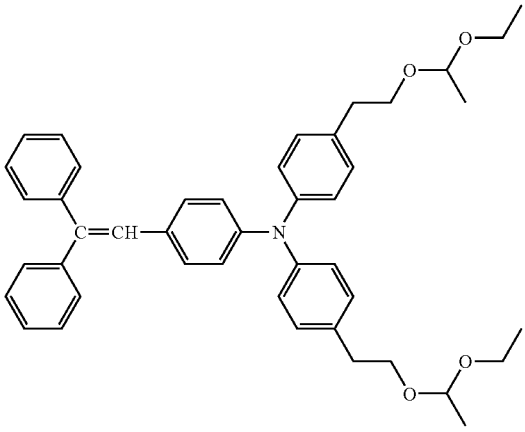
III-30
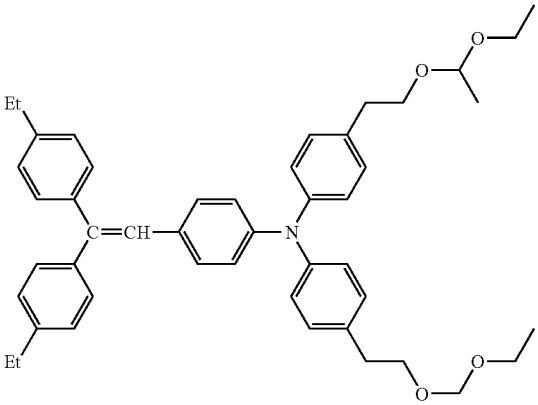

-continued
III-31
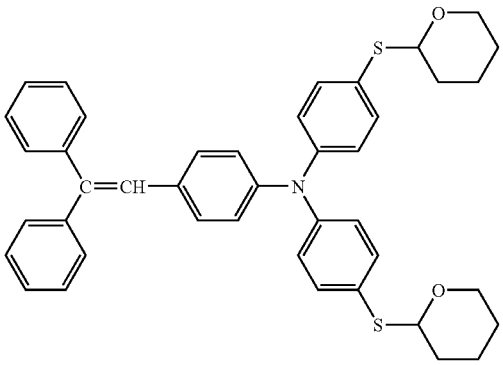
III-32
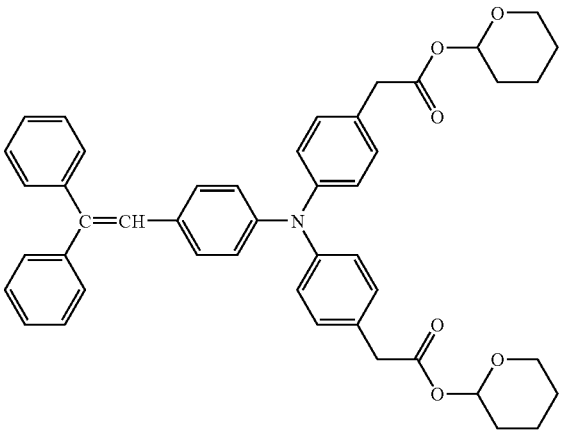
III-33
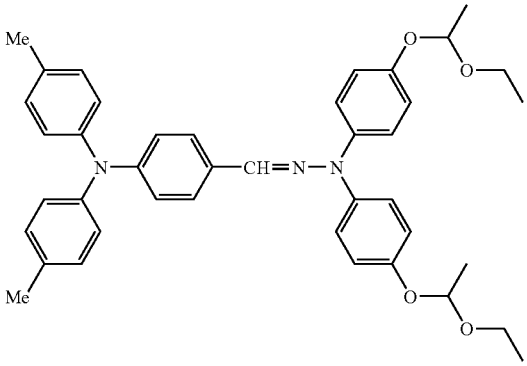
III-34
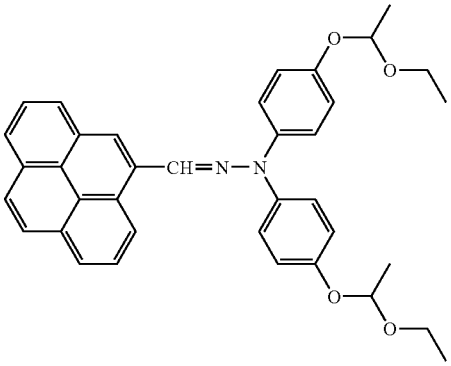
III-35
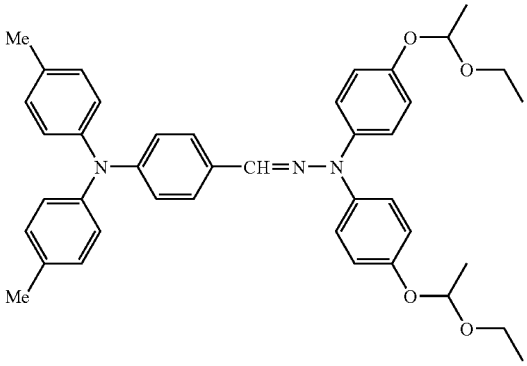
III-36
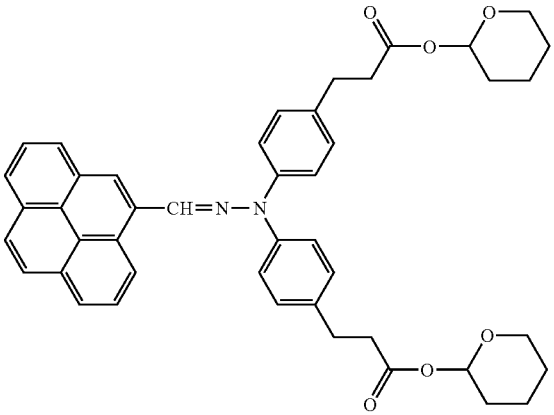

-continued
III-37
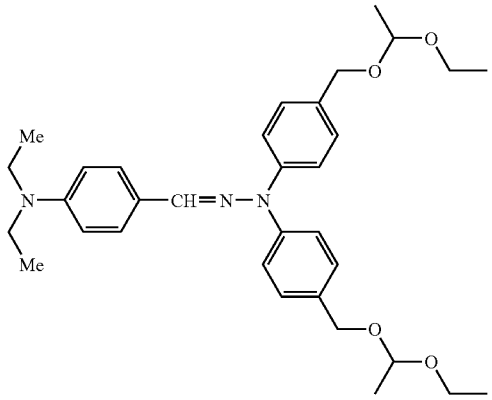
III-38
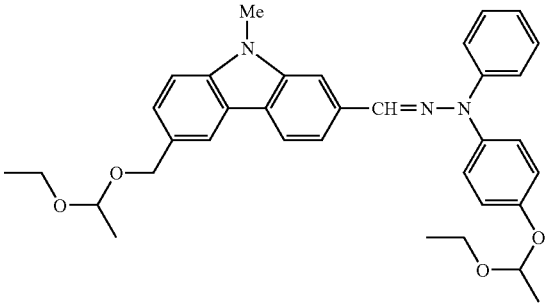
III-39
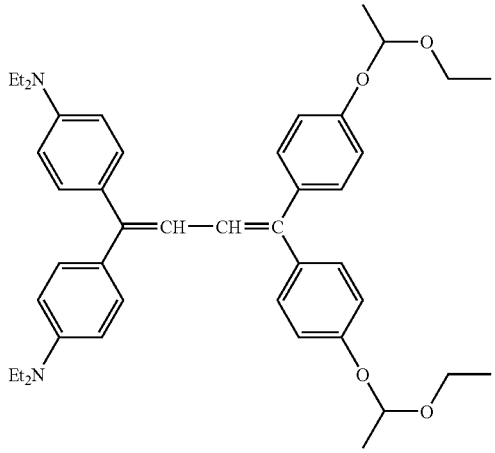
III-40
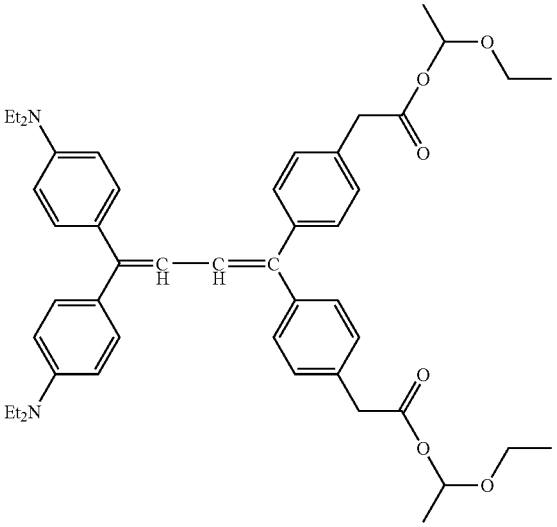
Specific examples of the compounds represented by Formula (IV) include, but are not limited to, the following compounds IV-1 to IV-13. In the compounds represented by the Formula (IV), the bond which is described but not with a substituent at the end thereof, or Me, represents a bond having a methyl group at the end thereof.
IV-1
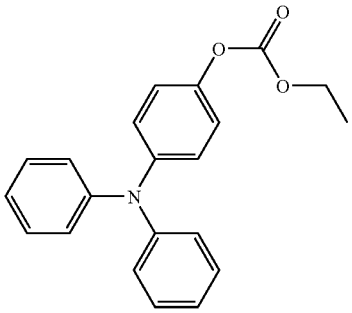
-continued
IV-2
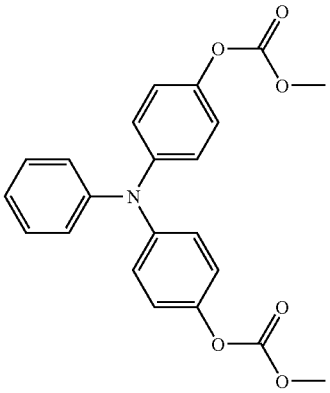

-continued
IV-3
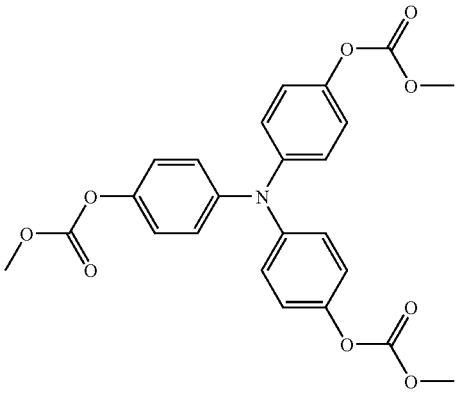
IV-4
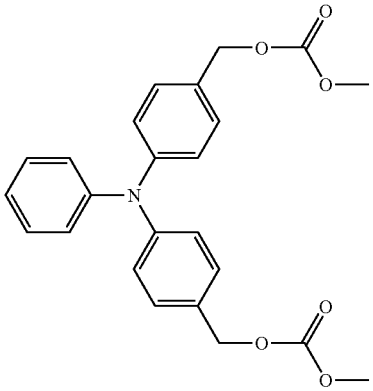
IV-5
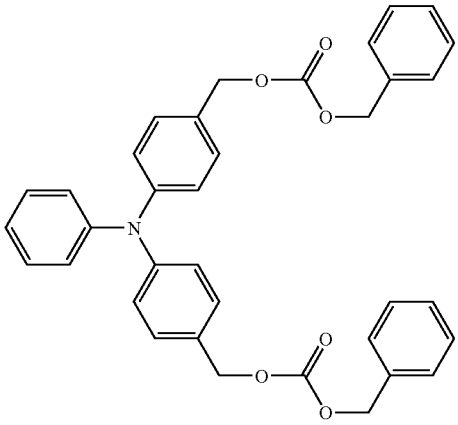
-continued
IV-6
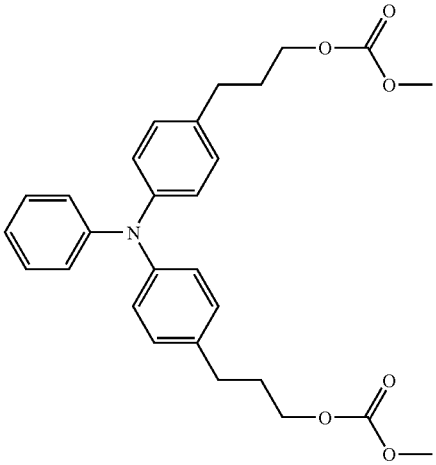
IV-7
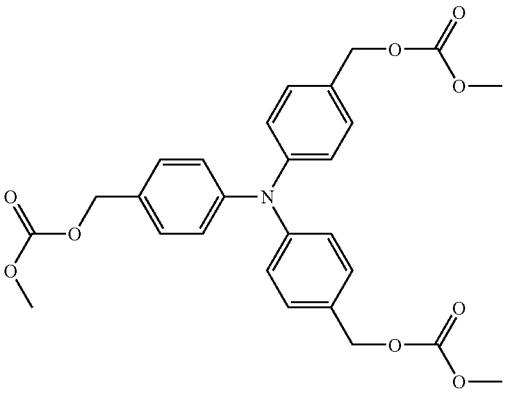
IV-8
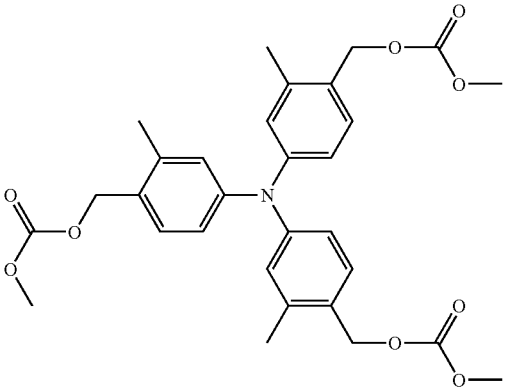

-continued

IV-9

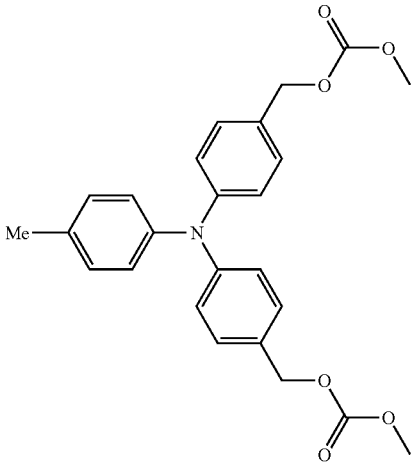

IV-10

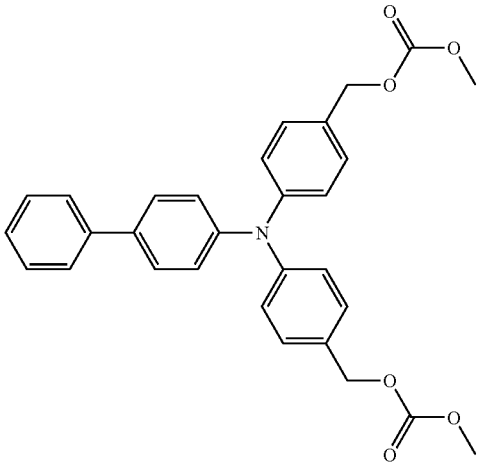

IV-11

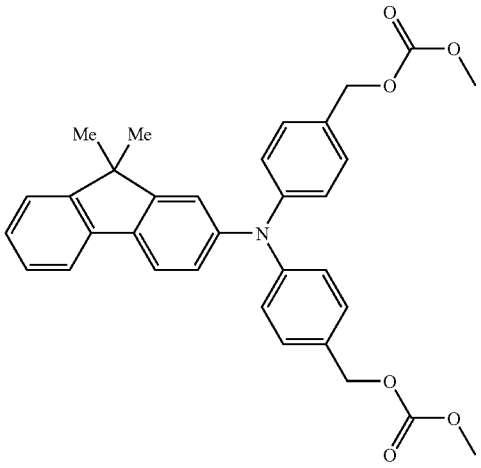

-continued

IV-12

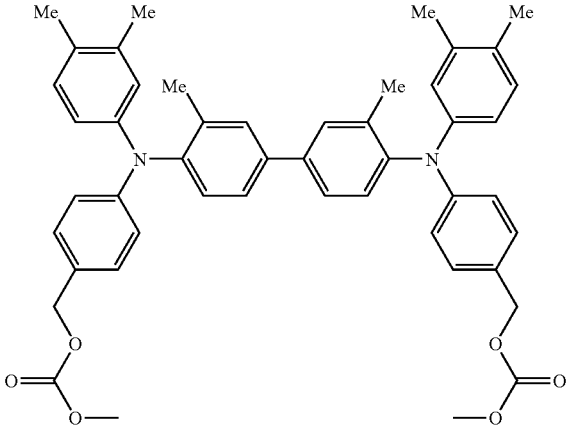

IV-13

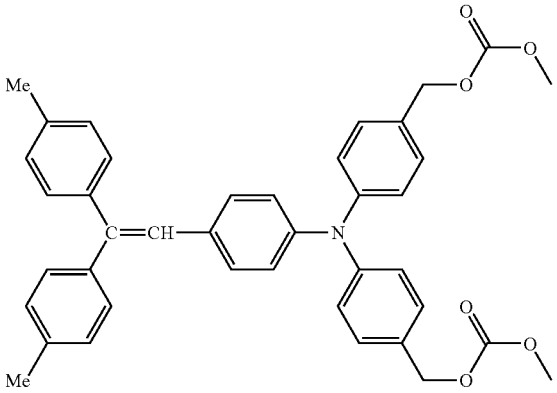

Specific examples of the compounds represented by Formula (V) include, but are not limited to, the following compounds V-1 to V-17. In the compounds represented by the Formula (V), the bond which is described but not with a substituent at the end thereof, or Me, represents a bond having a methyl group at the end thereof, and Et represents an ethyl group.

V-1

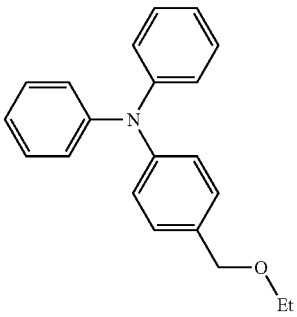

-continued
V-2
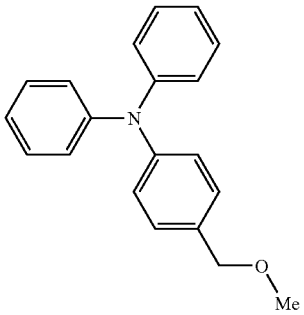
V-3
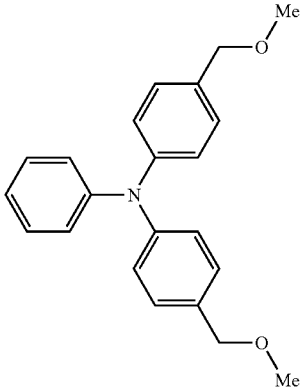
V-4
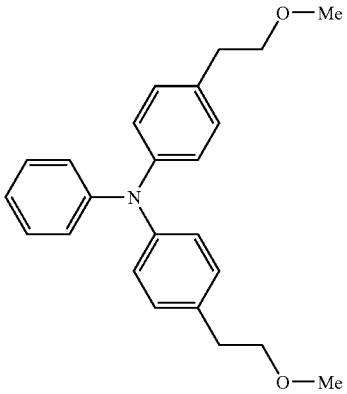
V-5
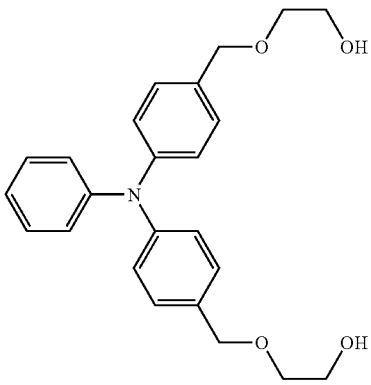
-continued
V-6
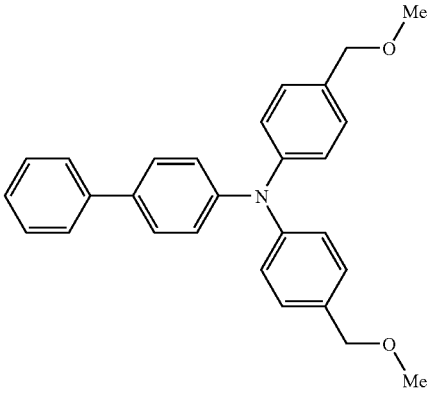
V-7
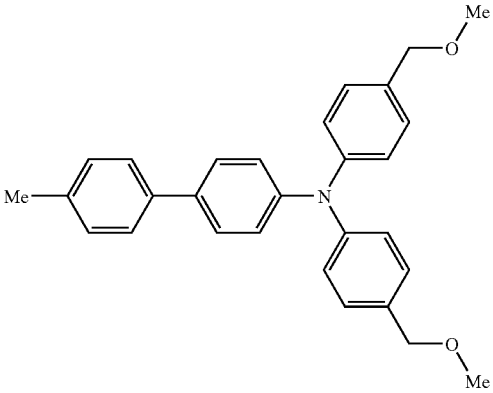
V-8
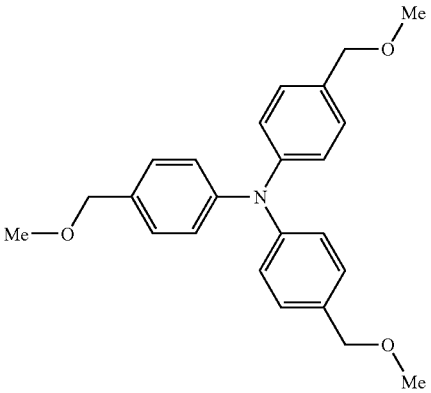
V-9
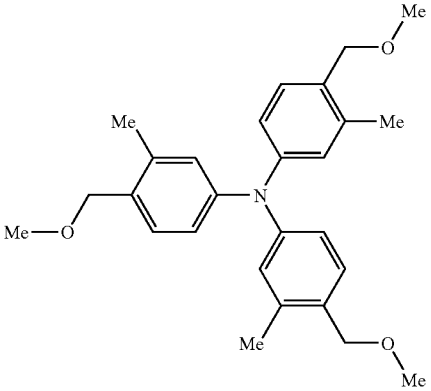

-continued
V-10
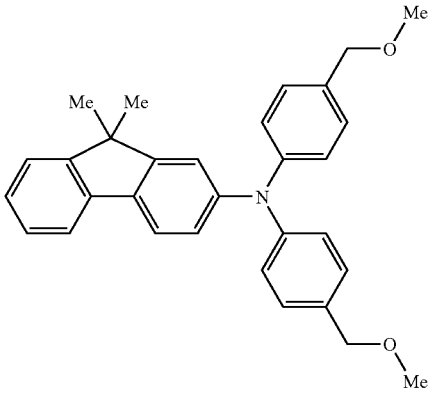
V-11
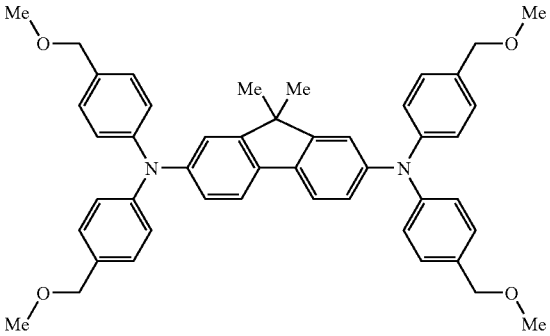
V-12
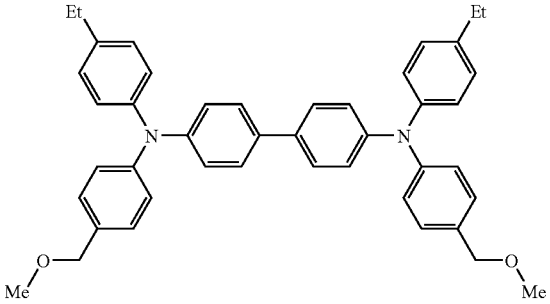
V-13
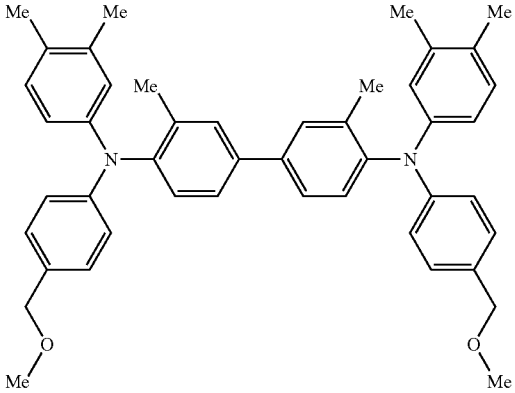
-continued
V-14
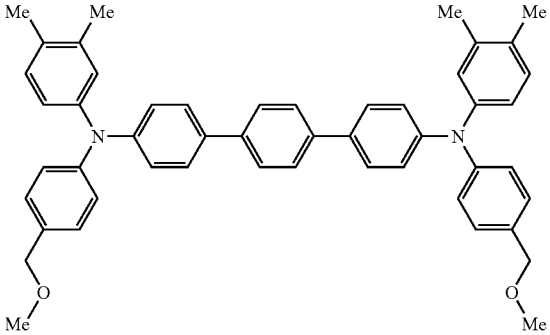
V-15
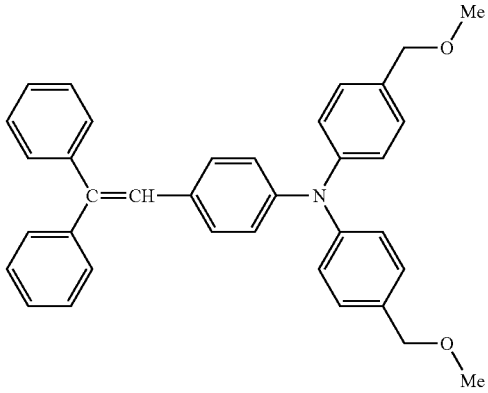
V-16
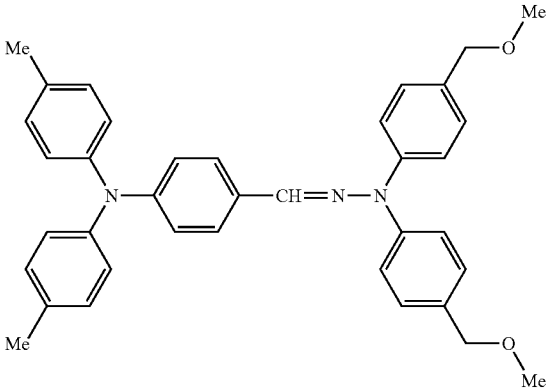
V-17
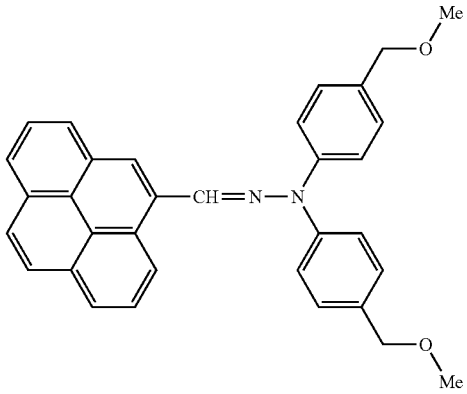

The compound having a structure as represented by the above-described Formula (IV) may be synthesized, for example, by the reaction represented by the following reaction formula, in which a compound having a hydroxyl group represented by Formula (1-a) is reacted with a halide represented by Formula (1-b) in an organic solvent in the presence of a base catalyst.

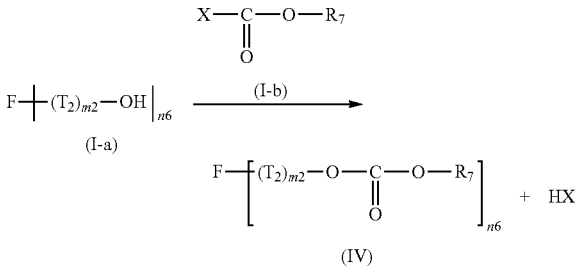

In Formula (1-a), F represents an organic group having a valence of n6 and a hole transporting ability, $T_2$ represents a divalent group, m2 denotes 0 or 1, and n6 denotes an integral number of 1 to 4. In Formula (1-b), X represents a halogen atom, $R_7$ represents a monovalent organic group, e.g. an organic group having carbon atoms of 1 to 18. In Formula (IV), F represents an organic group having a valence of n6 and a hole transporting ability, $T_2$ represents a divalent group, m2 denotes 0 or 1, $R_7$ represents a monovalent organic group, e.g. an organic group having carbon atoms of 1 to 18, and n6 denotes an integral number of 1 to 4.

Examples of the organic solvents include toluene, xylene, ethylbenzene, tetrahydrofuran, diethyl ether, dioxane, methylene chloride, 1,2-dichloroethane, chlorobenzene, N,N-dimethylformamide, and dimethyl sulfoxide.

Examples of the base catalysts include sodium hydroxide, potassium hydroxide, sodium methoxide, sodium-tert-butoxide, potassium-tert-butoxide, triethylamine, trimethylamine, pyridine and piperidine. Among them, triethylamine and pyridine are preferable. The amount of the base catalyst is preferably a molar amount of 1 to 2 times, more preferably 1.1 to 1.5 times, relative to the hydroxyl groups of the compound represented by the above-described formula (1-a).

The above-described reaction can be carried out at an optional temperature in the range under the boiling point of the solvent, but more preferably in the range of room temperature to 50° C. for suppressing the side reactions.

The compound represented by the above-described Formula (V) can be readily synthesized, for example, by reacting a triphenylamine compound having hydroxyalkyl groups with a dialkyl sulfate or an alkyl iodide to etherify the hydroxyalkyl groups. In this case, the reagent can be optionally selected from dimethyl sulfate, diethyl sulfate, methyl iodide, ethyl iodide or the like, which can be used in amount of 1 to 3 equivalent, preferably 1 to 2 equivalent with respect to the hydroxyalkyl groups. The base catalyst can be optionally selected from sodium hydroxide, potassium hydroxide, sodium methoxide, sodium ethoxide, sodium t-butoxide, potassium t-butoxide, sodium hydride, and metallic sodium, which can be used in amount of 1 to 3 equivalent, preferably 1 to 2 equivalent with reference to the hydroxyalkyl groups. The reaction can be carried out within a temperature range of 0° C. to the boiling point of the solvent.

Examples of the solvents used for the reaction include benzene, toluene, methylene chloride, tetrahydrofuran, N,N'-dimethylformamide, dimethyl sulfoxide, N-methylpyrrolidone and 1,3-dimethyl-2-imidazolidinone. These solvents may be used alone or in combination thereof. In some reactions, a quaternary ammonium salt such as tetra-n-butyl ammonium iodide may be used to catalyze the interlayer migration.

The protective layer 5 of the invention may further include other coupling agents or fluorine compounds for controlling the properties such as film-forming ability, flexibility, lubricity, and adhesiveness of the film. Examples of such compounds include various silane coupling agents, and commercially available silicone-based hard coating agents.

Examples of the silane coupling agents include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane and dimethyldimethoxysilane. Examples of the commercially available hard coating agent include KP-85, X-40-9740, X-8239 (manufactured by Shin-Etsu Chemical Co., Ltd.), AY42-440, AY42-441, and AY49-208 (manufactured by Toray Dow Coming Silicone Co. Ltd.). In order to impart water repellency, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2 H-perfluorooctyltriethoxysilane may be added. The amount of the silane coupling agent may be determined as appropriate. However, the amount of the fluorine-containing compound is preferably 0.25 times by weight or lower, with reference to the fluorine-free compounds. If the amount of the fluorine-containing compound exceeds the above range, the film-forming ability of the crosslinked film may be impaired.

Resins that are soluble in alcohols may also be added to the protective layer 5 for the purposes such as controlling of the discharge gas resistance, mechanical strength, scratch resistance, particle dispersibility and viscosity; reduction of the torque; controlling of the abrasive wear; extending a pot life; and others.

Examples of the resins that are soluble in an alcohol-based solvent include polyvinylbutyral resins, polyvinylformal resins, polyvinylacetal resins such as partially acetalized polyvinylacetal resins having butyral partially modified by formal or acetoacetal (for example, S-Lec B and K series, manufactured by Sekisui Chemical Co., Ltd.), polyamide resins, cellulose resins and polyvinylphenolic resins. Most preferred are polyvinyl acetal resins and polyvinyl phenolic resins from the viewpoint of electrical characteristics. The weight average molecular weight of the resin is preferably 2,000 to 100,000, more preferably 5,000 to 50,000. If the molecular weight of the resin is less than 2,000, effects achieved by adding of the resin may not be sufficient, and if exceeds 100,000, the solubility of the resin may lower to limit the content of the resin, which affect film forming ability during application. The content of the resin is preferably 1 to 40 weight %, more preferably 1 to 30 weight %, further preferably 5 to 20 weight %. If the content of the resin is less than 1 weight %, effects achieved by adding the resin may not be sufficient, and if exceeds 40 weight %, image blurring may occur at a high temperature and humidity.

The coating solution containing these components for the surface layer may be prepared with no solvent or with a solvent such as the alcohols such as methanol, ethanol, propanol and butanol, ketones such as acetone and methyl ethyl ketone, and ethers such as tetrahydrofuran, diethyl ether and dioxane. These solvents may be used alone or in combination of two or more kinds, and preferred solvents are those having a boiling point of 100° C. or less. The amount of the solvent may optionally be determined, but preferably 0.5 to 30 parts, more preferably 1 to 20 parts with reference to 1 part of the compound represented by Formulae (I) to (V). If the amount is too small, the compounds represented by Formulae (I) to (V) may easily deposit.

When the coating solution is prepared by reacting the above-described component, the component may simply be mixed and dissolved, or may further be heated at a temperature of room temperature to 100° C., preferably 30° C. to 80° C., for 10 minutes to 100 hours, preferably 1 hour to 50 hours. It is also preferable to irradiate the solution with ultrasonic wave. It is presumed that the irradiation progresses the partial reaction and enhances the uniformity of the coating solution, by which the formation of a uniform film with no coating defect may be facilitated.

In order to prevent the deterioration of the protective layer 5 caused by oxidizing gas such as ozone that is generated by the charging device, it is preferable to add an antioxidant to the protective layer 5. Higher resistance to oxidization than ever is required for a photoreceptor having enhanced surface mechanical strength and longer operating life, since the photoreceptor tends to be exposed to oxidizing gas for the longer period of time. Preferable examples of the antioxidants include hindered phenol-based or hindered amine-based antioxidants, and known antioxidants such as organic sulfur-based antioxidant, phosphite-based antioxidants, dithiocarbamate-based antioxidants, thiourea-based antioxidants and benzimidazole-based antioxidants also may be used. The content of the antioxidant is preferably 20 weight % or less, more preferably 10 weight % or less.

Examples of the hindered phenol-based antioxidant include 2,6-di-t-butyl-4-methylphenol, 2,5-di-t-butylhydroquinone, N,N'-hexamethylene bis(3,5-di-t-butyl-4-hydroxyhydrocinnamate, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5 -di-t-amylhydroquinone, 2-t-butyl-6-(3-butyl-2-hydroxy-5-methylbenzyl)-4-methylphenylacrylate, and 4,4'-butylidenebis(3-methyl-6-t-butylphenol).

In order to improve the stain resistance and lubricity of the surface of the electrophotographic photoreceptor, various kinds of particles may be added to the protective layer 5. Examples of the particles include silicon-containing particles. The silicon-containing particles are the particles containing silicon as the constituent element, and specific examples thereof include colloidal silica and silicone particles. The colloidal silica used as the silicon-containing particles can be selected from the common commercially available products in the form of a dispersion of an acidic or alkaline aqueous solution or an organic solvent such as an alcohol, ketone, or ester, in which the silica particles having an average particle diameter of 1 to 100 nm, preferably 10 to 30 nm, are dispersed. The solid content of the colloidal silica in the protective layer 5 is not particularly limited, but usually 0.1 to 50 weight %, preferably 0.1 to 30 weight % with reference to the total solid content of the protective layer 5 from the viewpoints of film-forming ability, film strength and electrical characteristics.

The silicone particles used as the silicon-containing particles may be selected from the common commercially available products of silicone resin particles, silicone rubber particles and silicone surface-treated silica particles. These silicone particles are spherical, and preferably have an average particle diameter of 1 to 500 nm, more preferably 10 to 100 nm. By using the silicone particles, the surface properties of an electrophotographic photoreceptor can be improved without inhibiting the crosslinking reaction, since the particles can exhibit an excellent dispersibility to resin because of being small in diameter and chemically inactive, and further, the content of the silicone particles required to achieve desirable characteristics is small. More specifically, the particles are uniformly incorporated into the strong crosslinking structure, and thereby enhancing the lubricity and water repellency of the surface of the electrophotographic photoreceptor, and maintaining the favorable abrasion resistance and stain resistance over the long time. The content of the silicone particles in the protective layer 5 is preferably 0.1 to 30 weight %, more preferably 0.5 to 10 weight % relative to the total solid content in the protective layer 5.

Other examples of the particles include fluorine-based particles of ethylene tetrafluoride, ethylene trifluoride, propylene hexafluoride, vinyl fluoride, vinylidene fluoride and the like, particles of resin comprising a copolymer of a fluorine resin and a monomer having hydroxyl groups, as described in "Proceedings of 8th Polymer Material Forum, p89", and particles of semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $SnO_2$, $In_2O_3$, ZnO and MgO.

Oils such as silicone oil may also be added for the same purposes as the above. Examples of the silicone oils include silicone oils such as dimethylpolysiloxane, diphenylpolysiloxane and phenylmethylsiloxane, reactive silicone oils such as amino modified polysiloxane, epoxy modified polysiloxane, carboxyl modified polysiloxane, carbinol modified polysiloxane, methacryl modified polysiloxane, mercapto modified polysiloxane and phenol modified polysiloxane, cyclic dimethyl cyclosiloxanes such as hexamethyl cyclotrisiloxane, octamethyl cyclotetrasiloxane, dicamethyl cyclopentasiloxane and dodecamethyl cyclohexasiloxane, cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane, cyclic phenylcyclosiloxanes such as hexaphenylcyclotrisiloxian, fluorine-containing cyclosiloxanes such as 3-(3,3,3-trifluoropropyl)methylcyclotrisiloxane, hydrosilyl group-containing cyclosiloxanes such as methylhydrosiloxane mixtures, pentamethylcyclopentasiloxane and phenylhydrocyclosiloxane, and vinyl group-containing cyclosiloxanes such as pentavinylpentamethylcyclopentasiloxane.

Catalysts may be added for curing resin compositions to promote the curing of the phenolic resin. The catalyst preferably exhibits acidity at room temperature or after heating, and the most preferable examples thereof are organic sulfonic acids and/or the derivatives thereof from the viewpoint of adhesiveness, ghost suppression and electrical characteristics. The presence of these catalysts in the protective layer is readily determined by means of XPS or the like.

Examples of the organic sulfonic acids and/or the derivatives thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid, and most preferred are p-toluenesulfonic acid and dodecylbenzenesulfonic acid from the viewpoint of catalytic activity and film-forming property. The salts of the organic sulfonates may also be used, as long as they can dissociate to some degree.

By using a so-called heat latent catalyst that exhibits an increased degree of catalytic activity when a temperature of a certain degree or more is applied, both of the lowering of curing temperature and the storage stability can be achieved, since the catalytic activity at a temperature at which the liquid is in storage is low, while the catalytic activity at the time of curing is high.

Examples of the heat latent catalyst include the microcapsules in which an organic sulfone compound or the like are coated with a polymer in the form of particles, porous compounds such as zeolite onto which an acid or the like is adsorbed, heat latent protonic acid catalysts in which a protonic acid and/or a derivative thereof are blocked with a base, a protonic acid and/or a derivative thereof esterified by a primary or secondary alcohol, a protonic acid and/or a derivative thereof blocked with a vinyl ether and/or a vinyl thioether, monoethyl amine complexes of boron trifluoride, and pyridine complexes of boron trifluoride.

From the viewpoint of catalytic activity, storage stability, availability and cost efficiency, the protonic acid and/or the derivative thereof that are blocked with a base are preferably used.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzene sulfonic acid, o-, m-, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of the protonic acid derivatives include neutralized alkali metal salts or alkali earth metal salts of protonic acids such as sulfonic acid and phosphoric acid, and polymer compounds in which a protonic acid skeleton is incorporated into a polymer chain (e.g., polyvinylsulfonic acid). Examples of the base to block the protonic acid include amines.

The amines are classified into primary, secondary, and tertiary amines. In the invention, any of these amines can be used without limitation.

Examples of the primary amines include methylamine, ethylamine, propylamine, isopropylamine, n-butylamine, isobutylamine, t-butylamine, hexylamine, 2-ethylhexylamine, secondary butylamine, allylamine and methylhexylamine.

Examples of the secondary amines include dimethylamine, diethylamine, di-n-propylamine, diisopropylamine, di-n-butylamine, diisobutylamine, di-t-butylamine, dihexylamine, di(2-ethylhexyl)amine, N-isopropyl N-isobutylamine, di(2-ethylhexyl)amine, disecondarybutylamine, diallylamine, N-methylhexylamine, 3-pipecholine, 4-pipecholine, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methyl morpholine, N,N-dimethylallylamine, N-methyl diallylamine, triallylamine, N,N-dimethylallylamine, N,N,N',N'-tetra methyl-1,2-diaminoethane, N,N,N',N'-tetramethyl-1,3 -diaminopropane, N,N,N',N'-tetraallyl-1,4-diaminobutane, N-methylpiperidine, pyridine, 4 -ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5 -nonyl)pyridine, imidazole and N-methylpiperazine.

Examples of the commercially available products include NACURE 2501 (toluenesulfonic acid dissociation, methanol/isopropanol solvent, pH; 6.0 to 7.2, dissociation temperature; 80° C.), NACURE 2107 (p-toluenesulfonic acid dissociation, isopropanol solvent, pH; 8.0 to 9.0, dissociation temperature; 90° C.), NACURE 2500 (p-toluenesulfonic acid dissociation, isopropanol solvent, pH; 6.0 to 7.0, dissociation temperature; 65° C.), NACURE 2530 (p-toluenesulfonic acid dissociation, methanol/isopropanol solvent, pH; 5.7 to 6.5, dissociation temperature; 65° C.), NACURE 2547 (p-toluenesulfonic acid dissociation, aqueous solution, pH; 8.0 to 9.0, dissociation temperature; 107° C.), NACURE 2558 (p-toluene sulfonic acid dissociation, ethyleneglycol solvent, pH; 3.5 to 4.5, dissociation temperature; 80° C.), NACURE XP-357 (p-toluenesulfonic acid dissociation, methanol solvent, pH; 2.0 to 4.0, dissociation temperature; 65° C.), NACURE XP-386 (p-toluenesulfonic acid dissociation, aqueous solution, pH; 6.1 to 6.4, dissociation temperature; 80° C.), NACURE XC-2211 (p-toluenesulfonic acid dissociation, pH; 7.2 to 8.5, dissociation temperature; 80° C.), NACURE 5225 (dodecylbenzenesulfonic acid dissociation, isopropanol solvent, pH; 6.0 to 7.0, dissociation temperature; 120° C.), NACURE 5414 (dodecylbenzenesulfonic acid dissociation, xylene solvent, dissociation temperature; 120° C.), NACURE 5528 (dodecylbenzenesulfonic acid dissociation, isopropanol solvent, pH; 7.0 to 8.0, dissociation temperature; 120° C.), NACURE 5925 (dodecylbenzenesulfonic acid dissociation, pH; 7.0 to 7.5, dissociation temperature; 130° C., NACURE 1323 (dinonyl naphthalene sulfonic acid dissociation, xylene solvent, pH; 6.8 to 7.5, dissociation temperature; 150° C.), NACURE 1419 (dinonylnaphthalenesulfonic acid dissociation, xylene/methylisobutylketone solvent, dissociation temperature; 150° C.), NACURE 1557 (dinonylnaphthalenesulfonic acid dissociation, butanol/2-butoxyethanol solvent, pH; 6.5 to 7.5, dissociation temperature; 150° C.), NACURE X49-110 (dinonylnaphthalenedisulfonic acid dissociation, isobutanol/isopropanol solvent, pH; 6.5 to 7.5, dissociation temperature; 90° C.), NACURE 3525 (dinonylnaphthalenedisulfonic acid dissociation, isobutanol/isopropanol solvent, pH; 7.0 to 8.5, dissociation temperature; 120° C.), NACURE XP-383 (dinonylnaphthalenedisulfonic acid dissociation, xylene solvent, dissociation temperature; 120° C.), NACURE 3327 (dinonylnaphthalenedisulfonic acid dissociation, isobutanol/isopropanol solvent, pH; 6.5 to 7.5, dissociation temperature; 150° C.), NACURE 4167 (phosphoric acid dissociation, isopropanol/isobutanol solvent, pH; 6.8 to 7.3, dissociation temperature; 80° C.), NACURE XP-297 (phosphoric acid dissociation, water/isopropanol solvent, pH; 6.5 to 7.5, dissociation temperature; 90° C., and NACURE 4575 (phosphoric acid dissociation, pH; 7.0 to 8.0, dissociation temperature; 110° C.) (manufactured by King Industries).

These heat latent catalysts may be used alone or in combination of two or more kinds thereof.

The content of the heat latent catalyst is preferably 0.01 to 20 weight %, most preferably 0.1 to 10 weight %, with respect to the 100 parts of solid content in the phenol-based resin solution. If the content exceeds 20 weight %, the catalyst may deposit as foreign matters after sintering treatment, and if less than 0.01 weight %, the catalytic activity may be lowered.

The content of the charge generating material in the single-layer photosensitive layer 6 (charge generating/charge transporting layer) is about 10 to 85 weight %, and preferably 20 to 50 weight %. The content of the charge transporting material is preferably 5 to 50 weight %. The single-layer photosensitive layer 6 (charge generating/charge transporting layer) is formed in the same manner as the charge generating layer 2 and the charge transporting layer 3. The thickness of the single-layer photosensitive layer (charge generating/charge transporting layer) 6 is preferably about 5 to 50 μm, more preferably 10 to 40 μm.

(Image Forming Apparatus/Process Cartridge)

Figure 4:
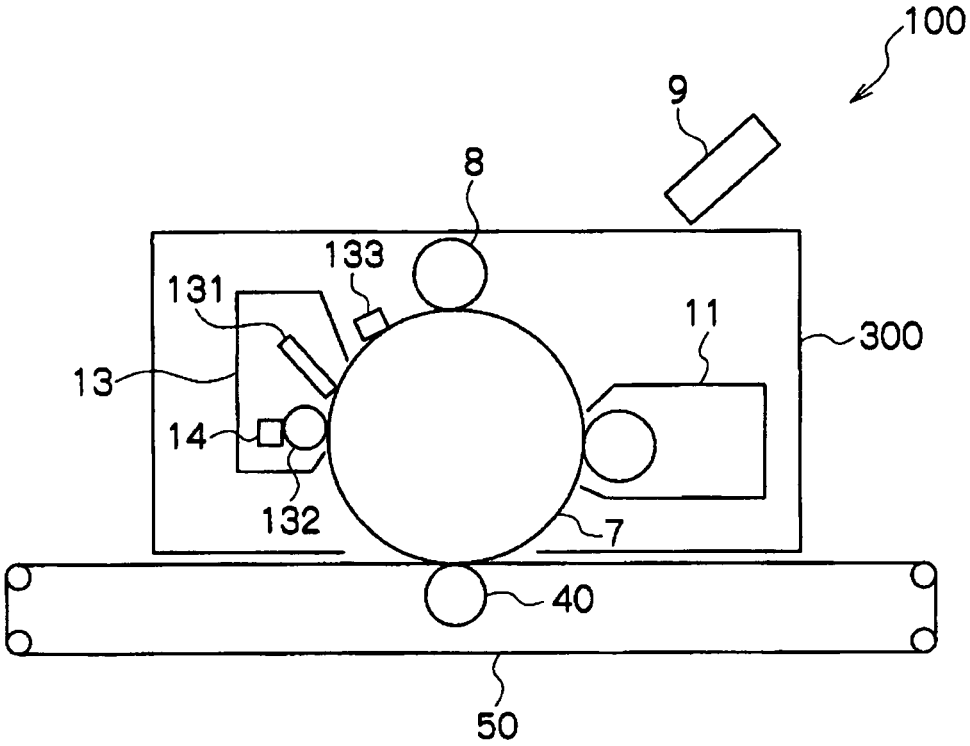
FIG. 4 is a schematic sectional view showing a process cartridge of the invention.

FIG. 4 is a schematic sectional view showing a preferred embodiment of the image forming apparatus comprising the electrophotographic photoreceptor of the invention. The image forming apparatus 100 shown in FIG. 4 comprises a process cartridge 300 having an electrophotographic photoreceptor 7, an exposure device 9, a transfer apparatus 40, and an intermediate transfer body 50, in an image forming apparatus main body (not shown). The exposure device 9 is disposed at a position such that the electrophotographic photoreceptor 7 is irradiated through the opening of the process cartridge 300. The transfer device 40 is disposed opposite to the electrophotographic photoreceptor 7 via the intermediate transfer body 50. The intermediate transfer body 50 is disposed such that a part of the intermediate transfer body 50 contacts the electrophotographic photoreceptor 7.

The process cartridge 300 integrally supports the electrophotographic photoreceptor 7, the charging device 8, a developing device and a cleaning device 13, in a housing. The cleaning device 13 has a cleaning blade 131 (cleaning member). The cleaning blade 131 is disposed so as to contact the surface of the electrophotographic photoreceptor 7.

A fibrous member 132 (roll-formed) for supplying a lubricant 14 to the surface of the photoreceptor 7, and a fibrous member 133 for assisting cleaning (toothbrush-formed) may be used if necessary.

As the charging device 8, for example, a contact type charging device using a conductive or semiconductive charging roller, a charging brush, a charging film, a charging rubber blade, a charging tube or the like can be used. Known charging devices such as a non-contact type roller charging device using a charging roller in proximity to the photoreceptor 7, and scorotron or corotron charging devices utilizing corona discharge can also be used.

Examples of the exposure device 9 include optical instruments which can expose the surface of the photoreceptor 7 so that a desired image is formed by using light of a semiconductor laser, an LED, a liquid-crystal shutter light or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 to 450 nm can also be used. Surface-emitting type laser light sources which are capable of multi-beam output are effective to form a color image.

As the developing device 11, for example, a common developing device, in which a magnetic or non-magnetic one- or two-component developer is contacted or not contacted for forming an image, can be used. Such developing device is not particularly limited as long as it has above-described functions, and can be appropriately selected according to the preferred use. Examples thereof include known developing device in which said one- or two-component developer is applied to the photoreceptor 7 using a brush or a roller.

The toner particles used in the image forming apparatus of the present embodiment preferably have an average shape factor ($ML^2/A\times\pi/4\times100$, wherein ML represents the maximum length of a particle and A represents the projection area of the particle.) of 100 to 150, more preferably 105 to 145, further preferably 110 to 140 from the viewpoint of achieving high developability, high transferring property, and high quality image. Furthermore, the volume-average particle diameter of the toner particles is preferably 3 to 12 μm, more preferably 3.5 to 10 μm, further preferably 4 to 9 μm. By using such toner particles having the above-described average shape factor and volume-average particle diameter, developability and transferring property can be enhanced and a high quality image, so-called photographic image, can be obtained.

The method of producing the toner is not particularly limited as long as the obtained toner particles satisfy the above-described average shape factor and volume-average particle diameter. Examples of the method include a kneading and grinding method in which a binding resin, a coloring agent, a releasing agent, and optionally a charge control agent or the like are mixed and kneaded, ground, and classified; a method of altering the shape of the particles obtained by the kneading and grinding method using mechanical shock or heat energy; an emulsion polymerization aggregation method in which a dispersion solution obtained by emulsifying and polymerizing polymerizable monomers of a binding resin is mixed with a dispersion solution containing a coloring agent, a releasing agent, and optionally a charge control agent and other agents, then aggregated, heated, and fused to obtain toner particles; a suspension polymerization method in which polymerizable monomers to obtain a binding resin and a solution containing a coloring agent, a releasing agent, and optionally a charge control agent and other agents, are suspended in an aqueous solvent and polymerized therein; and a dissolution-suspension method in which a binding resin and a solution containing a coloring agent, a releasing agent, and optionally a charge control agent and other agents, is suspended in an aqueous solvent to form particles.

Moreover, known methods such as a method of producing toner particles having a core-shell structure in which aggregated particles are further attached to the toner particles obtained by the above-described method, as the core, then heated and fused. As the method of producing toner particles, a suspension-polymerization method, an emulsion polymerization aggregation method, and a dissolution suspension method carried out in an aqueous solvent are preferred, and an emulsion polymerization aggregation method is most preferred from the viewpoint of controlling the shape and particle diameter distribution.

Toner mother particles comprise a binding resin, a coloring agent and a releasing agent, and as appropriate, further comprise silica and a charge control agent.

Examples of the binding resins used in the toner mother particles include monopolymers and copolymers of styrenes such as styrene and chlorostyrene, monoolefins such as ethylene, propylene, butylene, and isoprene, vinyl esters such as vinyl acetate, vinyl propionate, vinyl benzoate, vinyl butyrate, a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone, and polyester resins synthesized by copolymerization of dicarboxylic acids and diols.

Examples of the typical binding resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and polyester resins. Other examples include polyurethane, epoxy resins, silicone resins, polyamide, modified rosin and paraffin wax.

Examples of the typical coloring agents include magnetic powder such as magnetite and ferrite, carbon black, aniline blue, chalcoyl blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Examples of the typical releasing agents include low-molecular polyethylene, low-molecular polypropylene, Fischer-Tropsch wax, montan wax, camauba wax, rice wax and candelilla wax.

As the charge control agent, known agents such as azo metal-complex compounds, metal-complex compounds of salicylic acid, and resin-type charge control agents having polar groups can be used. When toner particles are produced by a wet method, it is preferred to use materials hardly soluble in water from the viewpoint of controlling ion strength and reducing contamination by waste water. The toner may be either a magnetic toner which contains a magnetic material or a non-magnetic toner which contains no magnetic material.

The toner particles used in the developing device 11 can be produced by mixing the above-described toner mother particles and external additives using a Henschel mixer, a V blender or the like.

When the toner mother particles are produced by a wet process, external additives can be added by a wet method.

Lubricant particles may be added to the toner used in the developing device 11. Examples of the lubricant particles include solid lubricants such as graphite, molybdenum disulfide, talc, fatty acids and metal salts of fatty acids, low molecular weight polyolefins such as polypropylene, polyethylene and polybutene, silicones having a softening point by heating, fatty-acid amides such as oleic acid amide, erucic acid amide, ricinoleic acid amide and stearic acid amide, vegetable waxes such as camauba was, rice wax, candelilla wax, Japan wax and jojoba oil, animal waxes such as beeswax, mineral and petroleum waxes such as montan wax, ozokerite, ceresine, paraffin wax, microcrystalline wax and Fischer-Tropsch wax, and modified products thereof. These may be used alone or in combination of two or more kinds thereof. The average particle diameter is preferably in the range of 0.1 to 10 μm, and those having the above-described chemical structure may be ground into particles having the same particle diameter. The content of the particles in the toner is preferably in the range of 0.05 to 2.0 weight %, more preferably 0.1 to 1.5 weight %.

Inorganic particles, organic particles or composite particles to which inorganic particles are attached to the organic particles may be added to the toner particles used in the developing device 11 for the purpose of removing a deposition or a deterioration-inducing substance from the surface of an electrophotographic photoreceptor.

Examples of the appropriate inorganic particles include various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The above-described inorganic particles may be treated with titanium coupling agents such as tetrabutyl titanate, tetraoctyl titanate, isopropyltriisostearoyl titanate, isopropyltridecylbenzenesulfonyl titanate and bis(dioctylpyrophosphate)oxyacetate titanate, silane coupling agents such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane.

The above-described particles hydrophilized with metal salts of higher fatty acids such as silicone oil, stearic acid aluminum, stearic acid zinc and stearic acid calcium are also preferably used.

Examples of the organic particles include styrene resin particles, styrene acrylic resin particles, polyester resin particles and urethane resin particles.

The particle diameter based on the number average particle diameter is preferably 5 nm to 1000 nm, more preferably 5 nm to 800 nm, further preferably 5 nm to 700 nm. If the average particle diameter is less than the lower limit, the particles tend to have insufficient abrasive properties. On the other hand, if the average particle diameter exceeds the upper limit, the particles tend to scratch the surface of an electrophotographic photoreceptor. The total of the content of the above-described particles and lubricant particles is preferably 0.6 weight % or more.

As the other inorganic oxides added to the toner particles, small inorganic oxide particles having a primary diameter of 40 nm or less are preferably used from the viewpoint of powder mobility and charge control, and inorganic oxide particles having a larger diameter than that of the small inorganic oxide particles are preferably added from the viewpoint of adhesiveness reduction and charge control. Known inorganic oxide particles may be used, but the combination of silica and titanium oxide particles is preferred for precise charge control.

Surface treatment of small inorganic particles enhances the dispersibility and powder mobility of the particles. Furthermore, the addition of carbonates such as calcium carbonate and magnesium carbonate, and inorganic minerals such as hydrotalcite is also preferably used to remove discharge products.

Color toner particles for electrophotography are used in combination with carriers. Examples of the carrier include iron powder, glass beads, ferrite powder, nickel powder and those coated with a resin. The mixing ratio of the carriers can be determined as appropriate.

Examples of the transfer device 40 include known transfer charging devices such as a contact type transfer charging devices using a belt, a roller, a film, a rubber blade, a scorotron transfer charging device and a corotron transfer charging device utilizing corona discharge.

As the intermediate transfer body 50, a belt which is imparted semiconductivity (intermediate transfer belt) of polyimide, polyamide imide, polycarbonate, polyarylate, polyester, rubber or the like is used. The intermediate transfer body 50 may also take the form of a drum.

In addition to the above-described devices, the image forming apparatus 100 may further be provided with, for example, a photodischarge device for photodischarging the photoreceptor 7.

Figure 5:
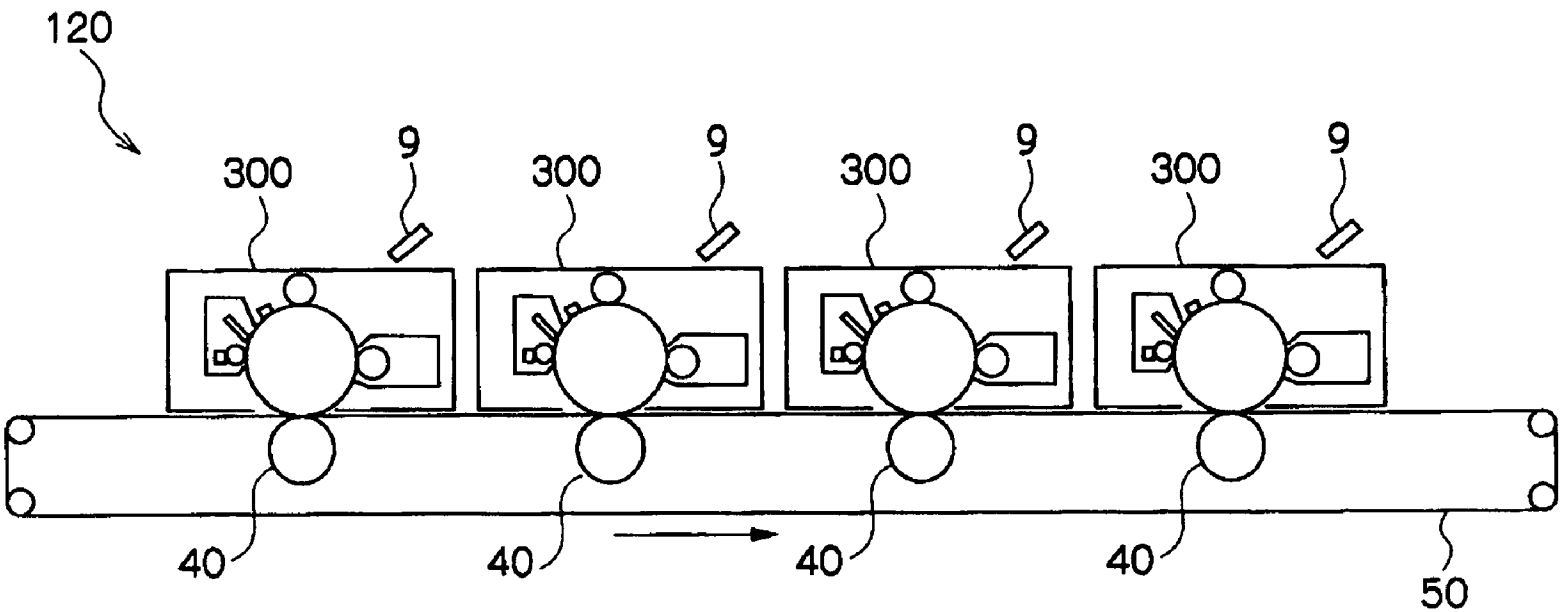
FIG. 5 is a schematic sectional view showing a tandem type image forming apparatus of the invention.

FIG. 5 is a schematic sectional view showing an embodiment of a tandem type image forming apparatus using a process cartridge including the electrophotographic photoreceptor of the invention.

The image forming apparatus 120 is a tandem type full color image forming apparatus equipped with four process cartridges 300. In the image forming apparatus 120, four process cartridges 300 are disposed parallel with each other on the intermediate transfer body 50, and one electrophotographic photoreceptor can be used for one color. The image forming apparatus 120 has the same constitution as the image forming apparatus 100, except being tandem type.

When the electrophotographic photoreceptor of the invention is used in a tandem type image forming apparatus, the electrical characteristics of the four photoreceptors are stabilized, which provides high image quality with excellent color balance over the long time.

EXAMPLES

The invention will now be illustrated in more detail with reference to examples. However, the invention is not limited to the examples.

<Synthesis of Phenolic Resin (1)>

500 g of phenol, 862 g of 35 weight % formaldehyde aqueous solution, and 5 g of sodium hydrate are put in a 2-L flask, heated at a temperature of 80° C. for 6 hours under a nitrogen gas stream, then water is removed under reduced pressure to obtain phenolic resin (1).

<Synthesis of Phenolic Resin (2)>

200 g of phenolic resin (1) is dissolved in 500 g of ethyl acetate, neutralized with 100 ml of 1N-hydrochloric acid, and thoroughly washed with water (the final pH of the aqueous phase is 5.3). The aqueous phase is removed, and the solvent is removed under reduced pressure to obtain 150 g of phenolic resin (2).

<Synthesis of Phenolic Resin (3)>

200 g of phenolic resin (1) is dissolved in 500 g of methanol, into which 50 g of an ion exchange resin (trade name: Amberlyst 15E, manufactured by Rohm and Haas Company) is added, stirred for 1 hour at room temperature, then the ion exchange resin is removed by filtration. The pH after 1 ml of the obtained solution is added to 10 ml of distilled water and stirred is 5.2. The solvent is removed under reduced pressure to obtain 195 g of phenolic resin (3).

<Synthesis of Phenolic Resin (4)>

500 g of phenol, 862 g of 35 weight % formaldehyde aqueous solution and 5 g of triethylamine are put in a 2-L flask, heated at a temperature of 80° C. for 6 hours under a nitrogen gas stream, then water is removed under reduced pressure to obtain phenolic resin (4).

<Synthesis of Phenolic Resin (5)>

200 g of phenolic resin (4) is dissolved in 500 g of ethyl acetate, neutralized with 10 ml of 1N-hydrochloric acid, and thoroughly washed with water (the final pH of the aqueous phase is 5.3). The aqueous phase is removed, and the solvent is removed under reduced pressure to obtain 145 g of phenolic resin (5).

<Synthesis of Phenolic Resin (6)>

200 g of phenolic resin (1) is dissolved in 500 g of methanol, into which 10 g of an ion exchange resin (trade name: Amberlyst 15E, manufactured by Rohm and Haas Company) is added and stirred for 1 hour at room temperature, then the ion exchange resin is removed by filtration. The pH after 1 ml of the obtained solution is added to 10 ml of distilled water and stirred is 5.4. The solvent is removed under reduced pressure to obtain 190 g of phenolic resin (6).

<Curing Catalysts>

As catalysts (1), (2) and (3), p-toluenesulfonic acid, NACURE 2500 (manufactured by King Industries, Inc.) and NACURE 5225 (manufactured by King Industries, Inc.) are used, respectively.

<pH Measurement of a Protective Film Extract>

The protective film is mechanically peeled from the photoreceptor. 0.1 g of the protective layer and 5 g of distilled water (prepared by Autostill WG75, manufactured by Yamato Scientific Co., Ltd.) are placed in a 10-ml sample bottle and tightly sealed, then shaken to extract at 60 rev/min with a shaker (trade name: Personal H-10, manufactured by Taitec Co. Ltd.) at room temperature for 24 hours. The pH of the solution is measured with a pH meter (trade name: HM-30V, manufactured by Toa Denpa Kogyo Ltd.) at a liquid temperature of 20° C. The measured pH is referred to be as $pH_{OCL}$.

In the same manner, the pH of the distilled water used for the measurement is measured with a pH meter (trade name: HM-30V, manufactured by Toa Denpa Kogyo Ltd.) at a liquid temperature of 20° C. The measured pH is referred to be as $pH_w$.

Example 1

(Preparation of Subbing Layer)

100 parts by weight of zinc oxide (average particle diameter: 70 nm, manufactured by Tayca Corporation, specific surface area: 15 $m^2/g$) is stirred and mixed with 500 parts by weight of tetrahydrofuran, into which 1.3 parts by weight of a silane coupling agent (trade name: KBM503, manufactured by Shin-Etsu Chemical Co., Ltd.) is added and stirred for 2 hours. Subsequently, solvent is removed by distillation under reduced pressure, and baking is carried out at a temperature of 120° C. for 3 hours to obtain the zinc oxide having the surface treated with the silane coupling agent.

110 parts by weight of the surface-treated zinc oxide is stirred and mixed with 500 parts by weight of tetrahydrofuran, into which a solution in which 0.6 parts by weight of alizarin is dissolved in 50 parts by weight of tetrahydrofuran is added, then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, trade name: Sumidur 3175, manufactured by Sumitomo-Bayer Urethane Co., Ltd.) and 15 parts by weight of a butyral resin (trade name: S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with the glass beads having a diameter of 1 mm for 2 hours to obtain a dispersion.

0.005 parts by weight of dioctyltin dilaurate as a catalyst, and 40 parts by weight of silicone resin particles (trade name: Tospal 145, manufactured by GE Toshiba Silicone Co., Ltd.) are added to the dispersion to obtain a coating solution for a subbing layer. A subbing layer having a thickness of 18 μm is formed by applying the coating solution on an aluminum substrate having a diameter of 30 mm, a length of 340 mm and a thickness of 1 mm by dip coating, and drying to cure at a temperature of 170° C. for 40 minutes.

(Preparation of Charge Generating Layer)

A mixture comprising 15 parts by weight of hydroxy gallium phthalocyanine having the diffraction peaks at least at 7.3°, 16.0°, 24.9° and 28.0° of Bragg angles (2θ±0.2°) in an X-ray diffraction spectrum of Cuka X ray as a charge generating substance, 10 parts by weight of vinyl chloride-vinyl acetate copolymer resin (trade name: VMCH, manufactured by Nippon Unicar Co., Ltd.) as a binding resin, and 200 parts by weight of n-butyl acetate is dispersed using a sand mill with the glass beads of 1 mm diameter for 4 hours. 175 parts by weight of n-butyl acetate and 180 parts by weight of methyl ethyl ketone are added to the obtained dispersion, then stirred to obtain a coating solution for a charge generating layer. The coating solution for charge generating layer is applied to the subbing layer by dip coating, and dried at an ordinary temperature to form a charge generating layer having a film thickness of 0.2 μm.

(Preparation of Charge Transporting Layer)

45 parts by weight of N,N'-diphenyl-N,N'-bis(3-methylphenyl)-[1,1']biphenyl-4,4 '-diamine and 55 parts by weight of bisphenol Z polycarbonate resin (viscosity average molecular weight: 40,000) are dissolved in 800 parts by weight of chlorobenzene to obtain a coating solution for a charge transporting layer. The coating solution is applied onto the charge generating layer, then dried at a temperature of 130° C. for 45 minutes to form a charge transporting layer having a film thickness of 20 μm.

(Preparation of Protective Layer)

3 parts by weight of the compound represented by Formula (I)-3, 3 parts by weight of phenolic resin (2), 0.3 parts by weight of colloidal silica (trade name: PL-1, manufactured by Fuso Chemical Co., Ltd.), 0.2 parts by weight of polyvinyl phenolic resin (weight average molecular weight: ca. 8,000, manufactured by Sigma-Aldrich Co.), 5 parts by weight of isopropylalcohol, 5 parts by weight of methyl isobutyl ketone, 0.2 parts by weight of 3,5-di-t-butyl-4-hydroxytoluene (BHT) and 0.1 parts by weight of catalyst (1) are mixed to prepare a coating solution for a protective layer, which is the coating agent composition of the present invention. The coating solution is applied onto the charge transporting layer by dip coating and air-dried at room temperature for 30 minutes, then cured by heating at 150° C. for 1 hour to form a protective layer having a film thickness of about 3.5 μm. The photoreceptor of Example 1 is thus prepared.

-Evaluation of Image Quality-

The electrophotographic photoreceptor prepared as described above is mounted on a DocuCentre Color 400CP (manufactured by Fuji Xerox Co., Ltd.), and a sequence of the evaluations as set forth below are conducted under conditions of low temperature and low humidity (8° C., 20% RH), and high temperature and high humidity (28° C., 85% RH), respectively.

Specifically, a 10,000-sheet image forming test is carried out under a condition of low temperature and low humidity (8° C., 20% RH). The image quality is evaluated according to the last sheet printed in the 10,000-sheet imaging test, and the first sheet printed after the electrophotographic photoreceptor is left for 24 hours under a condition of low temperature and low humidity (8° C., 20% RH) after completion of the 10,000-sheet image forming test. The evaluations are made on ghosts, fogs, streaks and image deletion. The results are shown in Table 2.

Subsequent to the above image-forming test, another 10,000-sheet image forming test is carried out under a condition of high temperature and high humidity (28° C., 85% RH). The image quality is evaluated according to the last sheet printed in the 10,000-sheet imaging test, and the first sheet printed after the electrophotographic photoreceptor is left for 24 hours under a condition of high temperature and high humidity (28° C., 85% RH) after completion of the second 10,000-sheet image forming test. The evaluations are made on ghosts, fogs, streaks and image deletion. The results are shown in Table 3.

<Ghosts>

Figure 6:
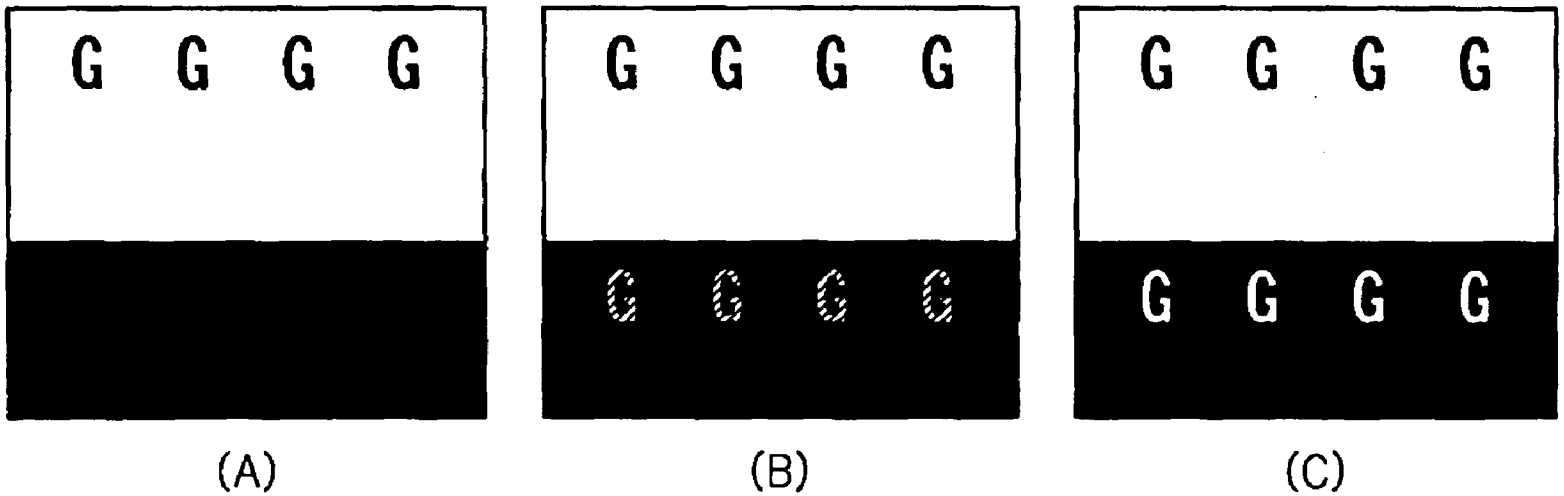
FIG. 6 (A) to FIG. 6 (C) are explanatory drawings showing criteria for a ghost evaluation.

As shown in FIG. 6(A), a pattern of letters G and a black solid area is printed to evaluate the visibility of the letters G appearing in the black solid area by visual observation.

A: Good or almost good as shown in FIG. 6(A).

B: Slightly visible as shown in FIG. 6(B).

C: Distinctly visible as shown in FIG. 6(C).

<Fogs>

The degree of toner adhesiveness to the white area is evaluated by visual observation using the same sample with the evaluation of ghost.

A: Good.

B: Light fog is developed.

C: Fog having a damaging effect of image quality is developed.

<Streaks>

Development of streaks is evaluated by visual observation using the same sample with the evaluation of ghost.

A: Good.

B: Streaks are partially developed.

C: Streaks having a damaging effect on image quality are developed.

<Image Deletion>

Image deletion is evaluated by visual observation using the same sample as the one used for evaluation of ghosts.

A: Good.

B: No problem occurs during the continuous printing test, but image deletion is observed after leaving the electrophotographic photoreceptor for 1 day (24 hours).

C: Image deletion is observed during the continuous printing test.

-Evaluation of Adhesiveness of the Protective Layer-

The surface of the photoreceptor after the image forming test is cut with a cutter to form a grid consisting of 5×5 squares, wherein each square has the size of 2×2 mm. A mending tape (manufactured by 3M Corp.) is applied onto the grid and peeled off. The evaluation of the adhesiveness is evaluated by the number of the remaining square after the mending tape is peeled off. The results are shown in Table 2.

A: 21 or more.

B: 11 or more and 20 or less.

C: 10 or less.

Examples 2 to 17

Photoreceptors 2 to 17 are prepared and evaluated in the same manner as Example 1, except that the charge transporting material, phenolic resin, additives, and catalyst are changed as shown in Table 1. The results are shown in Tables 2 and 3.

Example 18

A photoreceptor 18 having a protective layer is prepared in the same manner as Example 4, except that the charge transporting layer is formed in accordance with the method as described below. The evaluation is made in the same manner as the other examples. The results are shown in Tables 2 and 3.

(Formation of Charge Transporting Layer)

45 parts by weight of the following compound (A) and 55 parts by weight of bisphenol Z polycarbonate resin (viscosity average molecular weight: 40,000) are dissolved in 800 parts by weight of chlorobenzene to obtain a coating solution for charge transporting layer. The coating solution is applied to the charge generating layer, and dried at a temperature of 130° C. for 45 minutes to form a charge transporting layer having a film thickness of 20 μm.

Compound (A)

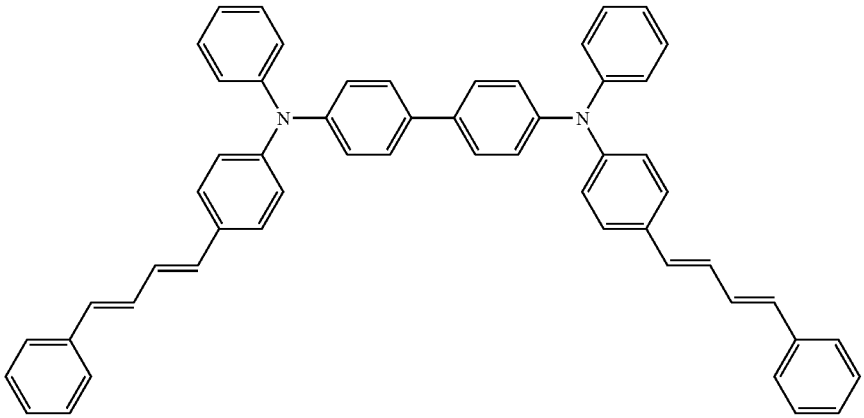

Example 19

A photoreceptor 19 having a protective layer is prepared in the same manner as Example 5, except that the charge transporting layer is formed in accordance with the method as described below. The evaluation is made in the same manner as the other examples. The results are shown in Tables 2 and 3.

(Formation of a Charge Transporting Layer)

50 parts by weight of the following compound (B) and 50 parts by weight of bisphenol Z polycarbonate resin (viscosity average molecular weight: 40,000) are dissolved in 800 parts by weight of chlorobenzene to obtain a coating solution for charge transporting layer. The coating solution is applied onto the charge generating layer, and dried at a temperature of 130° C. for 45 minutes to form a charge transporting layer having a film thickness of 20 μm.

Compound (B)

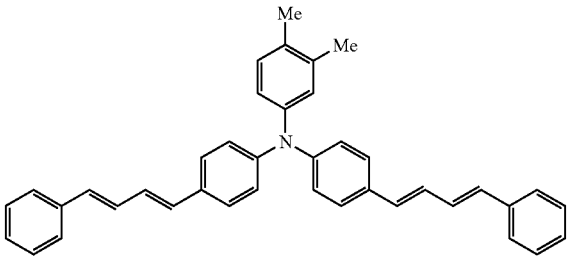

Example 20

A photoreceptor 20 having a protective layer is prepared in the same manner as Example 5, except that the charge transporting layer is formed in accordance with the method as described below. The evaluation is made in the same manner as the other examples. The results are shown in Tables 2 and 3.

(Formation of a Charge Transporting Layer)

50 parts by weight of the following compound (C) and 50 parts by weight of bisphenol Z polycarbonate resin (viscosity average molecular weight: 40,000) are dissolved in 800 parts by weight of chlorobenzene to obtain a coating solution for a charge transporting layer. The coating solution is applied onto the charge generating layer, and dried at 130° C. for 45 minutes to form a charge transporting layer having a film thickness of 20 μm.

Compound (C)

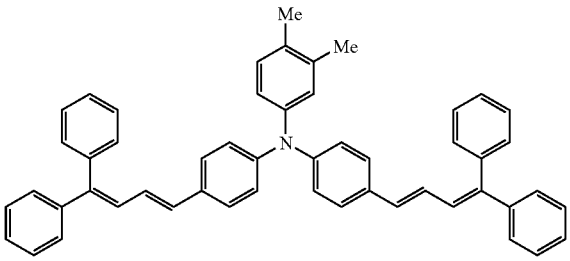

Comparative Examples 1 to 4

Comparative photoreceptors 1 to 4 are prepared and evaluated in the same manner with Example 1, except that the charge transporting material, phenolic resin, and additives used in Example 1 are changed to those as described in Table 1. The results are shown in Tables 2 and 3.

Comparative Examples 5 to 7

A solution containing 60 parts by weight of titanium oxide particles coated with antimony-doped tin oxide (trade name: CronosECT-62, manufactured by Titan Kogyo Kabushiki Kaisha), 60 parts by weight of titanium oxide (trade name: titone SR-1T, manufactured by Sakai Chemical Industry Co., Ltd.), 70 parts by weight of a resol type phenolic resin (trade name: Phenolite J-325, manufactured by Dainippon Ink And Chemicals, Inc., solids content: 70 weight %), 50 parts by weight of 2-methoxy-1-propanol and 50 parts by weight of methanol is dispersed using a ball mill for about 20 hours. The volume average particle diameter of the filler contained in the dispersion is 0.25 μm. The obtained dispersion is applied to the above-described aluminum cylinder by dip coating, and cured by heating at 140° C. for 30 minutes to form a resin layer having a film thickness of 15 μm. The layer is used in place of the subbing layer of Comparative Example 1 and comparative photoreceptors 5 to 7 are prepared and evaluated in the same manner with Example 1, except that the charge transporting material, phenolic resin, and additives shown in Table 1 are changed to those used in Comparative Example 1. The results are shown in Tables 2 and 3.

TABLE 1

| | Charge transporting material | Phenolic resin | Additives: Colloidal silica (Wt %) | Polyvinyl phenolic resin (Wt %) | BHT (Wt %) | catalytic agent | pHocl-pHw |
|---|---|---|---|---|---|---|---|
| Example 1 | (I)-3 | 2 | 0.3 | 0.2 | 0.2 | 1 | −3.5 |
| Example 2 | (I)-3 | 3 | 0.3 | 0.2 | 0.2 | 1 | −3.9 |
| Example 3 | (I)-3 | 1 | 0.3 | 0.3 | 0.2 | 1 | −1.5 |
| Example 4 | (I)-3 | 5 | — | — | — | 1 | −3.7 |
| Example 5 | (I)-3 | 6 | — | — | — | 1 | −3.8 |
| Example 6 | (I)-3 | 5 | 0.3 | 0.2 | 0.2 | 2 | −0.3 |
| Example 7 | (I)-3 | 5 | 0.3 | 0.2 | 0.2 | 3 | 0.4 |
| Example 8 | (II)-6 | 5 | — | — | — | 3 | 0.1 |
| Example 9 | (II)-15 | 5 | 0.1 | 0.2 | 0.2 | 3 | −0.1 |
| Example 10 | (II)-15 | 5 | 0.3 | 0.2 | 0.2 | 3 | 0.3 |
| Example 11 | (III)-9 | 6 | 0.3 | 0.2 | 0.2 | 2 | 0.3 |
| Example 12 | (IV)-4 | 5 | — | — | — | 3 | 0.2 |
| Example 13 | (V)-3 | 2 | 0.3 | 0.2 | 0.2 | 1 | −3.7 |
| Example 14 | (V)-3 | 3 | — | — | — | 2 | −0.1 |
| Example 15 | (V)-3 | 5 | — | — | — | 3 | −0.3 |
| Example 16 | (V)-3 | 6 | — | — | — | 2 | −0.1 |
| Example 17 | (V)-9 | 6 | — | — | — | 3 | 0.1 |
| Example 18 | (I)-3 | 5 | — | — | — | 1 | −3.7 |
| Example 19 | (I)-3 | 6 | — | — | — | 1 | −3.8 |
| Example 20 | (I)-3 | 6 | — | — | — | 1 | −3.8 |
| Comp. Example 1 | (I)-3 | 1 | 0.3 | 0.2 | 0.2 | — | 3.1 |
| Comp. Example 2 | (I)-3 | 4 | 0.3 | 0.2 | 0.2 | — | 1.0 |
| Comp. Example 3 | (II)-6 | 1 | 0.5 | 0.2 | 0.2 | — | 2.9 |
| Comp. Example 4 | (II)-15 | 4 | 0.3 | 0.5 | 0.2 | — | 0.8 |
| Comp. Example 5 | (III)-9 | 4 | — | — | — | — | 0.9 |
| Comp. Example 6 | (IV)-4 | 4 | 0.3 | 0.2 | 0.2 | — | 1.1 |
| Comp. Example 7 | (V)-3 | 1 | — | — | — | — | 2.5 |

TABLE 2-1

| | Low-temperature and Low-humidity (8° C., 20% RH) After 10,000 image forming test | | | | |
|---|---|---|---|---|---|
| | Adhesion | Ghosts | Fogs | Streaks | Image deletion |
| Example 1 | A | A | A | A | A |
| Example 2 | A | A | A | A | A |
| Example 3 | A | A | B | A | A |
| Example 4 | B | A | A | A | A |
| Example 5 | B | A | A | A | A |
| Example 6 | A | A | A | A | A |
| Example 7 | A | A | A | A | A |

TABLE 2-1-continued

| | Low-temperature and Low-humidity (8° C., 20% RH) After 10,000 image forming test | | | | |
|---|---|---|---|---|---|
| | Adhesion | Ghosts | Fogs | Streaks | Image deletion |
| Example 8 | A | A | A | A | A |
| Example 9 | A | A | A | A | A |
| Example 10 | A | A | A | A | A |
| Example 11 | A | A | A | A | A |
| Example 12 | A | A | A | A | A |
| Example 13 | B | A | A | A | A |
| Example 14 | A | A | A | A | A |
| Example 15 | A | A | A | A | A |
| Example 16 | A | A | A | A | A |
| Example 17 | A | A | B | A | A |

TABLE 2-1-continued

| | Low-temperature and Low-humidity (8° C., 20% RH) After 10,000 image forming test | | | | |
|---|---|---|---|---|---|
| | Adhesion | Ghosts | Fogs | Streaks | Image deletion |
| Example 18 | A | A | A | A | A |
| Example 19 | A | A | A | A | A |
| Example 20 | A | A | A | A | A |
| Comp. Example 1 | C | C | B | A | A |
| Comp. Example 2 | C | C | B | A | A |
| Comp. Example 3 | C | C | B | A | A |
| Comp. Example 4 | C | C | B | A | A |

TABLE 2-1-continued

| | | Low-temperature and Low-humidity (8° C., 20% RH) After 10,000 image forming test | | | |
|---|---|---|---|---|---|
| | Adhesion | Ghosts | Fogs | Streaks | Image deletion |
| Comp. Example 5 | C | C | B | A | A |
| Comp. Example 6 | C | C | B | A | A |
| Comp. Example 7 | C | C | B | A | A |

TABLE 2-2

| | Low-temperature and Low-humidity (8° C., 20% RH) After 1 day left | | | |
|---|---|---|---|---|
| | Ghosts | Fogs | Streaks | Image deletion |
| Example 1 | A | A | A | A |
| Example 2 | A | A | A | A |
| Example 3 | A | B | A | A |
| Example 4 | A | A | A | A |
| Example 5 | A | A | A | A |
| Example 6 | A | A | A | A |
| Example 7 | A | A | A | A |
| Example 8 | A | A | A | A |
| Example 9 | A | A | A | A |
| Example 10 | A | A | A | A |
| Example 11 | A | A | A | A |
| Example 12 | A | A | A | A |
| Example 13 | A | A | A | A |
| Example 14 | A | A | A | A |
| Example 15 | A | A | A | A |
| Example 16 | A | A | A | A |
| Example 17 | A | A | B | A |
| Example 18 | A | A | A | A |
| Example 19 | A | A | A | A |
| Example 20 | A | A | A | A |
| Comp. Example 1 | C | A | A | A |
| Comp. Example 2 | C | A | A | A |
| Comp. Example 3 | C | A | A | A |
| Comp. Example 4 | C | A | A | A |
| Comp. Example 5 | C | A | A | A |
| Comp. Example 6 | C | A | A | A |
| Comp. Example 7 | C | A | A | A |

TABLE 3-1

| | High-temperature and High-humidity (28° C., 85% RH) After 10,000 image forming test | | | |
|---|---|---|---|---|
| | Ghosts | Fogs | Streaks | Image deletion |
| Example 1 | A | A | A | B |
| Example 2 | A | A | A | B |
| Example 3 | A | A | A | A |
| Example 4 | A | A | B | B |
| Example 5 | A | A | A | B |
| Example 6 | A | A | A | A |
| Example 7 | A | A | A | A |
| Example 8 | A | A | A | A |
| Example 9 | A | A | A | A |
| Example 10 | A | A | A | A |
| Example 11 | A | A | A | A |
| Example 12 | A | A | B | B |
| Example 13 | A | A | A | A |
| Example 14 | A | A | A | A |
| Example 15 | A | A | A | A |

TABLE 3-1-continued

| | High-temperature and High-humidity (28° C., 85% RH) After 10,000 image forming test | | | |
|---|---|---|---|---|
| | Ghosts | Fogs | Streaks | Image deletion |
| Example 16 | A | A | A | A |
| Example 17 | A | A | A | A |
| Example 18 | A | A | B | B |
| Example 19 | A | A | A | B |
| Example 20 | A | A | A | B |
| Comp. Example 1 | B | A | A | B |
| Comp. Example 2 | B | A | A | B |
| Comp. Example 3 | B | A | A | B |
| Comp. Example 4 | B | A | A | B |
| Comp. Example 5 | B | A | A | B |
| Comp. Example 6 | B | A | A | B |
| Comp. Example 7 | B | A | A | B |

TABLE 3-2

| | High-temperature and High-humidity (28° C., 85% RH) After 1 day left | | | |
|---|---|---|---|---|
| | Ghosts | Fogs | Streaks | Image deletion |
| Example 1 | A | A | A | B |
| Example 2 | A | A | A | B |
| Example 3 | A | B | A | B |
| Example 4 | A | A | A | B |
| Example 5 | A | A | A | B |
| Example 6 | A | A | A | A |
| Example 7 | A | A | A | A |
| Example 8 | A | A | A | A |
| Example 9 | A | A | A | A |
| Example 10 | A | A | A | A |
| Example 11 | A | A | A | A |
| Example 12 | A | A | A | A |
| Example 13 | A | A | A | A |
| Example 14 | A | A | A | A |
| Example 15 | A | A | A | A |
| Example 16 | A | A | A | A |
| Example 17 | A | A | A | A |
| Example 18 | A | A | A | B |
| Example 19 | A | A | A | B |
| Example 20 | A | A | A | B |
| Comp. Example 1 | B | A | A | B |
| Comp. Example 2 | B | A | A | B |
| Comp. Example 3 | B | A | A | B |
| Comp. Example 4 | B | A | A | B |
| Comp. Example 5 | B | A | A | B |
| Comp. Example 6 | B | A | A | B |
| Comp. Example 7 | B | A | A | B |

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising a conductive substrate having a photosensitive layer and a protective layer thereon, the protective layer comprising a crosslinked film having a phenolic structure, in which the relationship between the pH of the exfoliated protective layer extracted with distilled water ($pH_{OCL}$) and the pH of said distilled water ($pH_w$) satisfies the following Formula (A):

$$pH_{OCL}-pH_w \leqq 0.5 \quad \text{Formula (A).}$$

2. The electrophotographic photoreceptor according to claim 1, wherein the protective layer comprises a film which is cured after a solution comprising a phenolic resin and at least one compound selected from the group consisting of the following Formulae (I) to (V) is applied on the surface of the electrophotographic photoreceptor:

$$F—[(X_1)_nR_1—CO_2H]_m \quad \text{Formula (I)}$$

wherein in Formula (I), F represents an organic group derived from a compound having a hole transporting ability, $R_1$ represents an alkylene group, m denotes an integral number of 1 to 4, $X_1$ represents an oxygen atom or a sulfur atom, and n denotes 0 or 1;

$$F—[(X_2)_{n1}—(R_2)_{n2}—(Z_2)_{n3}G]_{n4} \quad \text{Formula (II)}$$

wherein in Formula (II), F represents an organic group derived from a compound having a hole transporting ability, $X_2$ represents an oxygen atom or a sulfur atom, $R_2$ represents an alkylene group, $Z_2$ represents an alkylene group, an oxygen atom, a sulfur atom, NH or COO, G represents an epoxy group, n1, n2 and n3 each independently denotes an integral number of 0 or 1, and n4 denotes an integral number of 1 to 4;

Formula (III)

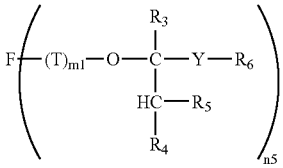

wherein in Formula (III), F represents an organic group having a valence of n5 and a hole transporting ability, T represents a divalent group, Y represents an oxygen atom or a sulfur atom, $R_3$, $R_4$ and $R_5$ each independently represent a hydrogen atom or a monovalent organic group, $R_6$ represents a monovalent organic group, m1 denotes an integral number of 0 or 1, n5 denotes an integral number of 1 to 4, and $R_5$ and $R_6$ may be bonded to each other to form a heterocyclic ring with Y as the heteroatom;

Formula (IV)

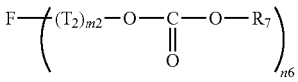

wherein in Formula (IV), F represents an organic group having a valence of n6 and a hole transporting ability, $T_2$ represents a divalent group, $R_7$ represents a monovalent organic group, m2 denotes an integral number of 0 or 1, and n6 denotes an integral number of 1 to 4;

Formula (V)

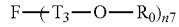

wherein in Formula (V), F represents an organic group having a valence of n7 and a hole transporting ability, $T_3$ represents a divalent alkylene group, $R_0$ represents a monovalent organic group, and n7 denotes an integral number of 1 to 4.

3. The electrophotographic photoreceptor according to claim 1, wherein the crosslinked film having the phenolic structure is formed by using a coating agent composition containing a phenol-based resin obtained by dissolving a crosslinking film precursor material having a phenolic structure in a solvent and bringing the material into contact with an acidic substance.

4. The electrophotographic photoreceptor according to claim 3, wherein the crosslinking film precursor material having a phenolic structure is a resol phenolic resin.

5. The electrophotographic photoreceptor according to claim 3, wherein the acidic substance is a solid acid.

6. The electrophotographic photoreceptor according to claim 1, wherein the crosslinked film having the phenolic structure has a charge transporting property.

7. The electrophotographic photoreceptor according to claim 1, wherein the protective layer contains a curing catalyst.

8. The electrophotographic photoreceptor according to claim 1, wherein the protective layer contains conductive particles.

9. The electrophotographic photoreceptor according to claim 1, wherein the protective layer contains a coupling agent.

10. The electrophotographic photoreceptor according to claim 1, wherein the protective layer contains a fluorine compound.

11. The electrophotographic photoreceptor according to claim 1, wherein the protective layer contains a resin that is soluble in an alcohol.

12. The electrophotographic photoreceptor according to claim 1, wherein the protective layer contains an antioxidant.

13. The electrophotographic photoreceptor according to claim 1, wherein the protective layer contains silicon-containing particles.

14. The electrophotographic photoreceptor according to claim 1, wherein a subbing layer is provided between the conductive substrate and the photosensitive layer.

15. An electrophotographic process cartridge integrally comprising the electrophotographic photoreceptor according to claim 1 and at least one selected from the group consisting of a charging device and an exposure device, the process cartridge being detachable from the main body of the image forming apparatus.

16. An image forming apparatus comprising the electrophotographic photoreceptor according to claim 1 and a charging device for charging the surface of the electrophotographic photoreceptor, an exposure device for forming an electrostatic latent image by exposing the surface of the electrophotographic photoreceptor, a developing device for developing the electrostatic latent image, and a transfer device for transferring a developed image to an image receiving medium.

* * * * *